US012492026B2

(12) United States Patent
Takidis et al.

(10) Patent No.: US 12,492,026 B2
(45) Date of Patent: Dec. 9, 2025

(54) STRAP-TENSIONING ASSEMBLY WITH SELF-ENERGIZING TRANSITIONING WHEEL, AND STRAP-SIZE-ADJUSTMENT FEATURES

(71) Applicant: Signode Industrial Group LLC, Tampa, FL (US)

(72) Inventors: Dimitrios Takidis, Dübendorf (CH); Philipp Buser, Erlinsbach (CH); Christian Benz, Zürich (CH); Michael Meng, Gipf-Oberfrick (CH)

(73) Assignee: SIGNODE INDUSTRIAL GROUP LLC, Tampa, FL (US)

( * ) Notice: Subject to any disclaimer, the term of this patent is extended or adjusted under 35 U.S.C. 154(b) by 285 days.

(21) Appl. No.: 18/257,453

(22) PCT Filed: Nov. 1, 2021

(86) PCT No.: PCT/US2021/072148

§ 371 (c)(1),
(2) Date: Jun. 14, 2023

(87) PCT Pub. No.: WO2022/140713

PCT Pub. Date: Jun. 30, 2022

(65) Prior Publication Data

US 2024/0367832 A1 Nov. 7, 2024

Related U.S. Application Data

(60) Provisional application No. 63/187,026, filed on May 11, 2021, provisional application No. 63/129,724, filed on Dec. 23, 2020.

(51) Int. Cl.
*B65B 13/22* (2006.01)
*B65B 13/06* (2006.01)
(Continued)

(52) U.S. Cl.
CPC ..... *B65B 13/22* (2013.01); *B65B 13/24* (2013.01)

(58) Field of Classification Search
CPC ..... B65B 13/22; B65B 13/24; B65B 13/06; B65B 13/185; B65B 59/003; B65B 59/02; B65B 59/04; B65B 65/02
See application file for complete search history.

(56) References Cited

U.S. PATENT DOCUMENTS 5,459,977 A * 10/1995 Haberstroh ..... B65B 13/18 53/399
6,584,892 B2 7/2003 Flaum et al.
(Continued)

FOREIGN PATENT DOCUMENTS

CN 1703348 A 11/2005
JP H08310508 A 11/1996

OTHER PUBLICATIONS

First Office Action and Search Report, from corresponding Chinese Patent Application No. 202180086842.1, including English translation, Jun. 16, 2025.
(Continued)

*Primary Examiner* — Mohammed S. Alawadi
(74) *Attorney, Agent, or Firm* — Neal, Gerber & Eisenberg LLP

(57) ABSTRACT

Various embodiments of the present disclosure provide a strapping machine strap-tensioning assembly with a self-energizing tensioning wheel and features that enable adjustment of the strap-tensioning assemblies for use with different strap sizes.

20 Claims, 40 Drawing Sheets

(51) Int. Cl.

| | |
|---|---|
| ***B65B 13/18*** | (2006.01) |
| ***B65B 13/24*** | (2006.01) |
| ***B65B 59/00*** | (2006.01) |
| ***B65B 59/02*** | (2006.01) |
| ***B65B 59/04*** | (2006.01) |
| ***B65B 65/02*** | (2006.01) |

(56) References Cited

U.S. PATENT DOCUMENTS

| | | | |
|---|---|---|---|
| 6,598,379 | B2 | 7/2003 | Zitella et al. |
| 6,604,339 | B2 | 8/2003 | Zitella et al. |
| 6,629,398 | B2 | 10/2003 | Pearson et al. |
| 6,857,252 | B2 | 2/2005 | Haberstroh et al. |
| 6,871,584 | B2 | 3/2005 | Pearson |
| 6,935,227 | B2 | 8/2005 | Lopez et al. |
| 6,955,119 | B2 | 10/2005 | Bobren et al. |
| 7,270,055 | B1 | 9/2007 | Haberstroh et al. |
| 7,287,464 | B1 | 10/2007 | Kirar et al. |
| 7,377,213 | B1 | 5/2008 | Haberstroh et al. |
| 7,428,867 | B1 | 9/2008 | Bell |
| 7,454,877 | B2 | 11/2008 | Morrison |
| 7,798,060 | B2 | 9/2010 | Pearson et al. |
| 8,281,711 | B2 | 10/2012 | Haberstroh et al. |
| 8,607,695 | B2 | 12/2013 | Schwede |
| 8,689,684 | B2 | 4/2014 | Haberstroh et al. |
| 8,701,555 | B2 | 4/2014 | Bell |
| 8,720,326 | B2 | 5/2014 | Elliott et al. |
| 9,296,501 | B2 | 3/2016 | Haberstroh et al. |
| 10,351,275 | B2 | 7/2019 | Elliott |
| 10,513,358 | B2 | 12/2019 | Takidis et al. |
| 10,633,130 | B2 | 4/2020 | Haberstroh et al. |
| 11,440,689 | B2 | 9/2022 | Foy et al. |
| 11,597,546 | B2 | 3/2023 | Höhn et al. |
| 2002/0179173 | A1 | 12/2002 | Marsche |
| 2016/0332756 | A1* | 11/2016 | Elliott ..... B65B 13/32 |
| 2019/0050663 | A2* | 2/2019 | Huber ..... B65B 13/06 |

OTHER PUBLICATIONS

"International Search Report and Written Opinion", from corresponding PCT Application No. PCT/US2021/072148, Jun. 10, 2022.

* cited by examiner

STRAP-TENSIONING ASSEMBLY WITH SELF-ENERGIZING TRANSITIONING WHEEL, AND STRAP-SIZE-ADJUSTMENT FEATURES

PRIORITY CLAIM

This application is a national phase application of PCT/US2021/072148, filed on Nov. 1, 2021, which claims priority to and the benefit of U.S. Provisional Patent Application No. 63/129,724, filed Dec. 23, 2020, and U.S. Provisional Patent Application No. 63/187,026, filed May 11, 2021, the entire contents of each of which are incorporated herein by reference.

FIELD

The present disclosure relates to strapping machines, and more particularly to strapping machine strap-tensioning assemblies with self-energizing tensioning wheels and features that enable adjustment of the strap-tensioning assemblies for use with different strap sizes.

BACKGROUND

A strapping machine forms a tensioned loop of plastic strap (such as polyester or polypropylene strap) or metal strap (such as steel strap) around a load. A typical strapping machine includes a support surface that supports the load, a strap chute that circumscribes the support surface, a strapping head that forms the strap loop, a controller that controls the strapping head to strap the load, and a frame that supports these components. A typical strapping head includes a strap-feeding assembly for feeding strap from a strap supply into and around the strap chute and for retracting the strap so it exits the strap chute and moves radially inwardly into contact with the load, a strap-tensioning assembly for tensioning the strap around the load, and a strap-sealing assembly for cutting the strap from the strap supply and attaching two areas of the strap together to form the strap loop. Each of these assemblies includes a guide that defines a strap channel that the strap passes through as it moves through the assembly. The strap channels and the strap chute together define a strap path that the strap moves through.

To strap the load, the strap-feeding assembly feeds strap (leading strap end first) from the strap supply through the strap-tensioning assembly, through the strap-sealing assembly, into and around the strap chute until the leading strap end returns to the strap-sealing assembly. While the strap-sealing assembly holds the leading strap end, the strap-feeding assembly retracts the strap to pull the strap out of the strap chute and onto and around the load. The strap-tensioning assembly then moves a tensioning wheel into contact with the strap and drives the tensioning wheel to tension the strap to a designated strap tension. The strap-sealing assembly cuts the strap from the strap supply to form a trailing strap end and attaches the leading and trailing strap ends to one another, thereby forming a tensioned strap loop around the load.

To ensure that the strap-feeding assembly can feed and retract the strap without interference from the strap-tensioning assembly, the tensioning wheel is in a retracted position during strap feeding and strap retraction. When it's time to tension the strap, the tensioning wheel must be moved from the retracted position into contact with the strap. Certain known strap-tensioning assemblies include an actuator operably connected to the tensioning wheel to control movement of the tensioning wheel to and from its retracted position into and out of contact with the strap. These actuators take up space, add weight, add mechanical and programming complexity, and (like all mechanical components) can wear and eventually fail (requiring purchase and installation of replacement parts).

Different applications require strap of different sizes. For instance, strap that is 8 millimeters wide and 0.3 millimeters thick may be used for light-duty applications, while strap that is 16 millimeters wide and 0.85 millimeters thick may be used for heavy-duty applications. Certain known strapping machines are configured so they can operate with strap of different widths and thicknesses. The strap-tensioning assemblies (and in some cases the strap-feeding and/or strap-sealing assemblies) of these strapping machines have guide members that define fixed-width and fixed-thickness strap channels that are sized to accommodate the widest and thickest strap used with those strapping machines. These fixed-width and fixed-thickness strap channels become problematic when smaller-width and/or thinner strap is used. Specifically, since there is more empty space in the strap channels when smaller-width and/or thinner strap is used, the strap tends to "wander" laterally and/or vertically in the strap channel and can snag and become stuck in the strap channel. This results in a strap mis-feed and requires the strap-feeding assembly to retract the strap and re-feed it, which results in unwanted downtime. It could also damage the leading end of the strap, leading to material waste or (if not recognized) sub-optimal welds.

SUMMARY

Various embodiments of the present disclosure provide a strapping machine strap-tensioning assembly with a self-energizing tensioning wheels and features that enable adjustment of the strap-tensioning assemblies for use with different strap sizes.

Certain embodiments of the strap-tensioning assembly include a strap-tensioning-assembly frame; a counter-roller assembly supported by the strap-tensioning-assembly frame and comprising a counter roller; a tensioning assembly supported by the strap-tensioning-assembly frame and including: a tensioning-wheel assembly including: a tensioning-wheel-assembly shaft defining a rotational axis; a tensioning wheel mounted to the tensioning-wheel-assembly shaft and rotatable about the rotational axis, wherein the tensioning-wheel assembly is movable from a retracted position in which the tensioning wheel is a first distance from the counter roller and a tensioning position in which the tensioning wheel is a smaller second distance from the counter roller; and a tensioning-wheel positioner mounted to the tensioning-wheel-assembly shaft and rotatable about the rotational axis from a retracted rotational position to a tensioning rotational position to move the tensioning-wheel assembly from its retracted position to its tensioning position; and a tensioning actuator operably connectable to the tensioning wheel to rotate the tensioning wheel about the rotational axis in a tensioning rotational direction.

Certain methods method of tensioning strap with a strap-tensioning assembly include: rotating a tensioning-wheel positioner about a rotational axis from a retracted rotational position to a tensioning rotational position to cause a tensioning-wheel assembly comprising a tensioning wheel to move from a retracted position to a tensioning position to force the strap against a counter roller; and rotating the tensioning wheel to apply a tensioning force to the strap.

Other embodiments of the strap-tensioning assembly include a strap-tensioning-assembly frame; and a tensioning assembly supported by the strap-tensioning-assembly frame and including: a tensioning-wheel assembly including: a tensioning-wheel-assembly shaft defining a rotational axis; a tensioning-wheel mount mounted to the tensioning-wheel-assembly shaft and rotatable about the rotational axis; a tensioning wheel removably mounted to the tensioning-wheel mount and rotatable with the tensioning-wheel mount about the rotational axis; and a tensioning-wheel retainer mounted to the tensioning-wheel mount to retain the tensioning wheel in place on the tensioning when mount and removable from the tensioning-wheel mount to enable removal of the tensioning wheel from the tensioning-wheel mount; and a tensioning actuator operably connectable to the tensioning wheel to rotate the tensioning wheel about the rotational axis.

DETAILED DESCRIPTION

Figure 1:
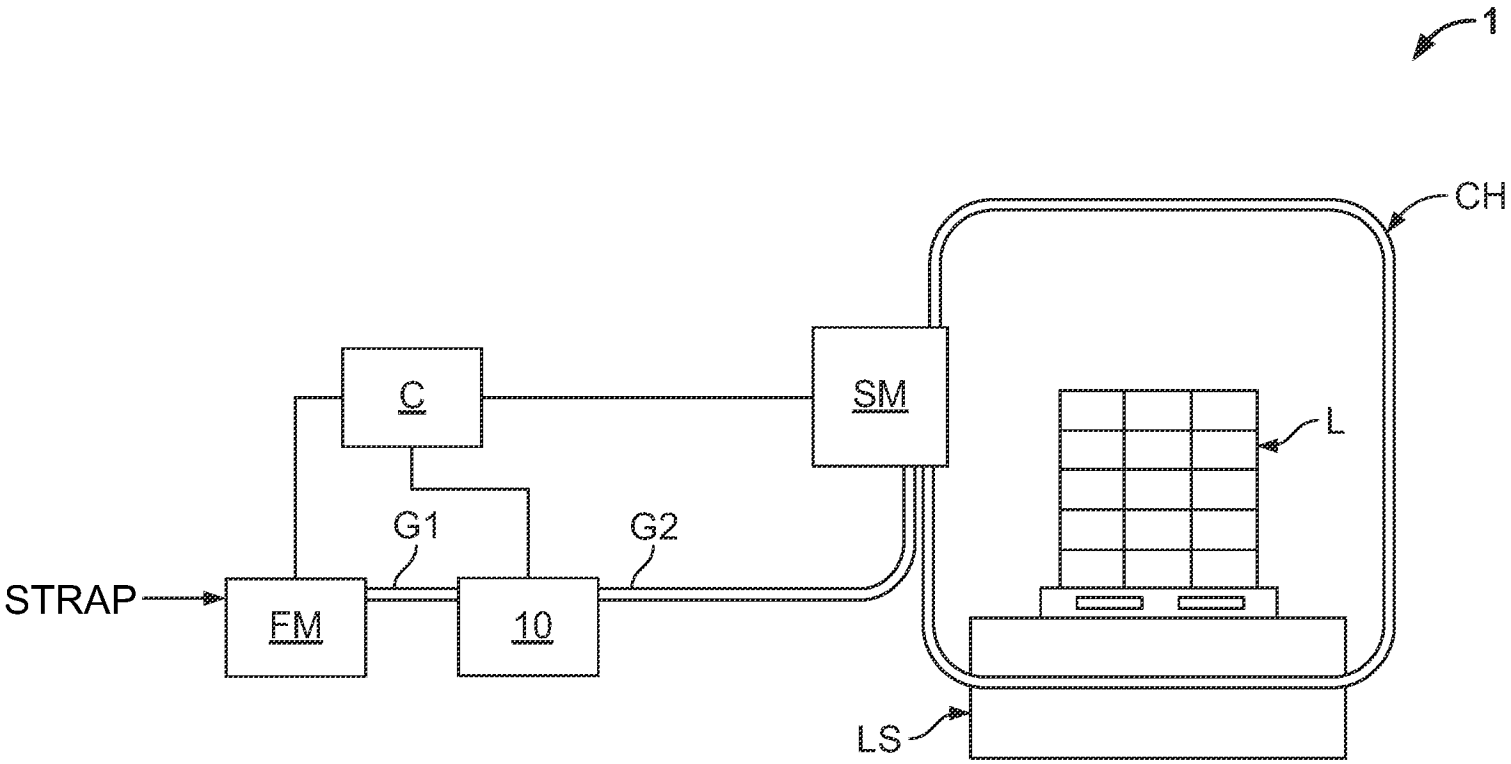
FIG. 1 is a diagrammatic view of one example embodiment of a strapping machine of the present disclosure.
Figure 2:
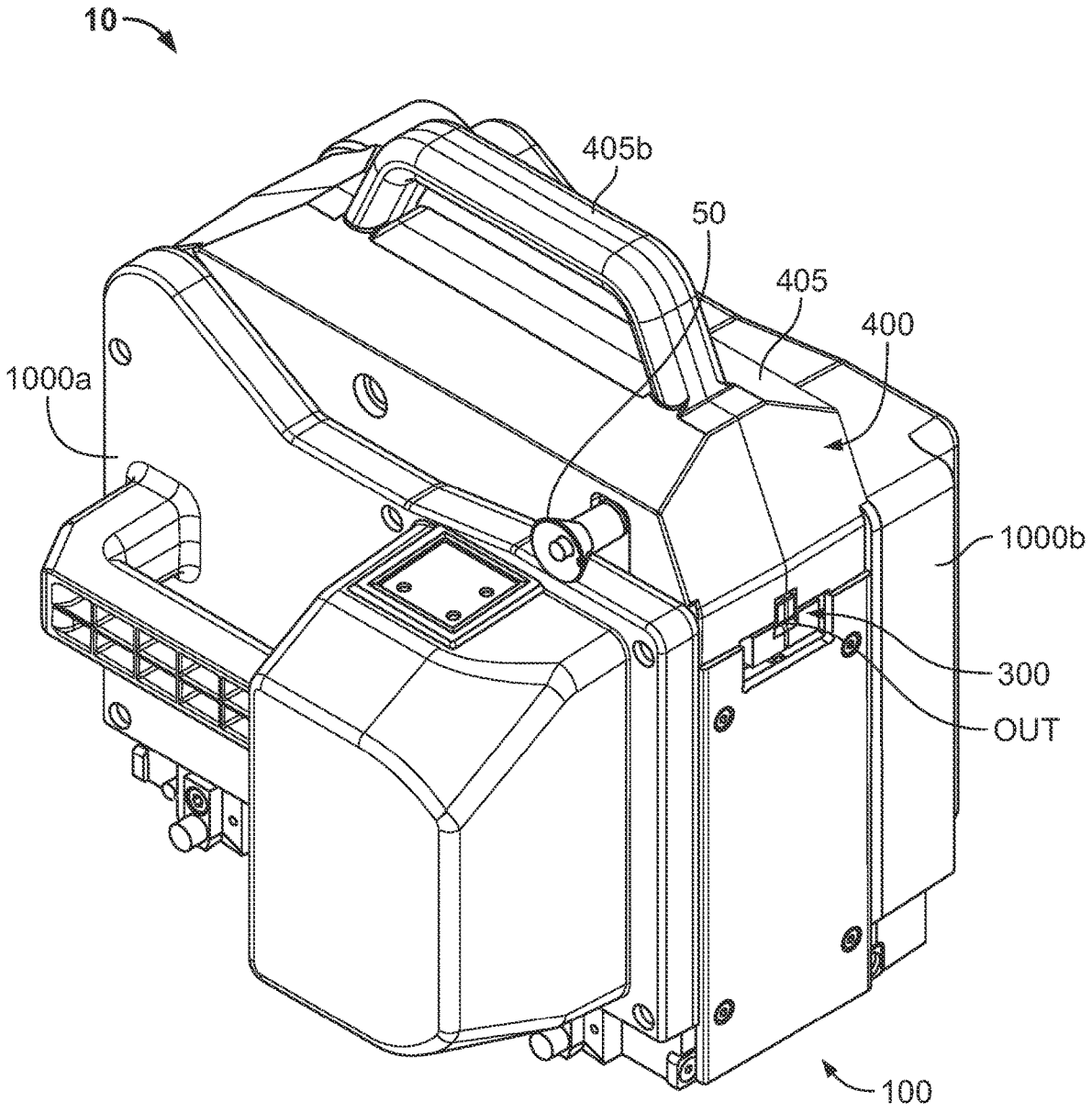
FIG. 2 is a perspective view of one example embodiment of a strap-tensioning assembly of the strapping machine of FIG. 1 with its upper strap-guiding assembly in its closed position.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

FIG. 1 shows one example embodiment of a strapping machine 1 of the present disclosure and components thereof in a simplified manner for clarity. The strapping machine 1 is configured to form a tensioned loop of strap around a load and includes a strapping-machine frame (not shown), a strap chute CH, a load supporter LS, a strap-feeding assembly FM, a strap-tensioning assembly 10, a strap-sealing assembly SM, guides G1 and G2, and a controller C.

The strapping-machine frame is configured to support some (or all) of the other components of the strapping machine 1 and may be formed of any suitable components arranged in any suitable configuration. The load supporter LS is configured to support loads—such as the palletized load L—as they are strapped by and as they move through the strapping machine 1. The load supporter LS includes a support surface (not labeled) on which loads are positioned during strapping and over which loads move as they move through the strapping machine 1. In this example embodiment, the support surface includes multiple rollers that facilitate movement of the loads through the strapping machine 1. The rollers may be driven or undriven. In other embodiments, the support surface includes a driven conveyor instead of rollers.

The strap chute CH circumscribes the support surface of the load supporter LS and defines a strap path that the strap follows when fed through the strap chute CH and from which the strap is removed when retracted. The strap chute CH includes two spaced-apart first and second upstanding legs (not labeled), an upper connecting portion (not labeled) that spans the first and second legs, a lower connecting portion (not labeled) that spans the first and second legs and is positioned in the load supporter LS, and elbows (not labeled) that connect these portions. As is known in the art, the radially inward wall of the strap chute CH is formed from multiple overlapping gates that are spring biased to a closed position that enables the strap to traverse the strap path when fed through the strap chute CH. When the strap-feeding assembly FM exerts a pulling force on the strap to retract the strap, the pulling force overcomes the biasing force of the springs and causes the gates to pivot to an open position, thereby releasing the strap from the strap chute CH so the strap moves radially inward into contact with the load L.

The strap-feeding assembly FM, the strap-tensioning assembly 10, and the strap-sealing assembly SM are together configured to form a tensioned strap loop around the load by feeding the strap through the strap chute CH, holding the leading strap end while retracting the strap to remove it from the strap chute CH so it contacts the load L, tensioning the strap around the load L to a designated tension, cutting the strap from the strap supply to form a trailing strap end, and connecting the leading strap end and the trailing strap end to one another. In this example embodiment, the strap-feeding assembly FM, the strap-tensioning assembly 10, and the strap-sealing assembly SM are distinct modules that are individually attachable to and removable from the strapping-machine frame. The guide G1 extends between the strap-feeding and strap-tensioning assemblies FM and 10 and is configured to guide the strap as it moves between those assemblies. The guide G2 extends between the strap-tensioning and strap-sealing assembly 10 and SM and is configured to guide the strap as it moves between those assemblies. In other embodiments these assemblies form a strapping head that is not comprised of self-contained and individually removable modules.

Generally, the strap-feeding assembly FM is configured to feed strap from a strap supply (not shown) and into and around the strap chute CH and to retract the strap so it exits the strap chute CH and contacts the load L.

Generally, and as described in detail below with respect to FIGS. 2-14C, the strap-tensioning assembly 10 is configured to tension the strap around the load L. The strap-tensioning assembly includes a tensioning wheel driven by a tensioning actuator. Once the strap-feeding assembly FM retracts the strap so it contacts the load L, the tensioning actuator drives the tensioning wheel to tension the strap to a designated (typically preset) tension.

Generally, the strap-sealing assembly SM is configured to, after the strap-tensioning assembly 10 tensions the strap to the designated tension, cut the strap from the strap supply and attach the leading and trailing strap ends to one another to form the strap loop. The manner of attaching the leading and trailing strap ends to one another depends on the type of strapping machine and the type of strap. Certain strapping machines configured for plastic strap include a strap-sealing assembly with a friction welder, a heated blade, or an ultrasonic welder configured to attach the leading and trailing strap ends to one another. Some strapping machines configured for plastic strap or metal strap include a strap-sealing assembly with jaws that mechanically deform (referred to as "crimping" in the industry) or cut notches into (referred to as "notching" in the industry) a seal element positioned around the leading and trailing strap ends to attach them to one another. Other strapping machines configured for metal strap include a strap-sealing assembly with punches and dies configured to form a set of mechanically interlocking cuts in the leading and trailing strap ends to attach them to one another (referred to in the strapping industry as a "sealless" attachment). Still other strapping machines configured for metal strap include a strap-sealing assembly with spot, inert-gas, or other welders configured to weld the leading and trailing strap ends to one another.

The controller C includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 1. In certain embodiments, the strapping machine 1 includes a single controller, while in other embodiments the strapping machine 1 has multiple controllers that operate together. In certain embodiments, the controller C is part of the strap-feeding assembly FM, the strap-tensioning assembly 10, and/or the strap-sealing assembly SM.

Returning to the strap-tensioning assembly 10, the strap-tensioning assembly 10 includes a tensioning wheel driven by a tensioning actuator to rotate the tensioning wheel to tension the strap. The tensioning wheel is self-energizing in that operation of the tensioning actuator causes the tensioning wheel to move from a retracted position in which the tensioning wheel is spaced-apart from the strap to a tensioning position in which the tensioning wheel contacts the strap for tensioning. The strap-tensioning assembly 10 also includes features that enable it to be adjusted to accommodate different strap sizes (e.g., different strap widths and thicknesses). FIGS. 2-14C show one example embodiment of the strap-tensioning assembly 10 and components thereof. The strap-tensioning assembly 10 includes a strap-tensioning-assembly frame 100, a lower (or first) strap-guiding assembly 300, an upper (or second) strap-guiding assembly 400, a tensioning assembly 500, and a biasing assembly 900.

Figure 4A:
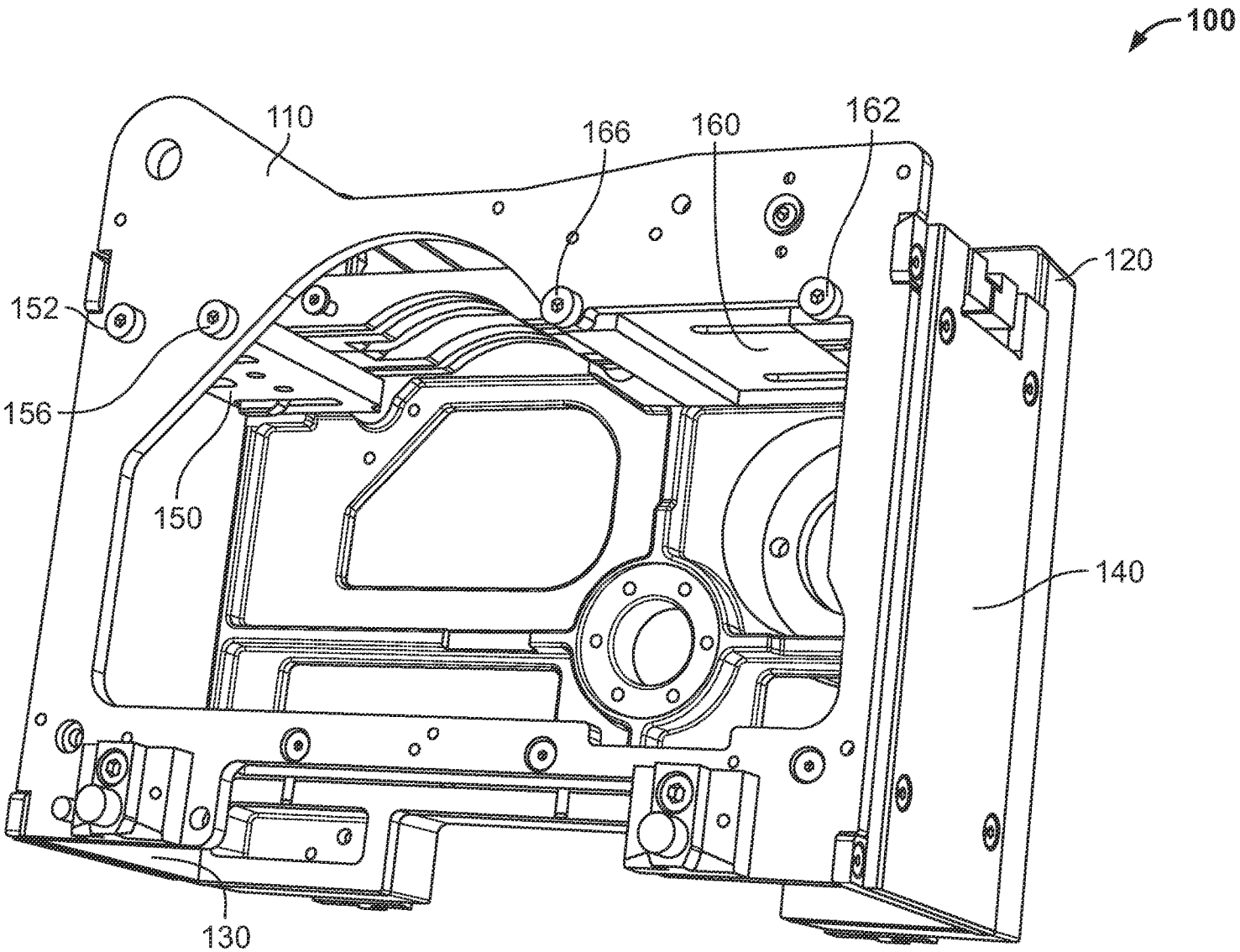
FIGS. 4A and 4B are front and rear perspective views of the strap-tensioning-assembly frame of the strap-tensioning assembly of FIG. 2.
Figure 4B:
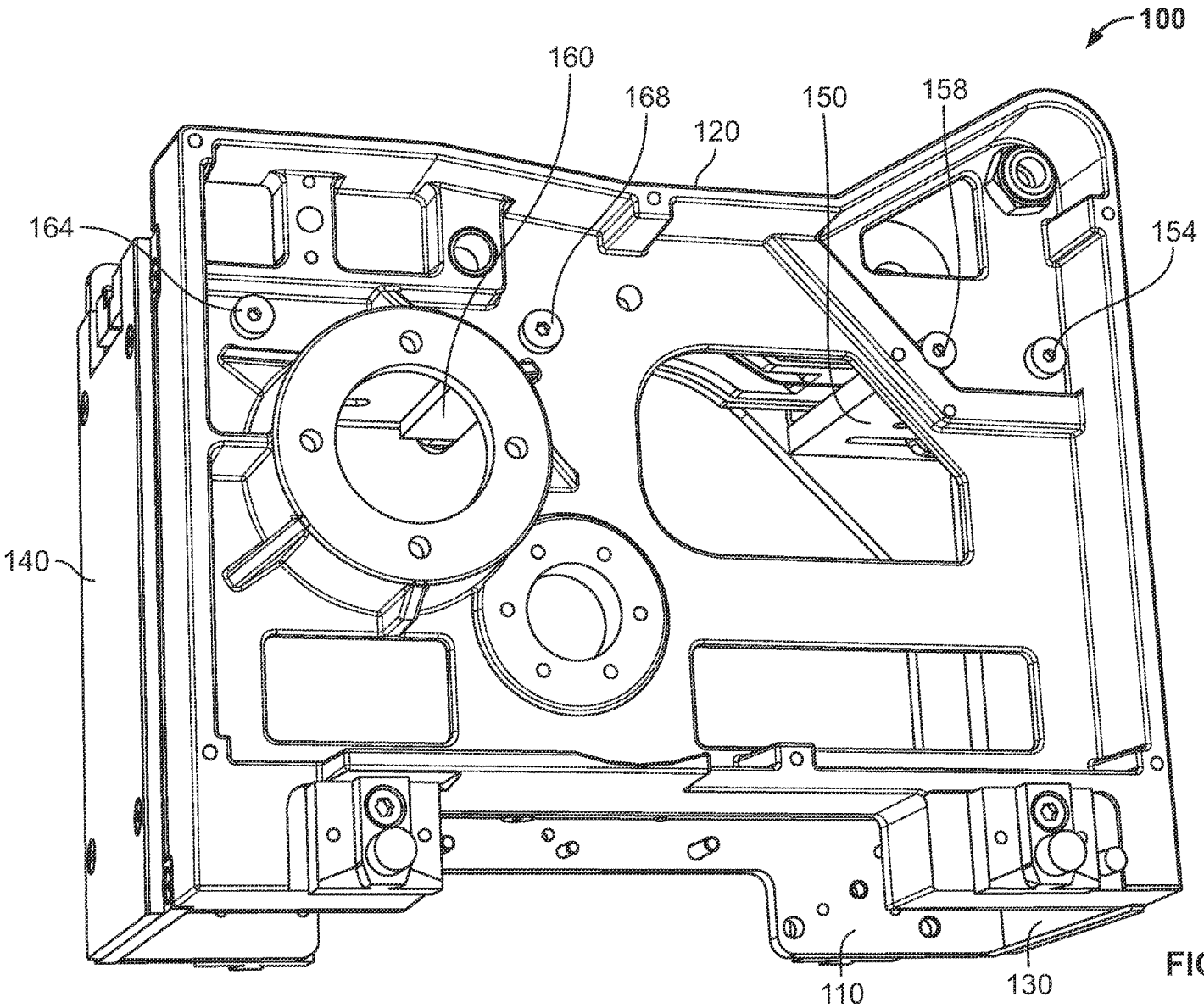

The strap-tensioning-assembly frame 100, which is best shown in FIGS. 4A and 4B, directly or indirectly supports the other components of the strap-tensioning assembly 10 and may be formed of any suitable components arranged in any suitable configuration. In this example embodiment, the strap-feeding-assembly frame 100 includes front (first), back (second), infeed side (third), and outfeed side (fourth) frame members 110, 120, 130, and 140; first and second support members 150 and 160; first-support-member mounting elements 152, 154, 156, and 158; and second-support-member mounting elements 162, 164, 166, and 168.

The front and back frame members 110 and 120 are spaced-apart from one another, and the infeed side and outfeed side frame members 130 and 140 are spaced-apart from one another. The infeed side frame member 130 extends between one end of the front frame member 110 and one end of the back frame member 120, and the outfeed side frame member 140 extends between the other end of the front frame member 110 and the other end of the back frame member 120. The first support member 150 extends between the front and back frame members 110 and 120 adjacent the infeed side frame member 130 and is mounted to the front and back frame members 110 and 120 via the first-support-member mounting elements 152, 154, 156, and 158, which are pins in this example embodiment but may be any other suitable components (such as threaded fasteners). The second support member 160 extends between the front and back frame members 110 and 120 adjacent the outfeed side frame member 140 and is mounted to the front and back frame members 110 and 120 via the second-support-member mounting elements 162, 164, 166, and 168, which are pins in this example embodiment but may be any other suitable components (such as threaded fasteners).

Two covers 1000*a* and 1000*b* are removably attached to the strap-tensioning-assembly frame 100 to at least partially enclose certain components of the lower strap-guiding assembly 300, the tensioning assembly 500, and the biasing assembly 900.

The lower strap-guiding assembly 300, which is best shown in FIGS. 3-5F, guides the strap through the strap-tensioning assembly 10 (along with the upper strap-guiding assembly 400) and is adjustable to accommodate different strap widths. As best shown in FIG. 5B, the lower strap-guiding assembly 300 includes: first and second guide frame members 310 and 320; first and second outer guide members 330 and 340; first, second, third, and fourth outer-guide-member directors 332, 334, 342, and 344; a center guide member 350; first and second strap-channel-width adjusters 360*a* and 360*b*; first second, third, and fourth spacers 370*a*, 370*b*, 370*c*, and 370*d*; first second, third, and fourth biasing elements 380*a*, 380*b*, 380*c*, and 380*d*; multiple fasteners 390; multiple guide rollers 395; multiple strap-channel-width-adjuster retainers 398; and multiple lower-strap-guiding-assembly retainers 399.

The first guide frame member 310 includes a body 312 having a first (infeed) end 314 and a second (outfeed) end 316. A mounting opening 314*a* is defined in the first (infeed) end 314. The second (outfeed) end 316 includes a foot 316*a* that includes the lower-strap-guiding-assembly retainer 399*a*. The second guide frame member 320 includes a body 322 having a first (infeed) end 324 and a second (outfeed) end 326. A mounting opening 324*a* is defined in the first (infeed) end 324. The second (outfeed) end 326 includes a foot 326*a* that includes the lower-strap-guiding-assembly retainer 399*b*. In other embodiments (not shown), the mounting openings are defined at the second (outfeed) ends of the first and second guide frame members, and the lower-strap-guiding-assembly retainers are included in the first (infeed) ends of the first and second guide frame members.

The lower-strap-guiding-assembly retainers 399*a* and 399*b* retain the lower strap-guiding assembly 300 on the strap-feeding-assembly frame 100, as described below. In this example embodiment, the lower-strap-guiding-assembly retainers include spring plungers, though they may be any other suitable components in other embodiments. FIG. 7F shows the lower-strap-guiding-assembly retainer 399*a* (the lower-strap-guiding-assembly retainer 399*b* is identical and is not separately shown or described for brevity). The lower-strap-guiding-assembly retainer 399*a* includes a body 399*a*1 threadably received in the foot 316*a*, a nose 399*a*2 captively received within a bore defined in the body 399*a*1, and a biasing element 399*a*3 (here, a compression spring) biasing the nose 399*a*2 toward the opening of the bore such that part of the nose 399*a*2 projects from the bore.

The first and second guide frame members 310 and 320 and the center guide member 350 (which is a plate in this example embodiment) are fixedly connected to one another by the spacers 370*a*-370*d* and the fasteners 390 to form a lower strap-guiding-assembly frame. Due to this fixed connection in this example embodiment, there is a first fixed distance between the first and second guide frame members 310 and 320, a second fixed distance between the first guide frame member 310 and the center guide member 350, and a third fixed distance (which here is the same as the second fixed distance) between the second guide frame member 320 and the center guide member 350. The first outer guide member 330 is slidably mounted to the spacers 370*a*-370*d* (which extend through corresponding openings in the first outer guide member 330) between the first guide frame member 310 and the center guide member 350 such that the first outer guide member 330 can move relative to the guide frame members and the center guide member between a first position adjacent the first guide frame member 310 (FIG. 5E) and a second position adjacent the center guide member 350 (FIG. 5D). Similarly, the second outer guide member 340 is slidably mounted to the spacers 370*a*-370*d* (which extend through corresponding openings in the second outer guide member 340) between the second guide frame member 320 and the center guide member 350 such that the second outer guide member 340 can move relative to the guide frame members and the center guide member between a first position adjacent the second guide frame member 320 (FIG. 5E) and a second position adjacent the center guide member 350 (FIG. 5D).

Figure 5A:
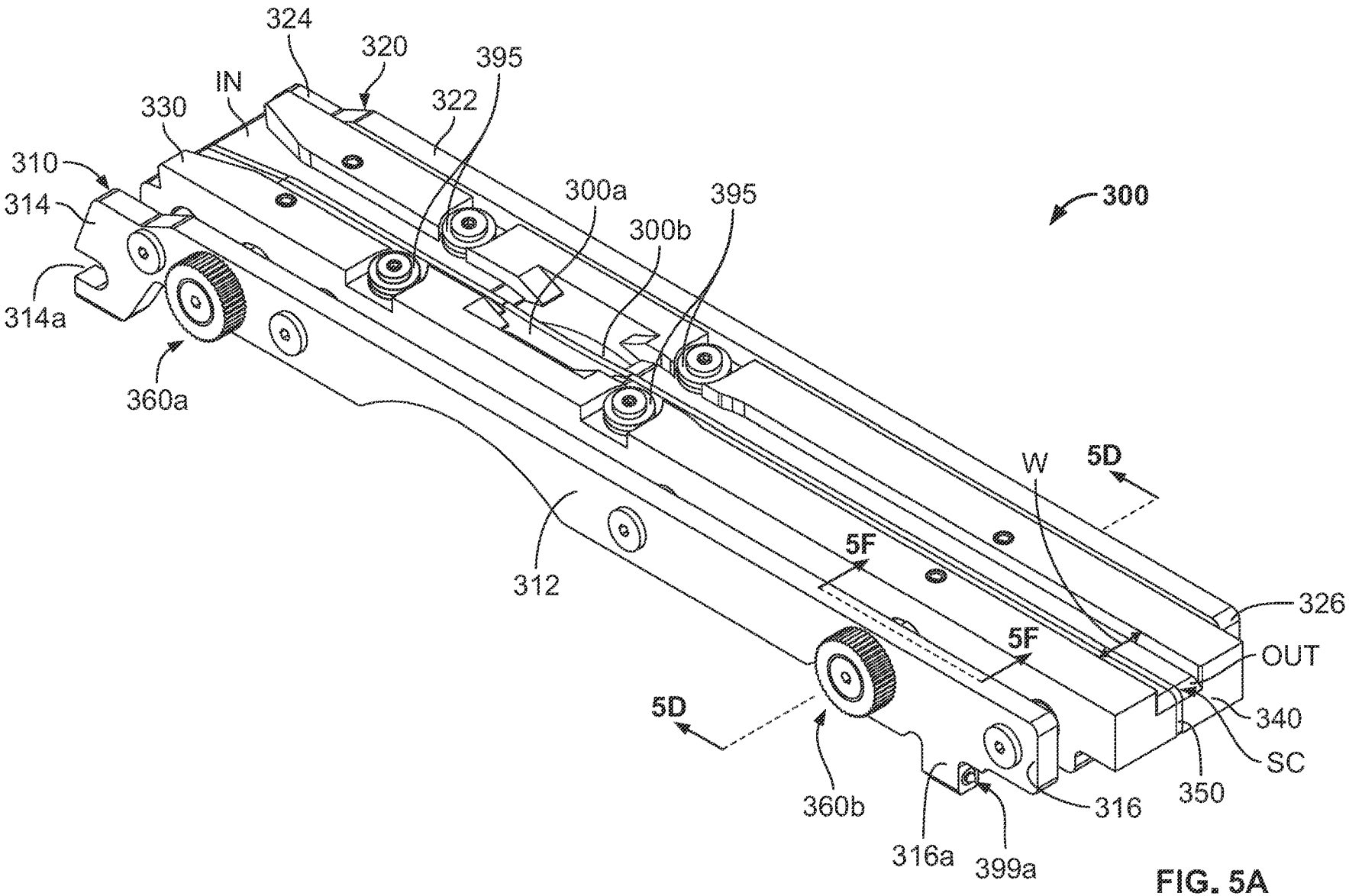
FIG. 5A is a perspective view of the lower strap-guiding assembly of the strap-tensioning assembly of FIG. 2.
Figure 5B:
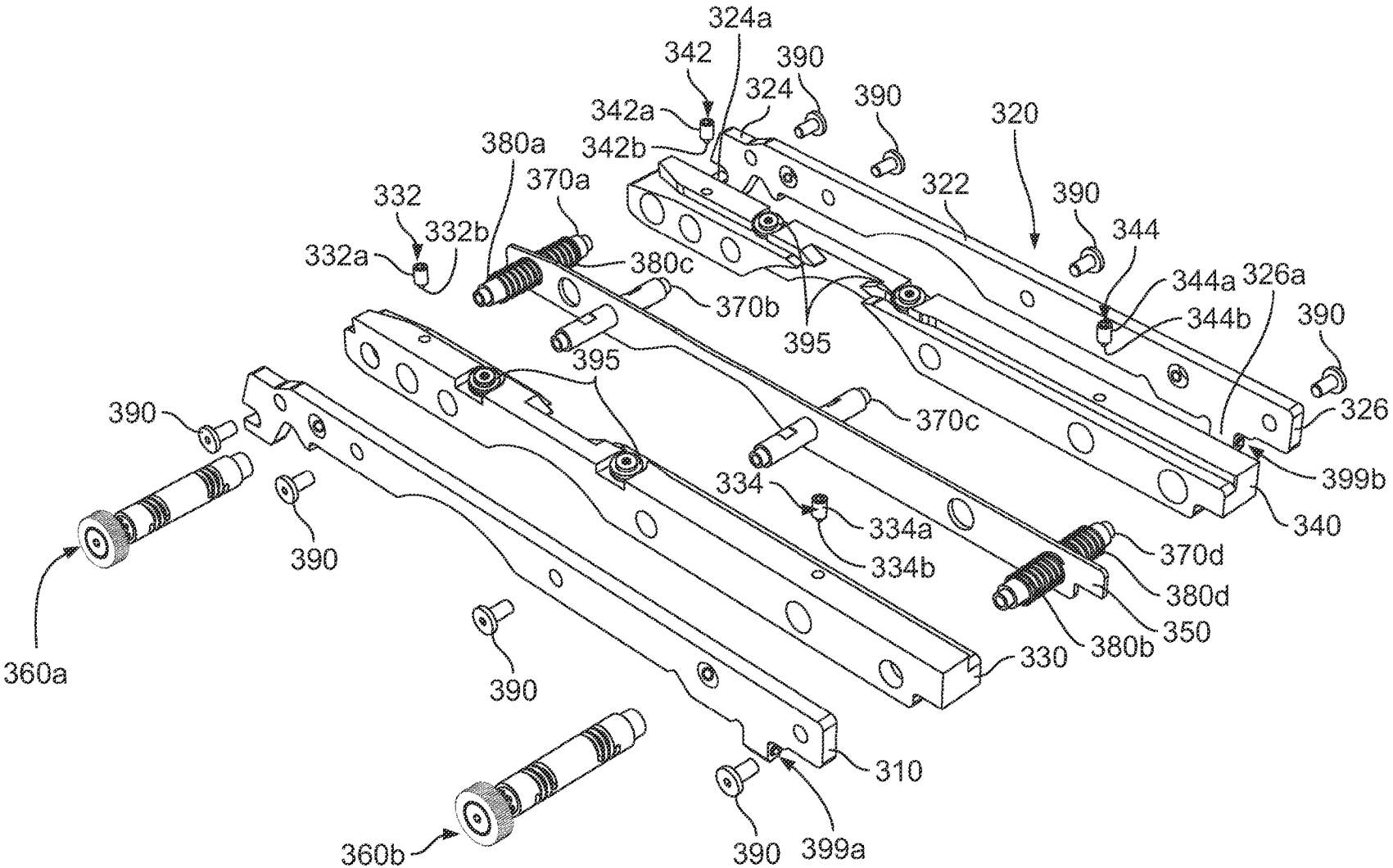
FIG. 5B is an exploded perspective view of the lower strap-guiding assembly of FIG. 5A.

As best shown in FIG. 5A, a first feed-wheel-receiving opening 300*a* is formed between the first outer guide member 330 and the center guide member 350 and a second feed-wheel-receiving opening 300*b* is formed between the second outer guide member 340 and the center guide member 350. Two of the guide rollers 395 are mounted to the first outer guide member 330 on the infeed and outfeed sides of the first feed-wheel-receiving opening 300*a* and extend partially into the strap channel SC. Similarly, two of the guide rollers 395 are mounted to the second outer guide member 340 on the infeed and outfeed sides of the second feed-wheel-receiving opening 300*b* and extend partially into the strap channel SC. In this example embodiment, the guide rollers 395 are rotatable relative to the outer guide members 330 and 340, while in other embodiments the guide rollers are not rotatable relative to the outer guide members 330 and 340. The strap engages the guide rollers as it moves through the strap channel SC, and the guide rollers help keep the strap in the lateral center of the strap channel SC and limits the strap's contact with the outer walls of the strap channel SC, thereby reducing debris formation and the potential for the strap to be damaged.

The first and second biasing elements 380*a* and 380*b* bias the first outer guide member 330 to its first position, and the third and fourth biasing elements 380*c* and 380*d* bias the second outer guide member 340 to its first position. In this example embodiment, the biasing elements 380*a*-380*d* are compression springs. Also, in this example embodiment: the first biasing element 380*a* circumscribes the portion of the first spacer 370*a* between the first guide frame member 310 and the center guide member 350 and engages the first outer guide member 330 and the center guide member 350, the second biasing element 380*b* circumscribes the portion of the fourth spacer 370*d* between the first guide frame member 310 and the center guide member 350 and engages the first outer guide member 330 and the center guide member 350, the third biasing element 380*c* circumscribes the portion of the first spacer 370*a* between the second guide frame member 320 and the center guide member 350 and engages the second outer guide member 340 and the center guide member 350, and the fourth biasing element 380*d* circumscribes the portion of the fourth spacer 370*d* between the second guide frame member 320 and the center guide member 350 and engages the second outer guide member 340 and the center guide member 350.

Figure 5C:
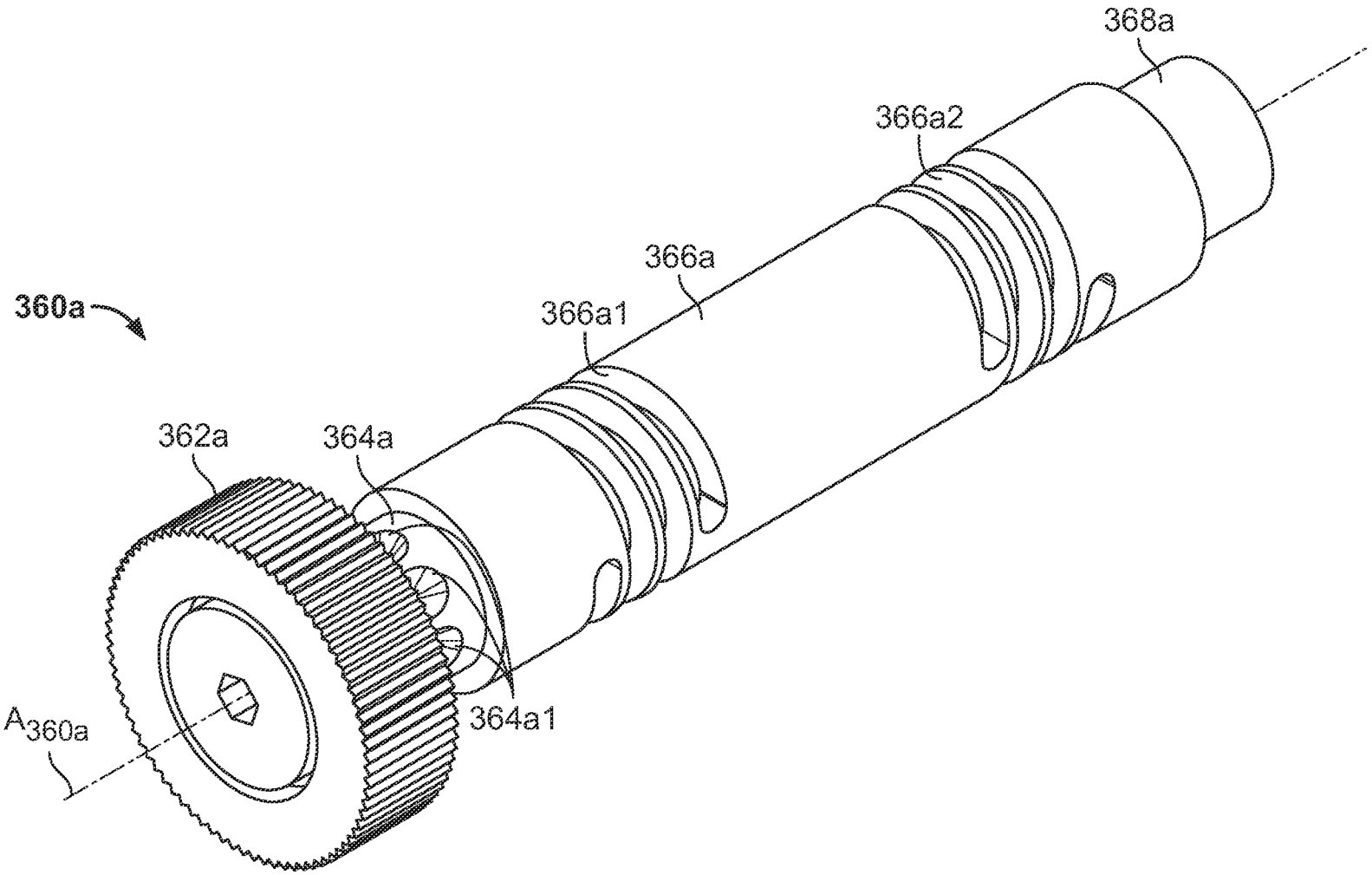
FIG. 5C is a perspective view of the strap-channel-width adjuster of the lower strap-guiding assembly of FIG. 5A.
Figure 5D:
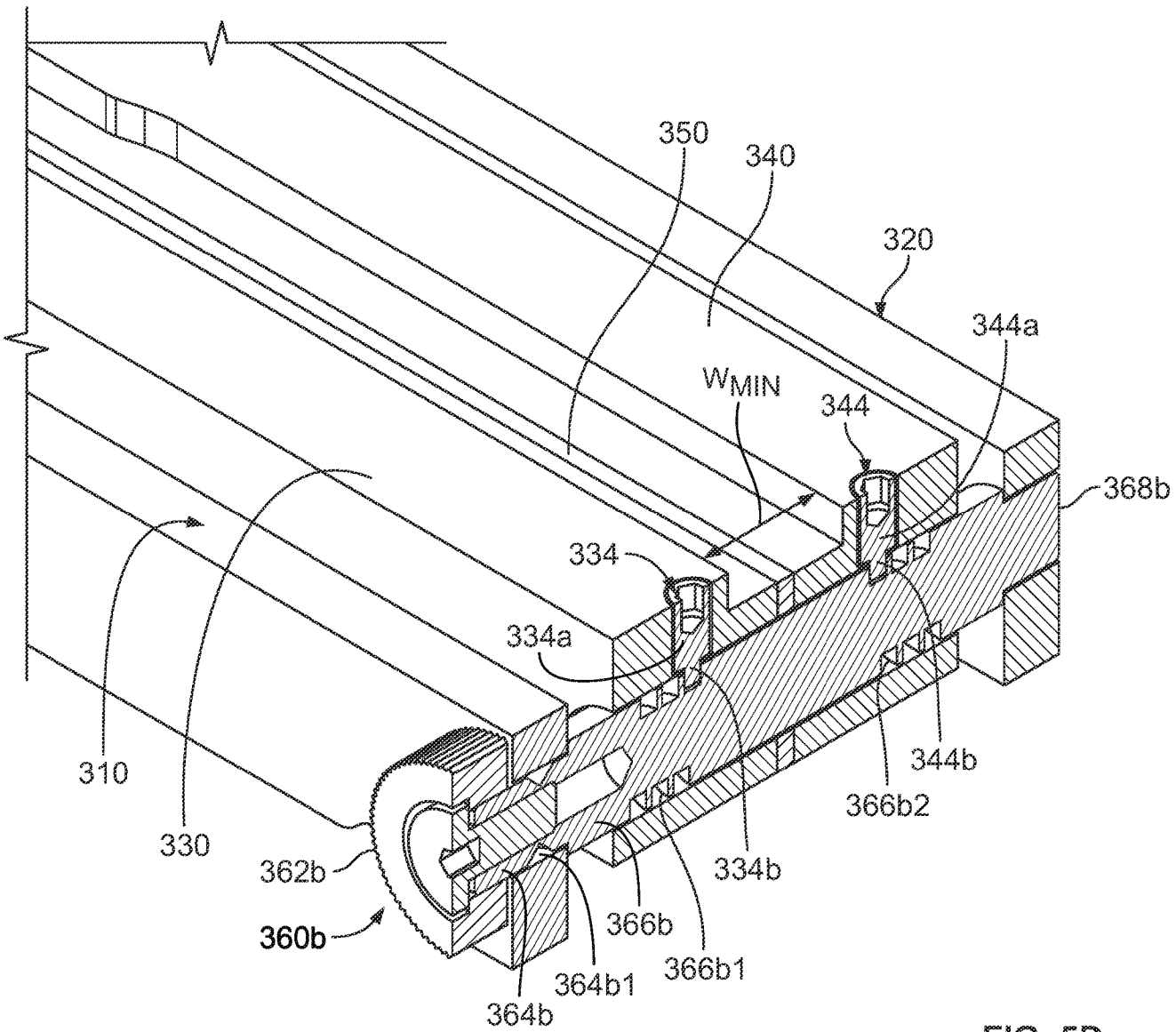
FIG. 5D is a cross-sectional perspective view of the lower strap-guiding assembly of FIG. 5A taken along line 5D-5D of FIG. 5A and showing the first and second guide members in their first (narrow) configuration.

The first and second strap-channel-width adjusters 360*a* and 360*b* control the positions of the first and second outer guide members 330 and 340 and therefore the width of the strap channel partially defined by the lower strap-guiding assembly 300, as described in detail below. In this example embodiment, the first and second strap-channel-width adjusters 360*a* and 360*b* are identical, so only the first strap-channel-width adjuster 360*a* is shown and described in detail. Turning to FIG. 5C, the first strap-channel-width adjuster 360*a* includes a head 362*a*, a neck 364*a*, a body 366*a*, and a foot 368*a*. The head 362*a* is disc-shaped and has a toothed or knurled outer cylindrical surface to facilitate a user grasping and rotating the first strap-channel-width adjuster 360*a* (as described below). In other embodiments the head is coated with or is formed from a high-friction material, such as rubber. The neck 364*a* extends from the head 362*a* and, in this example embodiment, the head 362*a* is attached to the neck 364*a* via a fastener (not labeled). The neck 364*a* is cylindrical, and multiple aligned, circumferentially spaced depressions 364*a*1 are defined in the outer cylindrical surface of the neck 364*a*. The body 366*a* extends from the neck 364*a* (and in this example embodiment is integrally formed with the neck 364*a*). First and second spiral-shaped width-control grooves 366*a*1 and 366*a*2 are defined in the outer cylindrical surface of the body 366*a*. The width-control grooves 366*a*1 and 366*a*2 are mirror images of one another. For instance, if the width-control groove 366*a*1 is a right-hand spiral, the width-control groove 366*a*2 is a left-hand spiral, and vice-versa. The foot 368*a* is cylindrical and extends from the body 366*a* (and in this example embodiment is integrally formed with the body 366*a*). The first strap-channel-width adjuster 360*a* defines a rotational axis $A_{360a}$. The second strap-channel-width adjuster 360*b* has identical components that are identified below with element numbers in which a "b" replaces the "a" of the corresponding element numbers of the first strap-channel-width adjuster 360*a*.

The first and second strap-channel-width adjusters 360*a* and 360*b* extend through openings defined in the first and second guide frame members 310 and 320, the first and second outer guide members 330 and 340, and the center guide member 350. The first and second strap-channel-width adjusters 360*a* and 360*b* are secured (such as via set screws, retaining clips or rings, or in any other suitable manner) such that they cannot move relative to these components parallel or transverse to their respective rotational axes $A_{360a}$ and $A_{360b}$ but can rotate relative to these components about their respective rotational axes $A_{360a}$ and $A_{360b}$. The first outer-guide-member director 332 has a threaded body 332*a* and a projection 332*b* extending from the body 332*a*. The body 332*a* of the first outer-guide-member director 332 is threadably received in the first outer guide member 330 such that the projection 332*b* of the first outer-guide-member director is received in the width-control groove 366*a*1 of the body 366*a* of the first strap-channel-width adjuster 360*a*. The second outer-guide-member director 334 has a threaded body 334*a* and a projection 334*b* extending from the body 334*a*. The body 334*a* of the second outer-guide-member director 334 is threadably received in the first outer guide member 330 such that the projection 334*b* of the second outer-guide-member director is received in the width-control groove 366*b*1 of the body 366*b* of the second strap-channel-width adjuster 360*b*. The third outer-guide-member director 342 has a threaded body 342*a* and a projection 342*b* extending from the body 342*a*. The body 342*a* of the third outer-guide-member director 342 is threadably received in the second outer guide member 340 such that the projection 342*b* of the third outer-guide-member director is received in the width-control groove 366*a*2 of the body 366*a* of the first strap-channel-width adjuster 360*a*. The fourth outer-guide-member director 344 has a threaded body 344*a* and a projection 344*b* extending from the body 344*a*. The body 344*a* of the fourth outer-guide-member director 344 is threadably received in the second outer guide member 340 such that the projection 344*b* of the fourth outer-guide-member director is received in the width-control groove 366*b*2 of the body 366*b* of the second strap-channel-width adjuster 360*b*.

Figure 5E:
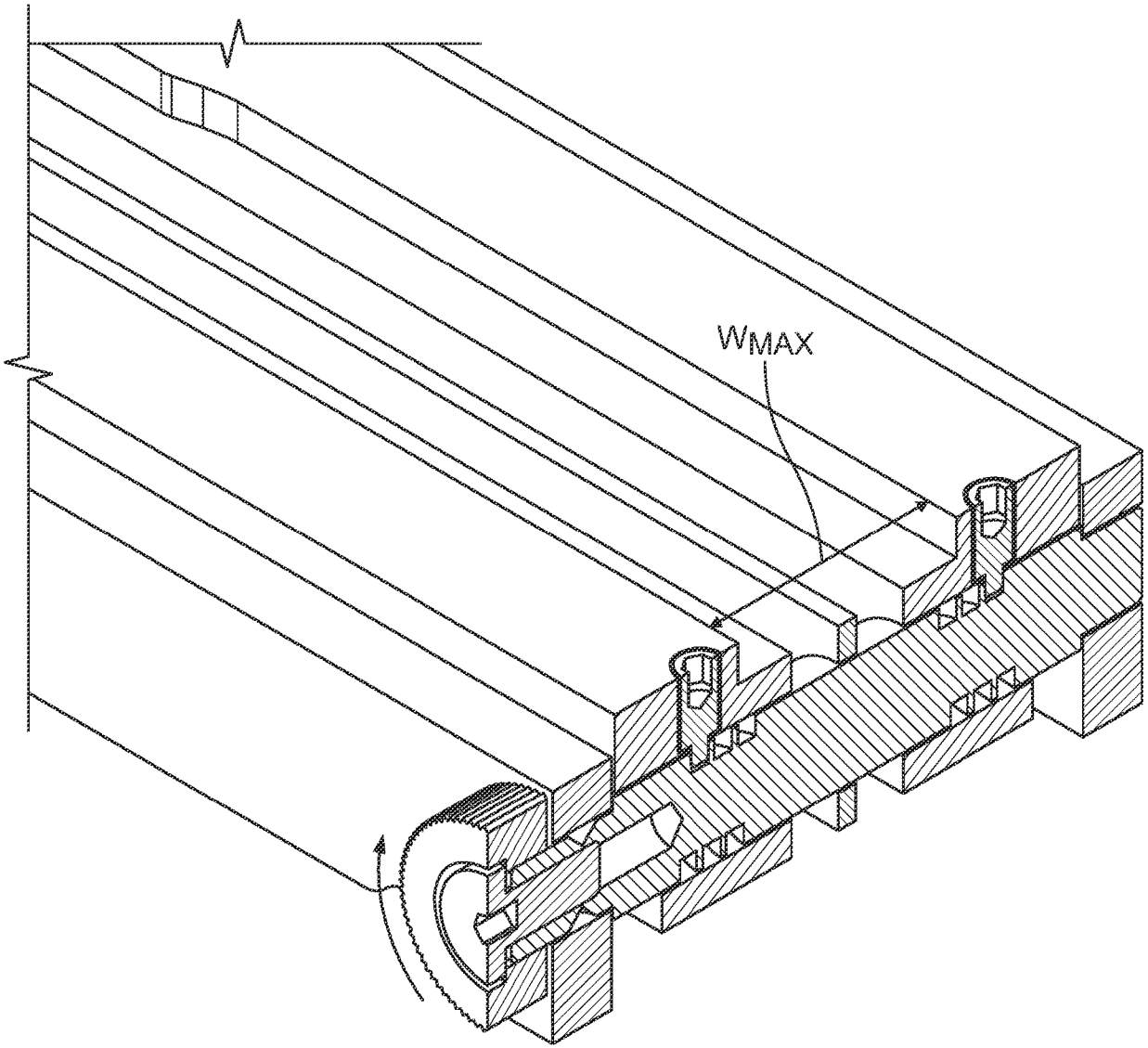
FIG. 5E is a cross-sectional perspective view of the lower strap-guiding assembly of FIG. 5A taken along line 5D-5D of FIG. 5A and showing the first and second guide members in their second (wide) configuration.

As best shown in FIG. 5A, the outer guide members 330 and 340 (along with the upper strap-guiding assembly 400) define a strap channel SC therebetween that has a width W. When the first and second outer guide members 330 and 340 are in their respective second positions, referred to herein as a second (narrow) configuration, the width of the strap channel SC is a minimum width $W_{MIN}$ (FIG. 5D). Conversely, when the first and second outer guide members are in their respective first positions, referred to herein as a first (wide) configuration, the width of the strap channel SC is a maximum width $W_{MAX}$ (FIG. 5E). The width of the strap channel SC is adjustable between the minimum and maximum widths $W_{MIN}$ and $W_{MAX}$ via rotation of the first and second strap-channel-width adjusters 360*a* and 360*b*, which enables the operator to tailor the width of the strap channel to conform to strap of different sizes. Put differently, the first and second strap-channel-width adjusters 360*a* and 360*b* are operably connected to the first and second outer guide members 330 and 340 to move the first and second outer guide members between their respective first and second positions to adjust the width of the strap channel SC.

Specifically, as explained above, the projections of the outer-guide-member directors are received in the spiral-shaped width-control grooves of the strap-channel-width adjusters. As the strap-channel-width adjusters are rotated, the projections follow the grooves and force the outer guide members to move toward or away from one another (depending on the direction of rotation). FIGS. 5D and 5E illustrate this for the second strap-channel-width adjuster 360*b*. In FIG. 5D the first and second outer guide members 330 and 340 are in the second (narrow) configuration (i.e., are in their respective second positions) and the width of the strap channel SC is $W_{MIN}$. To move the first and second outer guide members 330 and 340 away from one another and toward the first (wide) configuration, the operator rotates the second strap-channel-width adjuster 360*b* clockwise (from the perspective shown in FIGS. 5D and 5E). Initially, the projections 334*b* and 344*b* of the second and fourth guide-place directors 334 and 344—which are respectively received in the first and second width-control grooves 366*b*1 and 366*b*2 of the body 366*b* of the second strap-channel-width adjuster 366—are positioned at the ends of the grooves nearest the longitudinal center of the body. As the second strap-channel-width adjuster 360*b* rotates, the walls that define the width-control grooves force the projections outward such that they follow the grooves and move toward the ends of the grooves furthest from the longitudinal center of the body. This in turn forces the first and second outer guide members 330 and 340 to move toward the first configuration, as shown in FIG. 5E.

Figure 5F:
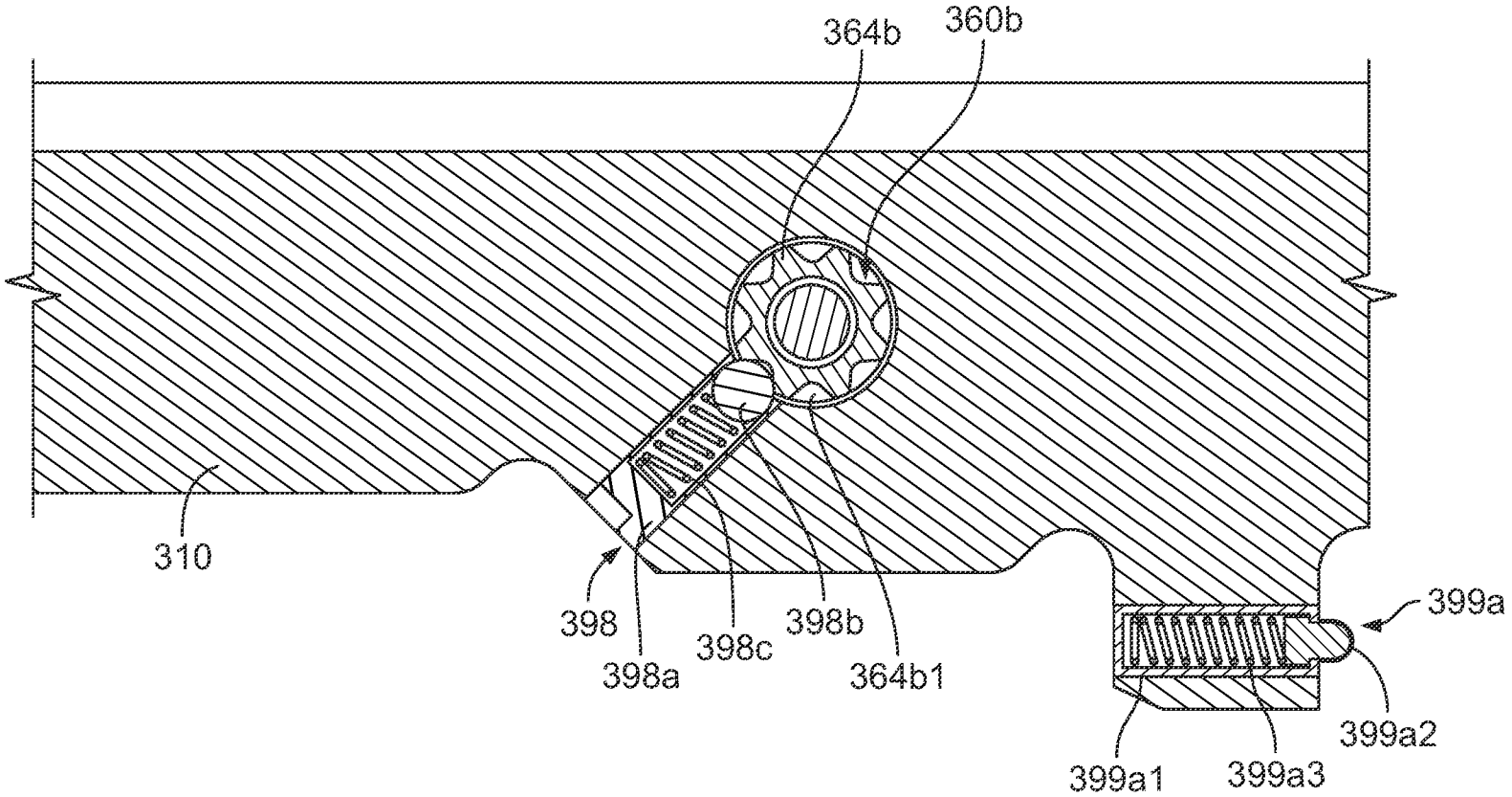
FIG. 5F is a cross-sectional side view of the lower strap-guiding assembly of FIG. 5A taken along line 5F-5F of FIG. 5A and showing the retainer.

The strap-channel-width-adjuster retainers 398 engage the strap-channel-width adjusters 360*a* and 360*b* to help maintain the strap-channel-width adjusters 360*a* and 360*b* in their rotational positions by resisting rotation. In this example embodiment, the strap-channel-width-adjuster retainers 398 include spring plungers, though they may be any other suitable components in other embodiments. FIG. 5F shows one strap-channel-width-adjuster retainer engaging the second strap-channel-width adjuster 360*b* (another identical strap-channel-width-adjuster retainer engages the first strap-channel width adjuster 360*a* and is not shown for brevity). The strap-channel-width-adjuster retainer 398 includes a body 398*a* threadably received in the first guide frame member 310, a nose 398*b* captively received within a bore defined in the body 398*a*, and a biasing element 398*c* (here, a compression spring) biasing the nose 398*b* toward the opening of the bore such that part of the nose 398*b* projects from the bore. The strap-channel-width-adjuster retainer 398 is positioned so the nose 398*b* is adjacent to and received in the depressions 364*b*1 in the neck 364*a* of the strap-channel-width adjuster 360. To rotate the strap-channel-width adjuster, the force of the biasing element 398*c* must be overcome. This prevents unwanted rotation of the strap-channel-width adjuster.

Figure 6A:
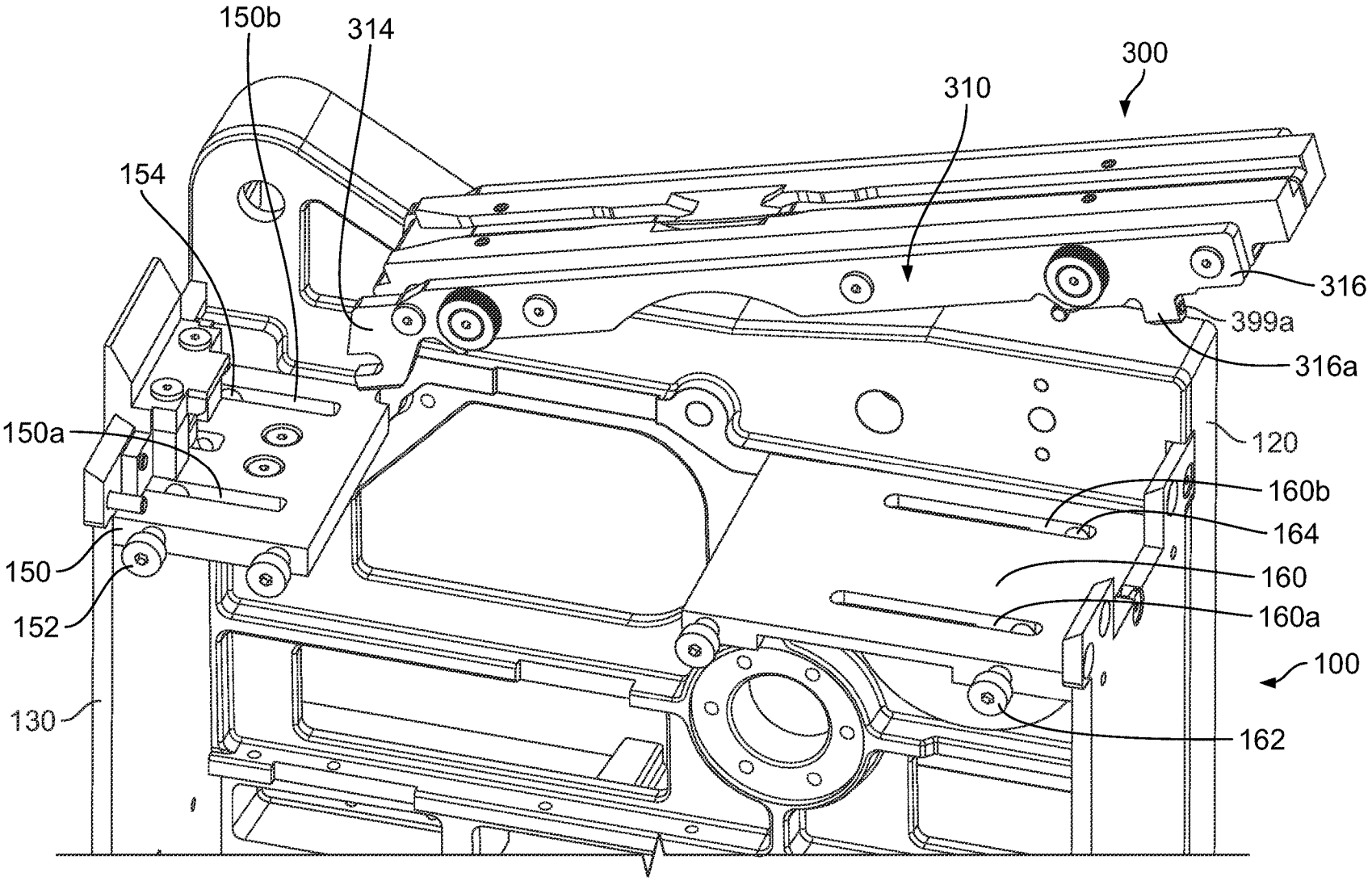
FIG. 6A is a perspective view showing the lower strap-guiding assembly of FIG. 5A removed from the strap-tensioning-assembly frame.

As shown in FIGS. 6A-6D, the lower strap-guiding assembly 300 is removably mounted to the strap-tensioning-assembly frame 100 generally above the tensioning assembly 500 (described below). Specifically, the lower strap-guiding assembly 300 is removably mounted to first (infeed) and second (outfeed) lower-strap-guiding-assembly mounts of the strap-tensioning-assembly frame 100. In this example embodiment, the first lower-strap-guiding-assembly mount includes the first-support-member mounting elements 152 and 154, which are accessible via openings 150*a* and 150*b* defined through the first platform 150 (FIG. 6A). The second lower-strap-guiding-assembly mount includes the second-support-member-mounting elements 162 and 164, which are accessible via openings 160*a* and 160*b* defined through the second platform 160 (FIG. 6A).

Figure 6B:
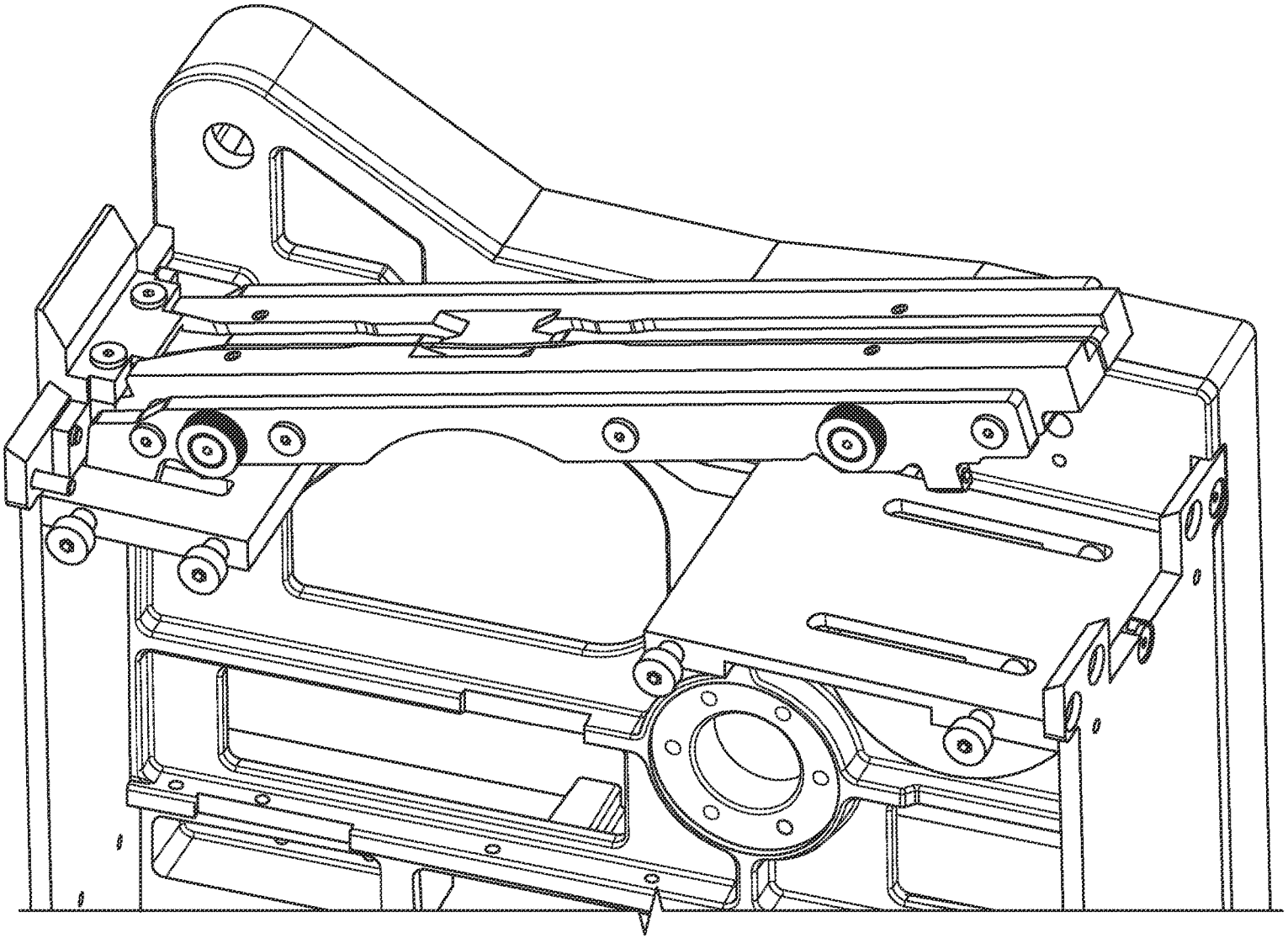
FIGS. 6B and 6C are perspective views showing the lower strap-guiding assembly of FIG. 5A being mounted to the strap-tensioning-assembly frame.
Figure 6C:
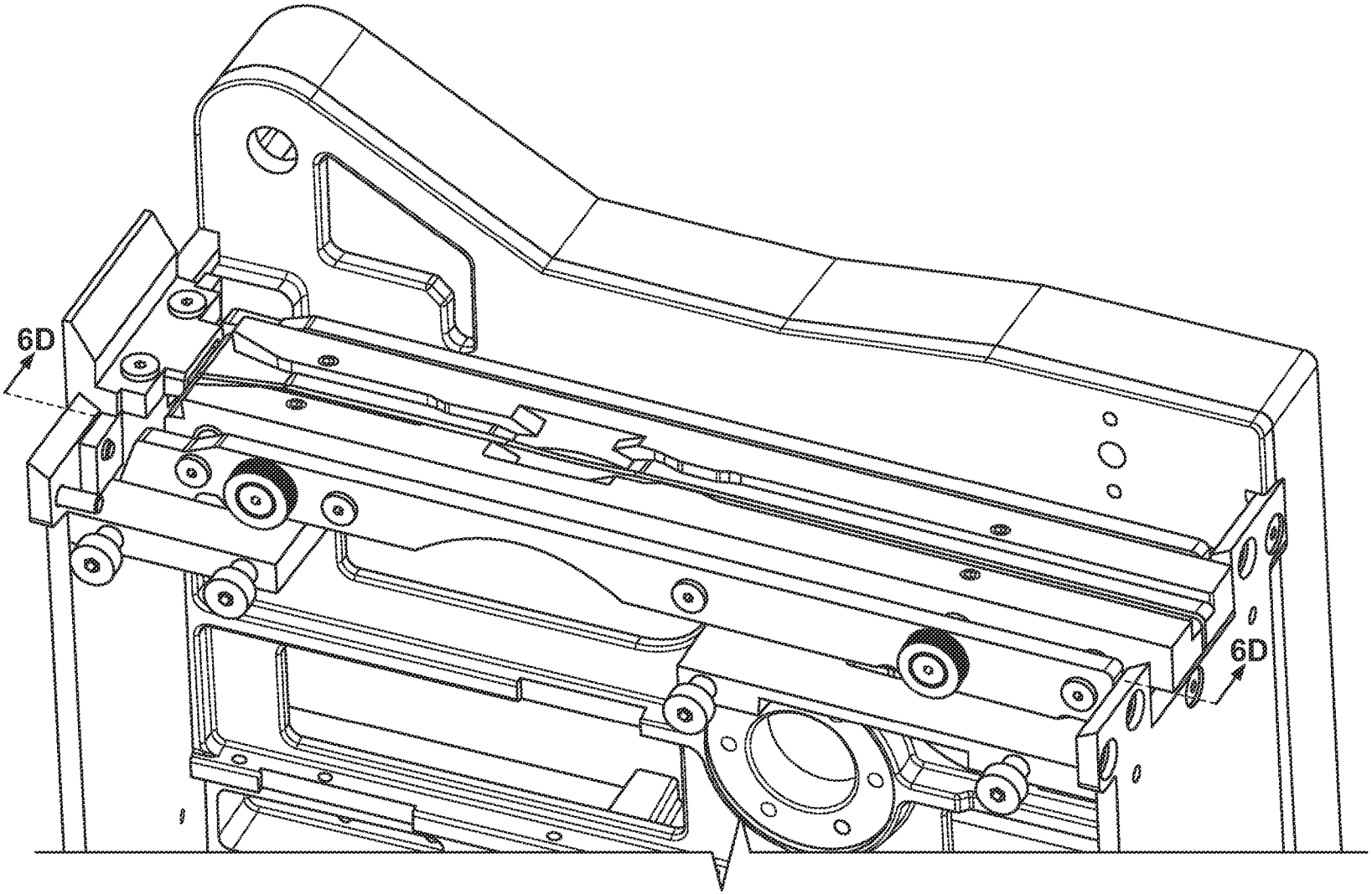
Figure 6D:
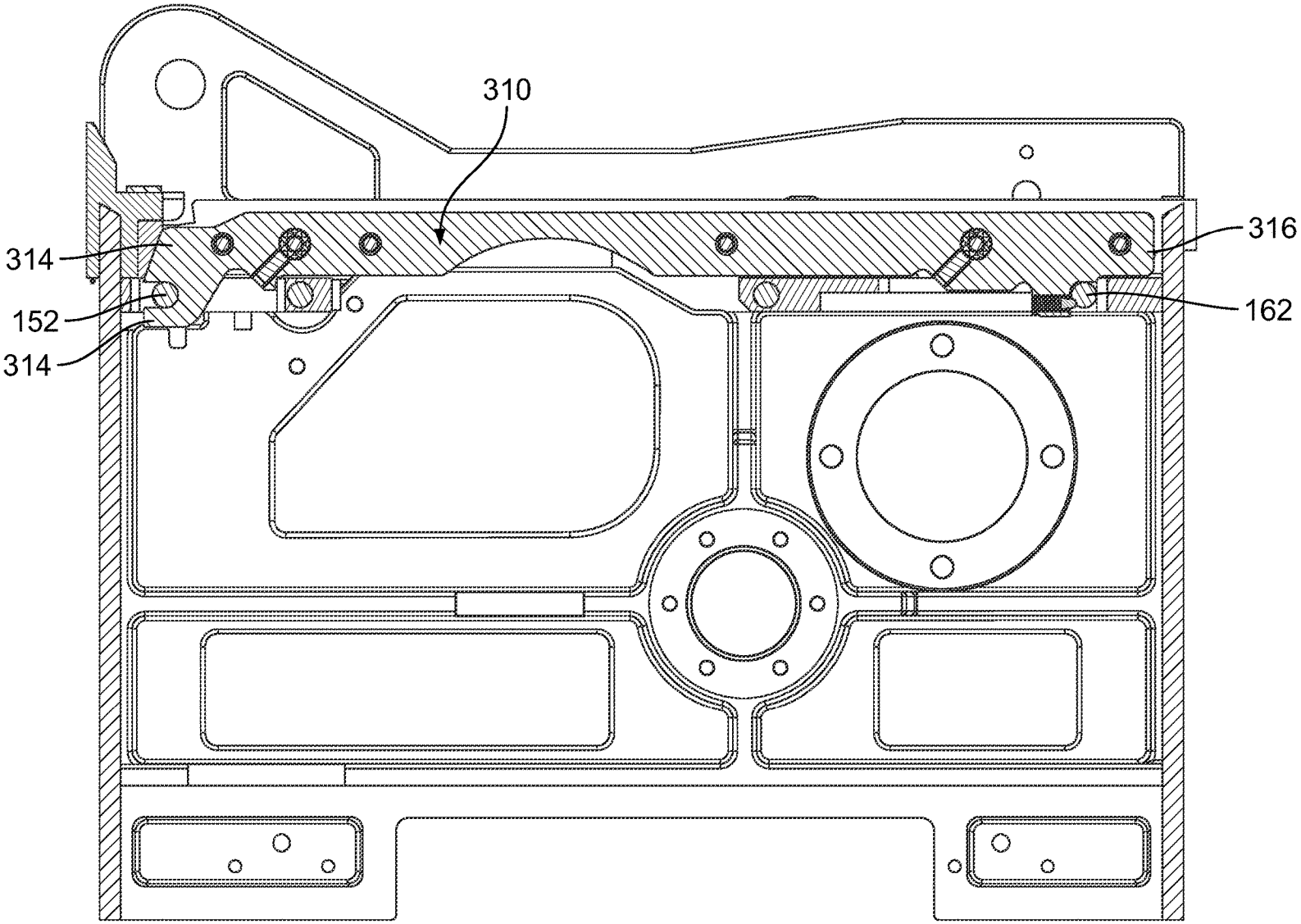
FIG. 6D is a cross-sectional view of the lower strap-guiding assembly of FIG. 5 mounted to the strap-tensioning-assembly frame taken along line 6D-6D of FIG. 6C.

To mount the lower strap-guiding assembly 300 to the strap-tensioning-assembly frame 100, the lower portions of the first ends 314 and 324 of the first and second guide frame members 310 and 320 are inserted into the openings 150*a* and 150*b* in the first platform 150, respectively, and positioned so the first-support-member mounting elements 152 and 154 (i.e., the first lower-strap-guiding-assembly mount in this example embodiment) are received in their respective mounting openings 314*a* and 324*a*, as shown in FIG. 6B. The lower strap-guiding assembly 300 is then rotated about the first-support-member mounting elements 152 and 154 and toward the second platform 160 until the: (1) undersides of the second ends 316 and 326 of the first and second guide frame members 310 and 320 lockingly engage the second-support-member-mounting elements 162 and 164 (i.e., the second lower-strap-guiding-assembly mount in this example embodiment), respectively; and (2) the noses 399*a*2 and 399*b*2 of the lower-strap-guiding-assembly retainers 399*a* and 399*b* engage the second-support-member-mounting elements 162 and 164, respectively, as shown in FIGS. 6C and 6D.

Once the lower strap-guiding assembly 300 is in this operational position, the lower-strap-guiding-assembly retainers 399*a* and 399*b* retain it in place. More specifically, the spring-biased noses 399*a*2 and 399*b*2 resist rotation of the strap-guiding assembly 300 away from its operational position. To remove the lower strap-guiding assembly 300 from the strap-tensioning assembly frame 100, the operator reverses the above sequence, making sure to lift with enough force to overcome the forces of the springs 399*a*3 and 399*b*3 of the lower-strap-guiding-assembly retainers 399*a* and 399*b*. The operator therefore does not need any tools to remove the lower strap-guiding assembly from the strap-tensioning-assembly frame (at least in this example embodiment), making removal quick and easy.

In certain embodiments, the second strap-guiding-assembly mount defines an opening sized to receive part of the nose when the strap-guiding assembly is in its operational position.

Figure 3:
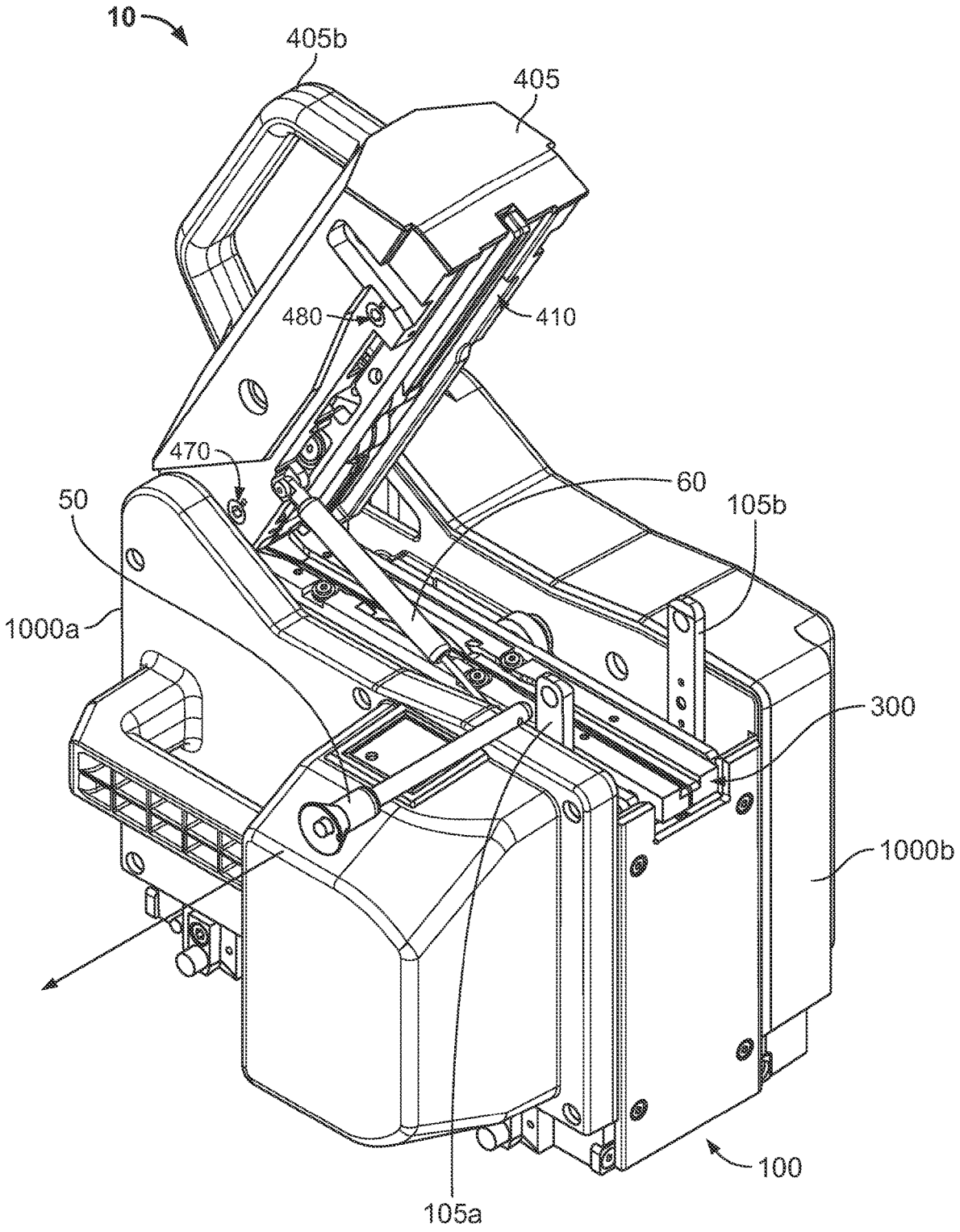
FIG. 3 is a perspective view of the strap-tensioning assembly of FIG. 2 with its upper strap-guiding assembly in its open position.

As shown in FIG. 3, the lower strap-guiding assembly 300 (when mounted to the strap-tensioning-assembly frame 100) is positioned such that the strap-engaging surface 840*a* of the tensioning wheel 840 extends into the first feed-wheel-receiving opening 300*a* and the strap-engaging surface 840*b* of the tensioning wheel 840 extends into the second feed-wheel-receiving opening 300*b* such that these surfaces can engage the strap (when the strap is received in the strap channel SC).

The upper strap-guiding assembly 400, which is best shown in FIGS. 2, 3, and 7A-8D, cooperates with the lower strap-guiding assembly 300 to form the strap channel SC and with the tensioning assembly 500 to tension the strap. The upper strap-guiding assembly 400 is adjustable to accommodate different strap thicknesses and includes a housing 405, a strap-channel cover 410, a counter-roller assembly 420, and a counter-roller-assembly mounting pin 430.

The upper strap-guiding assembly 400 is mounted to the strap-tensioning-assembly frame 100 and pivotable relative to the strap-tensioning-assembly frame 100, and the lower strap-guiding assembly 300, the tensioning assembly 500, and the biasing assembly 900 about a pivot (not shown) between a closed position (FIG. 2) and an open position (FIG. 3). A gas spring 60 (FIG. 3) or other suitable component assists in pivoting the upper strap-guiding assembly 400 from its closed position to its open position and retains the upper strap-guiding assembly 400 in the open position (until it is forced back to the closed position against the force of the gas spring). When the upper strap-guiding assembly 400 is in its closed position, a locking pin 50 may be inserted through the upper strap-guiding assembly 400 and two ears 105*a* and 105*b* of the strap-tensioning-assembly frame 100 to lock the upper strap-guiding assembly 400 in place and prevent it from pivoting from its closed position to its open position. The locking pin 50 must be removed (as shown in FIG. 3) before the upper strap-guiding assembly 400 can be pivoted to its open position.

The housing 405 supports some (or all) of the other components of the upper strap-guiding assembly 400 and may be formed of any suitable component(s) arranged in any suitable configuration. In this example embodiment, the housing 405 includes a handle 405*b* to facilitate carrying the strap-tensioning assembly 10.

The strap-channel cover 410 covers the lower strap-guiding assembly 300 when the upper strap-guiding assembly 400 is in its closed position and cooperates with the lower strap-guiding assembly 300 to form the strap channel SC. The strap-channel cover 410 includes a base including first and second outer guide members 412*a* and 412*b* and a center guide member 414 extending along the lateral center of the base between the first and second outer guide members. As best shown in FIG. 7B, a first counter-roller-receiving opening 410*a* is formed between the first outer guide member 412*a* and the divider 414 and a second counter-roller-receiving opening 410*b* is formed between the second outer guide member 412*b* and the divider 414.

Figure 8A:
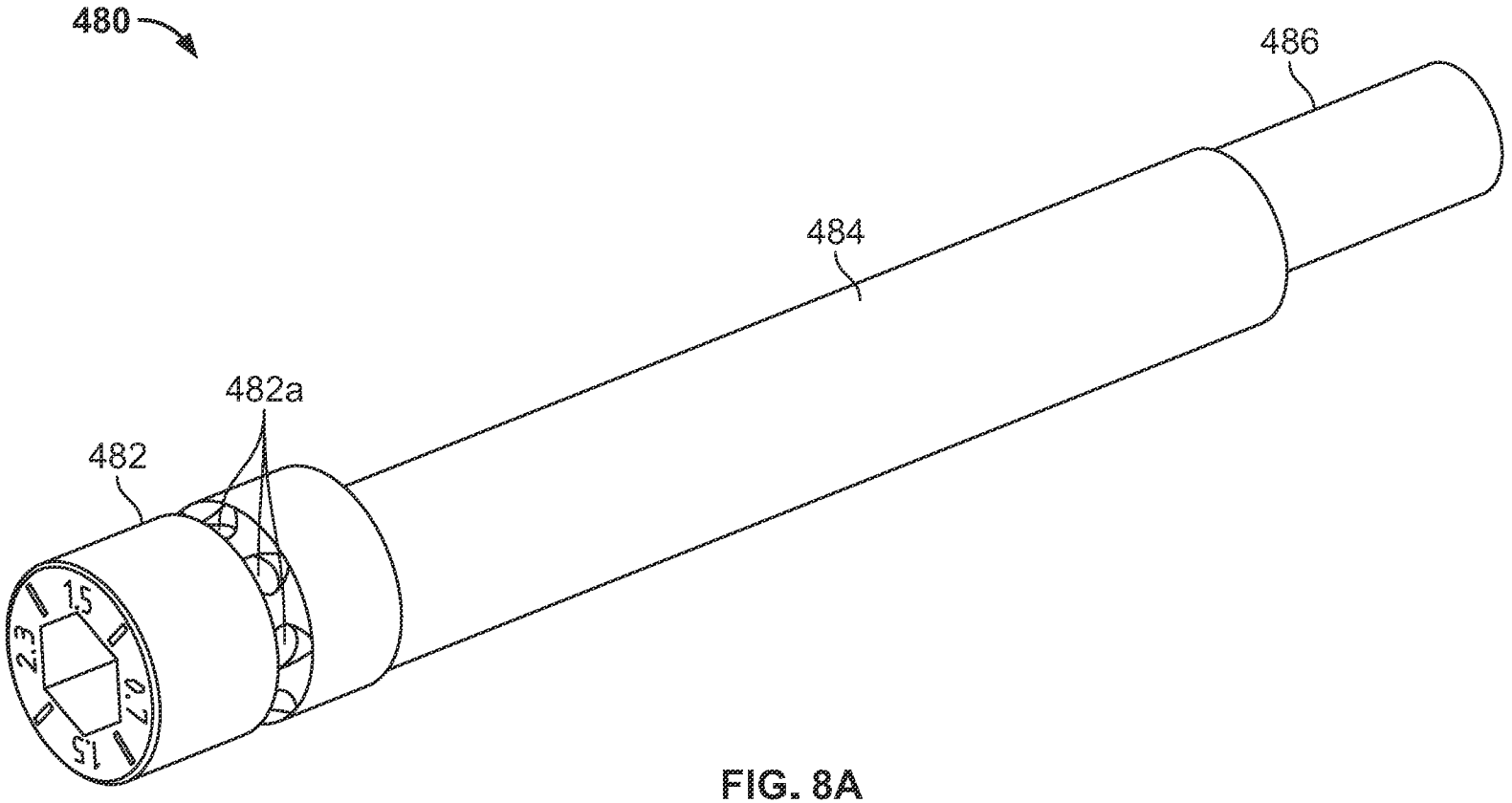
FIGS. 8A and 8B are perspective views of one of the eccentric mounting pins of the upper strap-guiding assembly.
Figure 8B:
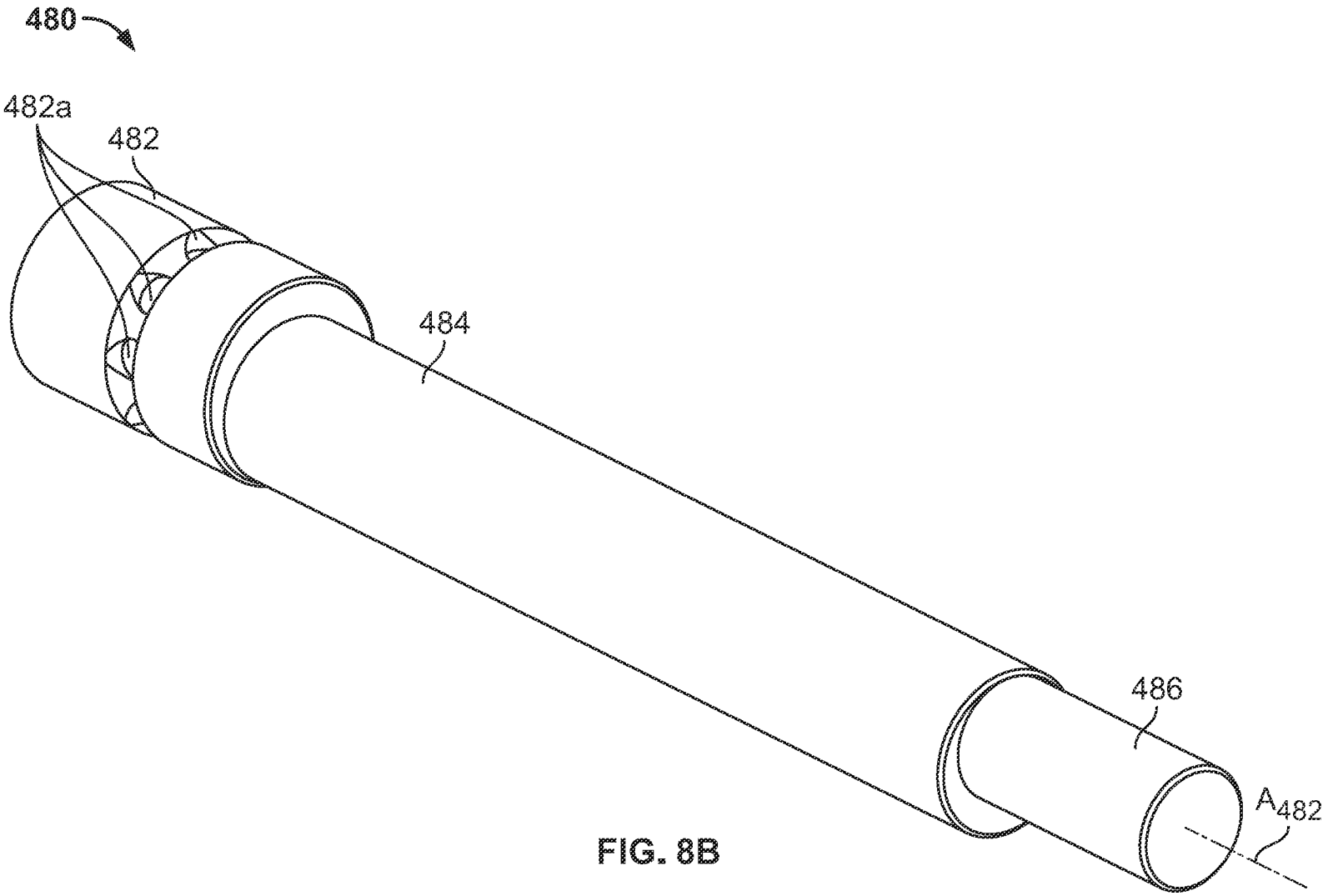
Figure 8C:
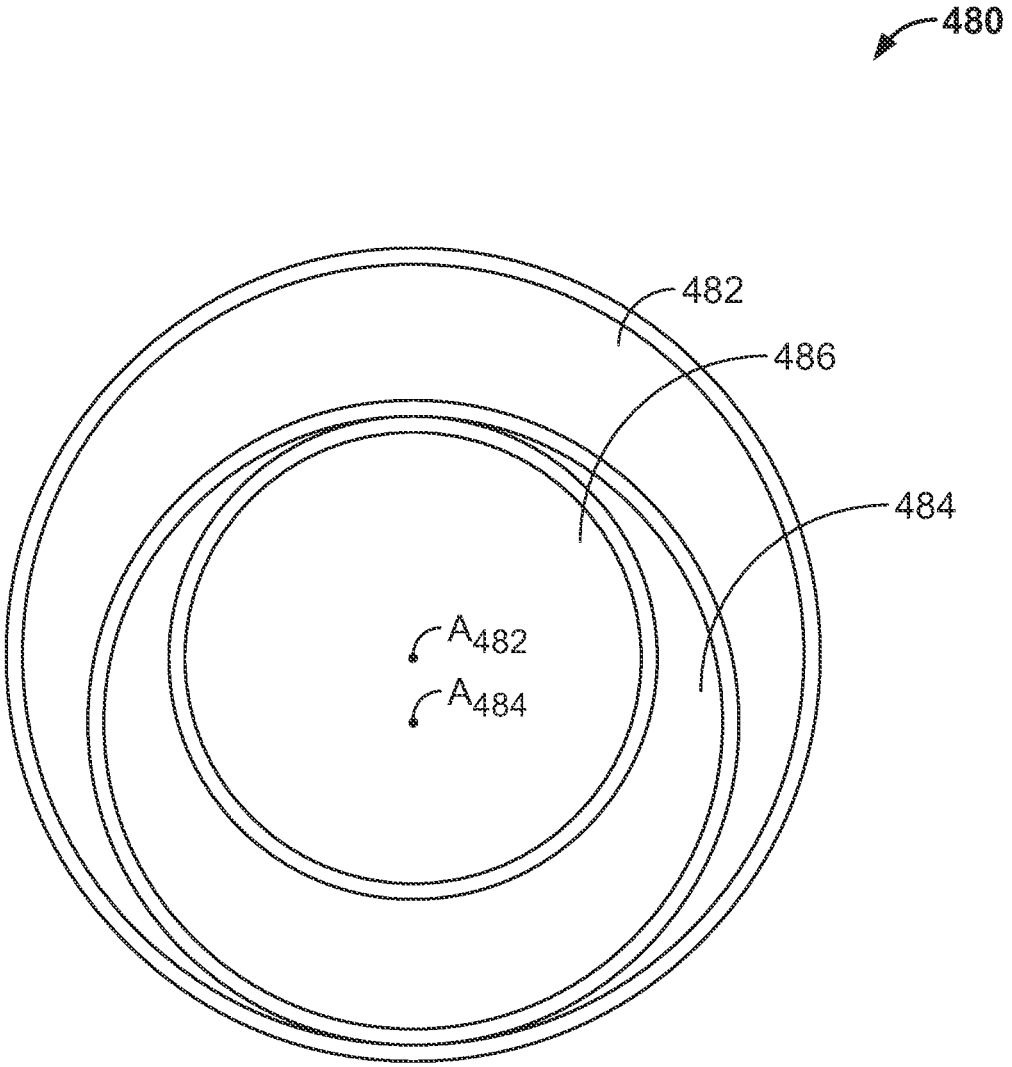
FIG. 8C is an end-on view of the eccentric mounting pin of FIGS. 8A and 8B.

The strap-channel cover 410 is removably mounted to the housing 405 via first and second eccentric mounting pins 470 and 480 (explained below with respect to FIGS. 8A-8D). The eccentric mounting pins 470 and 480 are manipulatable (here, rotatable) to control the distance between the strap-channel cover 410 and the lower strap-guiding assembly 300 and therefore control the height (not labeled) of the strap channel SC. In this example embodiment, the first and second eccentric mounting pins 470 and 480 are identical, so only the second eccentric mounting pin 480 is shown and described in detail. The second eccentric mounting pin 480 includes a head 482, a body 484, and a foot 486. The head 482 is cylindrical, and multiple aligned, circumferentially spaced depressions 482*a* are defined in the outer cylindrical surface of the head 482. The body 484 is cylindrical and extends from the head 482 (and in this example embodiment is integrally formed with the head 482). The foot 486 is cylindrical and extends from the body 484 (and in this example embodiment is integrally formed with the body 484). The head 482 and the foot 486 define a longitudinal axis $A_{482}$, and the body 484 defines a longitudinal axis $A_{484}$ that, as best shown in FIG. 8C, is laterally offset from the longitudinal axis $A_{482}$. Put differently, the body 484 is eccentrically mounted to the head 482 and the foot 486. The first eccentric mounting pin 470 has identical components.

Figure 8D:
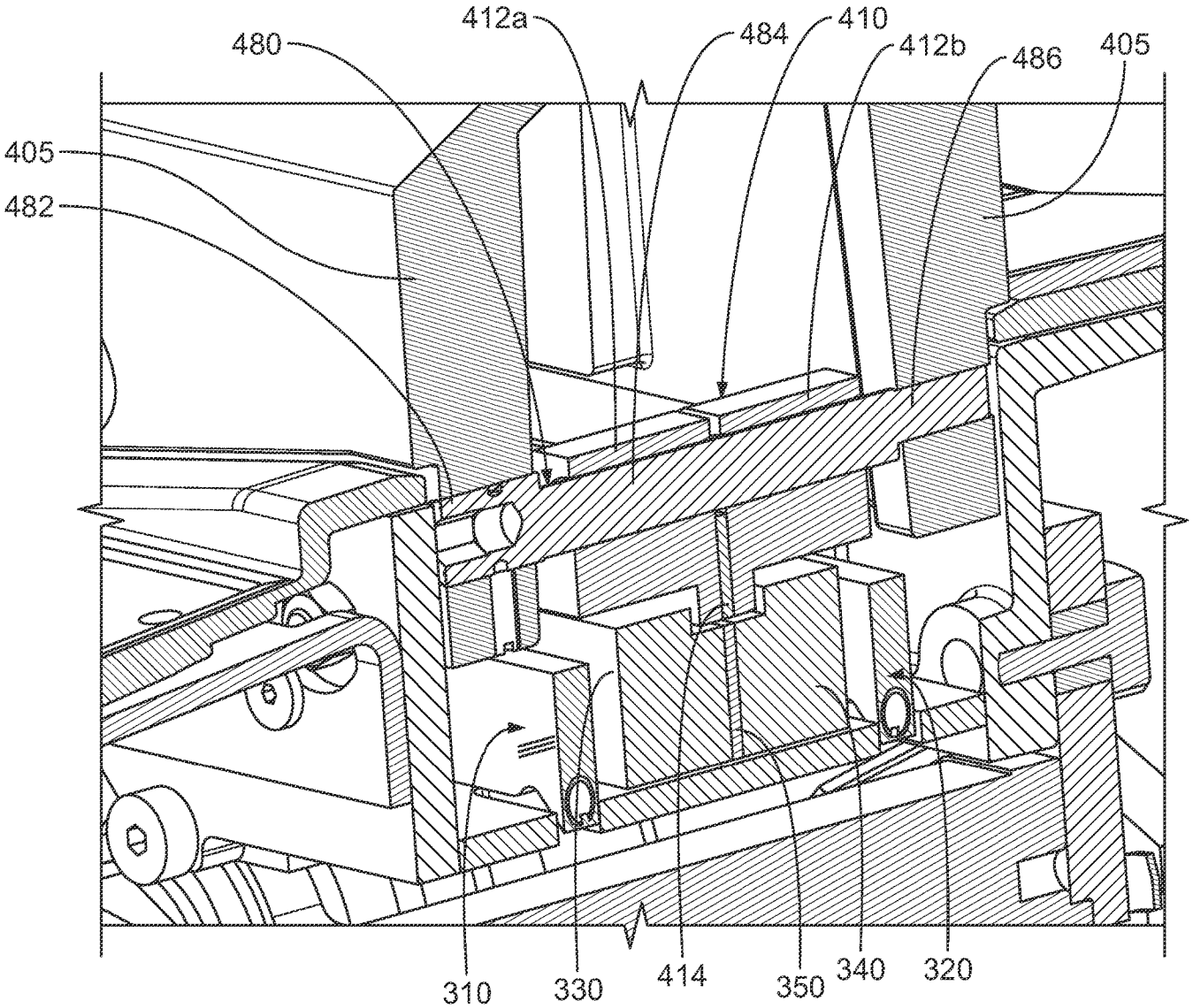
FIG. 8D is a cross-sectional perspective view of part of the strap-tensioning assembly showing the eccentric mounting pin of FIGS. 8A and 8B.

As shown in FIG. 8D, the head 482 and the foot 486 of the second eccentric mounting pin 480 are received in openings (not labeled) in the housing 405, and the body 484 of the eccentric mounting pin 480 extends through openings (not labeled) in the first and second outer guide members 412*a* and 412*b* of the base of the strap-channel cover 410. Due to this mounting configuration, the second eccentric mounting pin 480 is rotatable relative to the housing 405 and the strap-channel cover 410 about the first longitudinal axis $A_{482}$. Since the body 484 is eccentrically mounted to the head 482 and the foot 486, rotation of the second eccentric mounting pin 480 causes the body 484 to rotate around the first longitudinal axis $A_{482}$, which causes the strap-channel cover 410 to further from or closer to the lower strap-guiding assembly 300, thereby increasing or decreasing the height of the strap channel SC. Although not labeled for clarity, a spring-biased retainer (similar to the strap-channel-width-adjuster retainer 398 described above and shown in FIG. 5F) engages the depressions 482*a* to prevent unwanted rotation of the eccentric mounting pin 480.

Figure 7A:
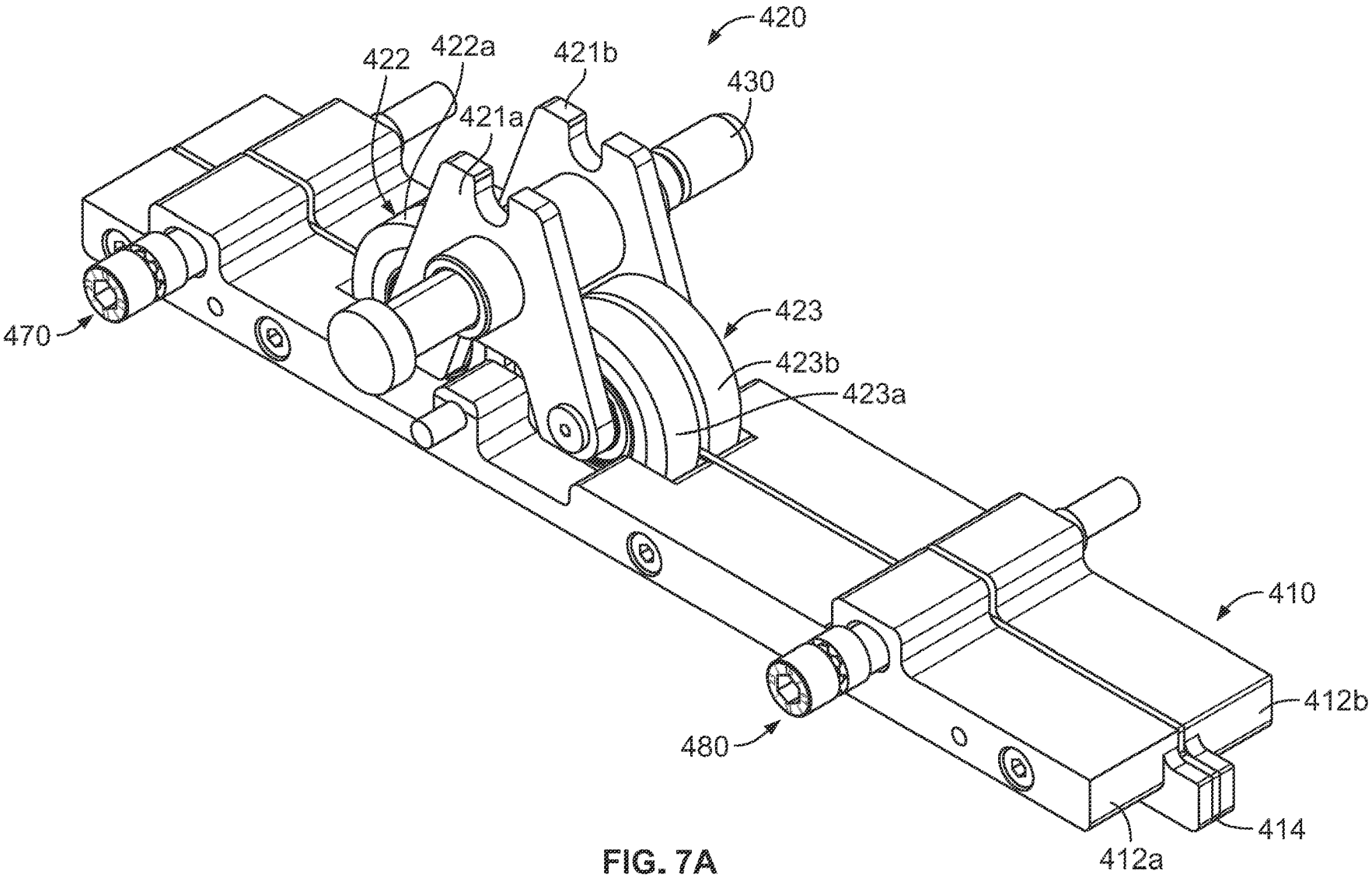
FIGS. 7A and 7B are perspective views of the upper strap-guiding assembly of the strap-tensioning assembly of FIG. 2 with certain components removed.
Figure 7B:
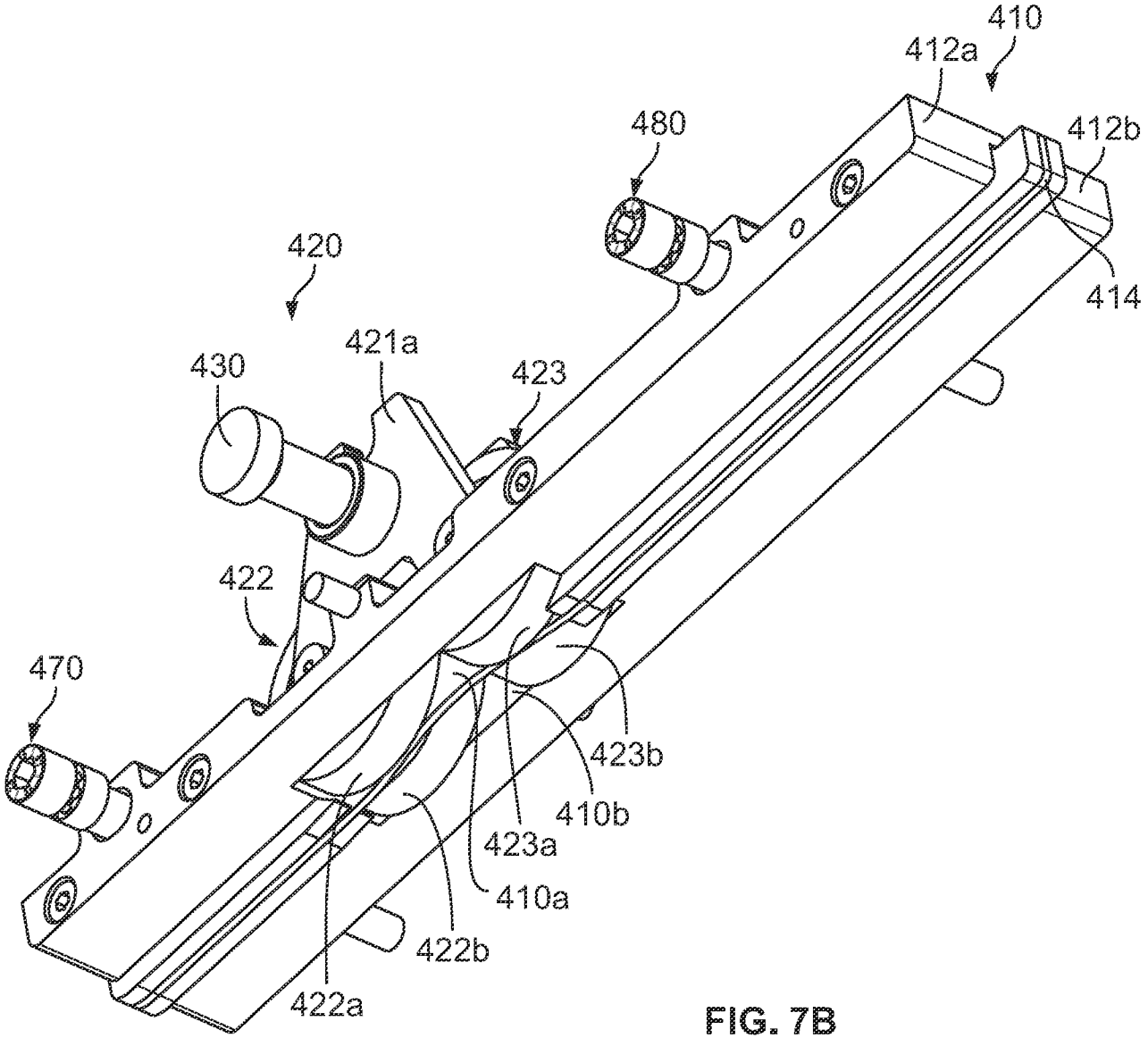

The counter-roller assembly 420, best shown in FIGS. 7A and 7B, includes first and second counter-roller supports 421*a* and 421*b* supporting first and second counter rollers 422 and 423. The first counter roller 422 includes spaced-apart, circumferential strap-engaging surfaces 422*a* and 422*b* and is mounted between the first and second counter-roller supports 421*a* and 421*b* via a mounting pin (not labeled). Similarly, the second counter roller 423 includes spaced-apart, circumferential strap-engaging surfaces 423*a* and 423*b* and is mounted between the first and second counter-roller supports 421*a* and 421*b* via a mounting pin (not labeled). The first and second counter rollers 422 and 423 are freely rotatable about their respective mounting pins relative to the counter-roller supports 421*a* and 421*b*. In this example embodiment, each counter roller includes a bearing (not labeled) through which its mounting pin extends.

The counter-roller assembly 420 is mounted to the housing 405 via the counter-roller-assembly mounting pin 430. Specifically, the counter-roller-assembly mounting pin 430 is received in and extends through a spacer (not labeled) that extends between the first and second counter-roller supports 421*a* and 421*b*. The ends of the counter-roller-assembly mounting pin 430 are supported by the housing 405. Once mounted, the counter-roller assembly 420 is rotatable relative to the remaining components of the upper strap-guiding assembly 400 and relative to the tensioning wheel 840 about the counter-roller-mounting pin 430. Once mounted, the strap-engaging surfaces 422*a* and 423*a* of the counter rollers 422 and 423 extend into the first counter-roller-receiving opening 410*a* and the strap-engaging surfaces 422*b* and 423*b* of the counter rollers 422 and 423 extend into the second counter-roller-receiving opening 410*b* such that these surfaces can engage the strap (when the strap is received in the strap channel) to ensure proper tensioning.

The tensioning assembly 500, which is shown in FIGS. 9A-14C, tensions the strap around the load. The tensioning assembly 500 includes a tensioning actuator 600, a drive gear 610, a transmission 700, and a tensioning-wheel assembly 800.

The tensioning actuator 600 (here an electric motor though any suitable actuator may be used) is mounted to the strap-tensioning-assembly frame 100. The tensioning actuator 600 has an output shaft (not labeled) defining a longitudinal axis $A_{605}$ to which the drive gear 610 is fixedly mounted (such as via a keyed, splined, or other suitable connection) such that the output shaft and the drive gear 600 are rotatable together about the axis $A_{605}$ and relative to the strap-tensioning-assembly frame 100.

Figure 10:
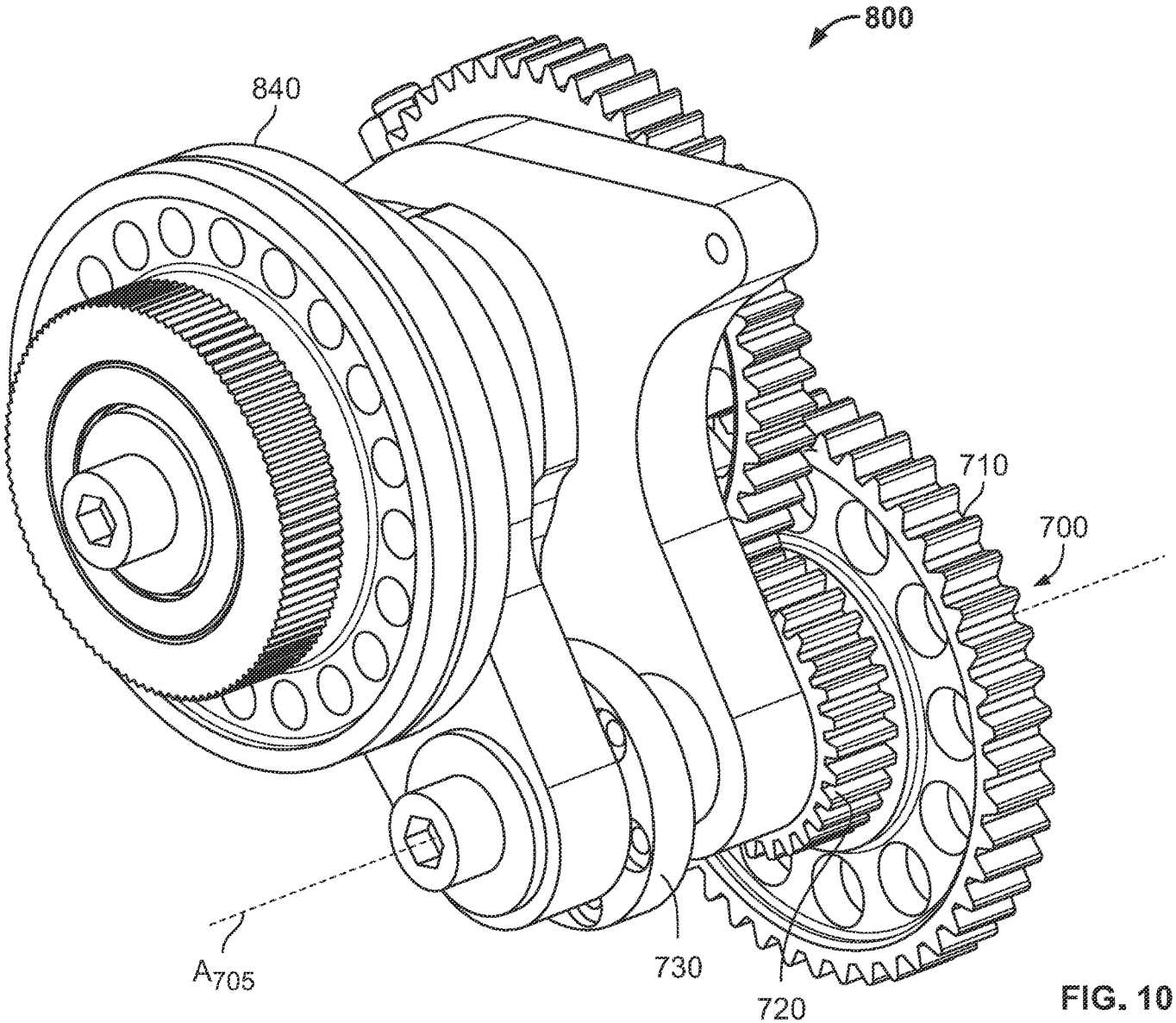
FIG. 10 is a perspective view of the transmission and the tensioning-wheel assembly of the tensioning assembly of FIGS. 9A and 9B.

The transmission 700, which is best shown in FIG. 10, includes a first transmission gear 710, a second transmission gear 720, a mounting collar 730, and a transmission shaft (not shown). The first transmission gear 710 has a first outside diameter, and the second transmission gear 720 has a second outside diameter that is less than the first outside diameter. The first transmission gear 710 is fixedly mounted (such as via a keyed, splined, or other suitable connection) to one end of the transmission shaft, and the second transmission gear 720 is fixedly mounted (such as via a keyed, splined, or other suitable connection) to the transmission shaft adjacent the first transmission gear 710 so the first transmission gear 710, the second transmission gear 720, and the transmission shaft are rotatable together about a longitudinal axis $A_{705}$ of the transmission shaft. The mounting collar 730, which (as described below) is used to mount the transmission 700 to the strap-tensioning assembly frame 100, is slidably mounted to the transmission output shaft such that the transmission shaft is rotatable relative to the mounting collar 730 (which includes a bearing in some embodiments).

The tensioning-wheel assembly 800, which is best shown in FIGS. 11A-11E, includes a tensioning-wheel-assembly shaft 805, a driven gear 810, a tensioning-wheel-assembly mount 815, a tensioning-wheel positioner 820, a first freewheel 825, a tensioning-wheel mount 830, a second freewheel 835, a tensioning wheel 840, and a tensioning-wheel retainer 850.

The tensioning-wheel-assembly mount 815 includes spaced-apart first and second mounting elements 815*a* and 815*b* connected by a connecting element 815*c*. The first mounting element 815*a* includes a body (not labeled) having a transmission-mounting foot 815*a*1 defining a transmission-mounting opening (not labeled) therethrough. The body also includes a biasing-assembly-mounting arm 815*a*2. The body defines a tensioning-wheel-assembly-mounting opening (not labeled) therethrough in which a bearing (not labeled) is received. The second mounting element 815*b* includes a body (not labeled) having a transmission-mounting foot 815*b*1 defining a transmission-mounting opening (not labeled) therethrough. The body defines a tensioning-wheel-assembly-mounting opening (not labeled) therethrough in which a bearing (not labeled) is received. The body also defines a locking opening 815*b*2 therethrough sized to receive the locking pin 50 to facilitate locking the tensioning wheel 840 against rotation, as described below.

Figure 11A:
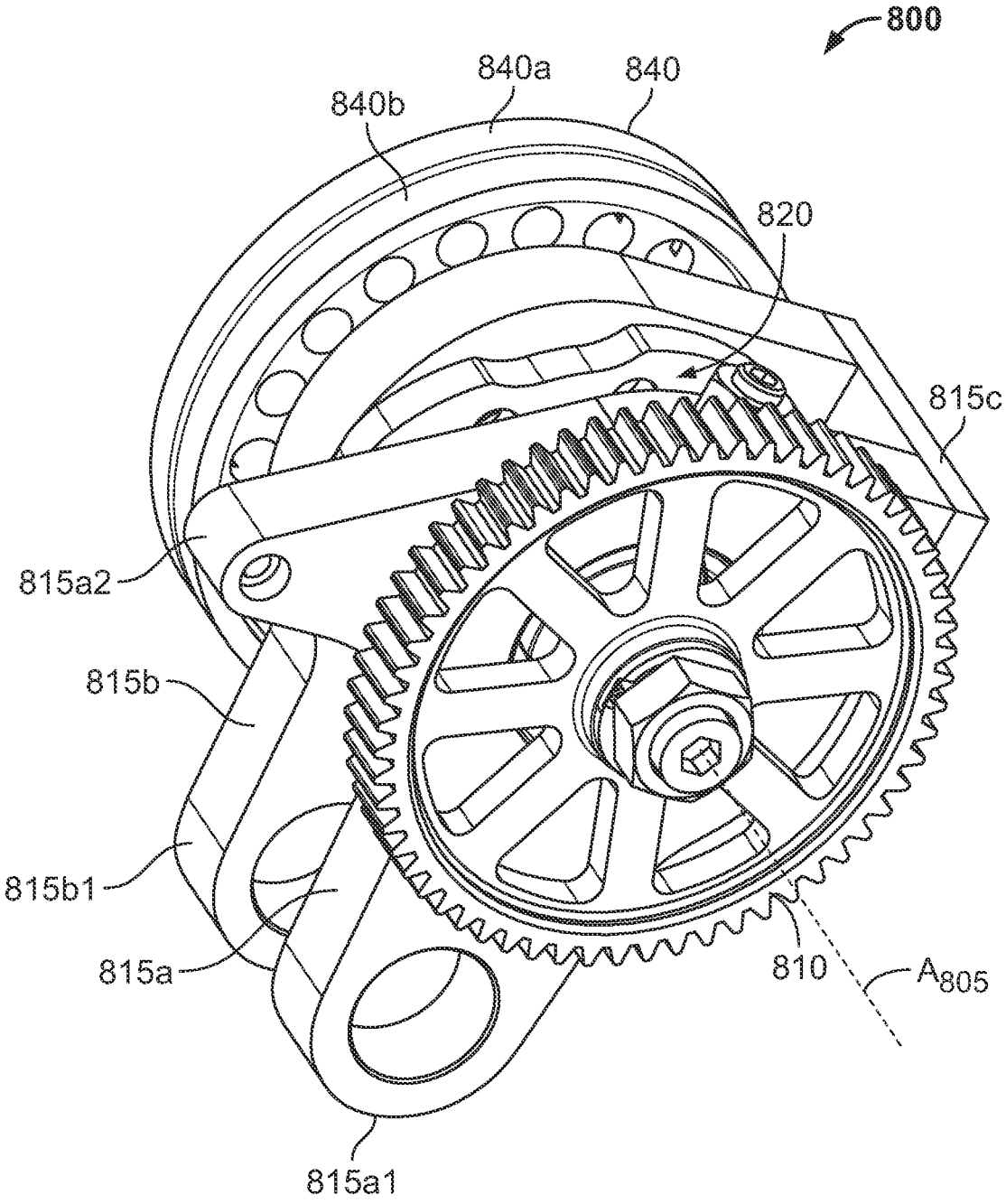
FIGS. 11A and 11B are opposing perspective views of the tensioning-wheel assembly of FIG. 10.
Figure 11B:
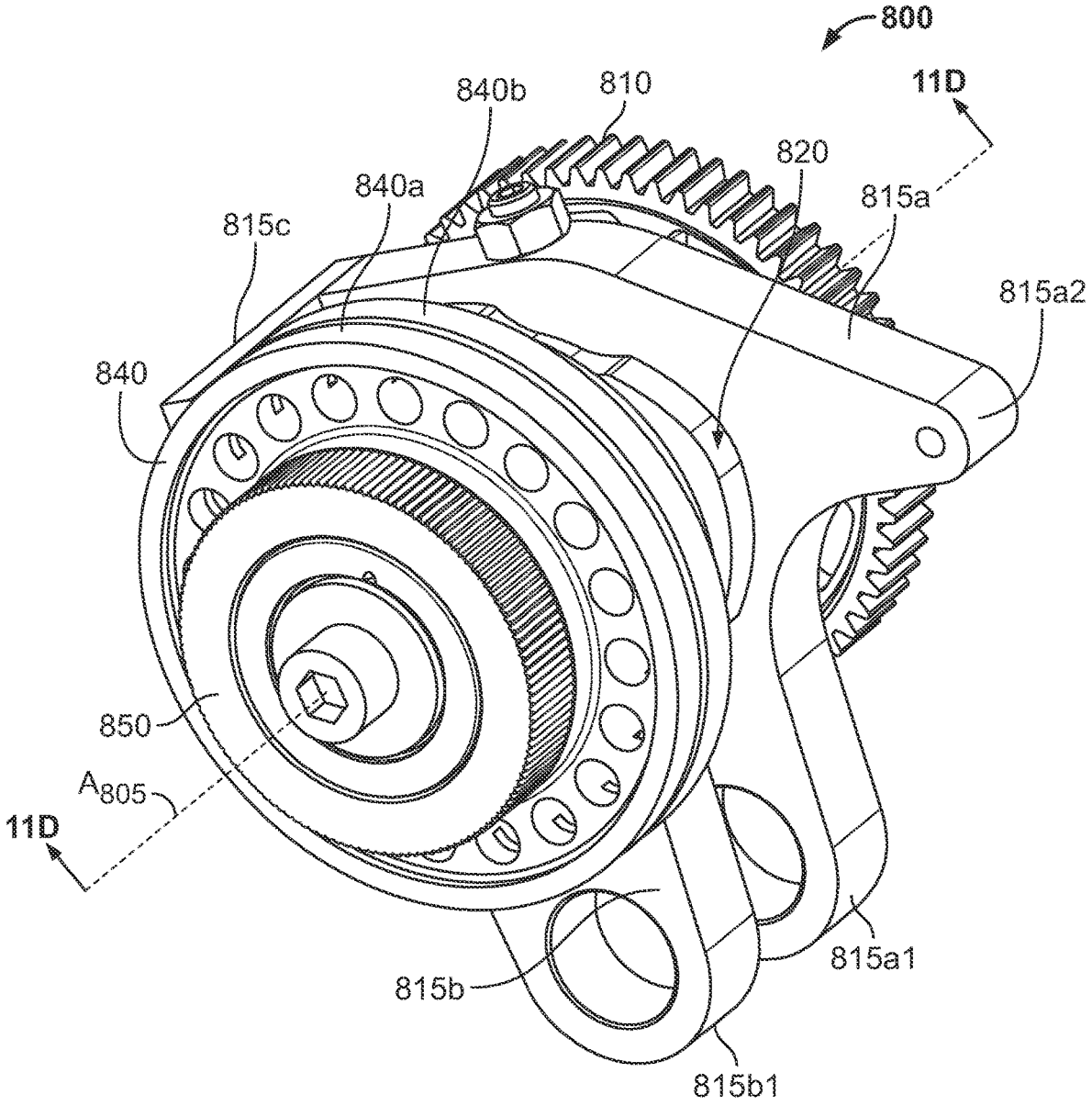
Figure 11C:
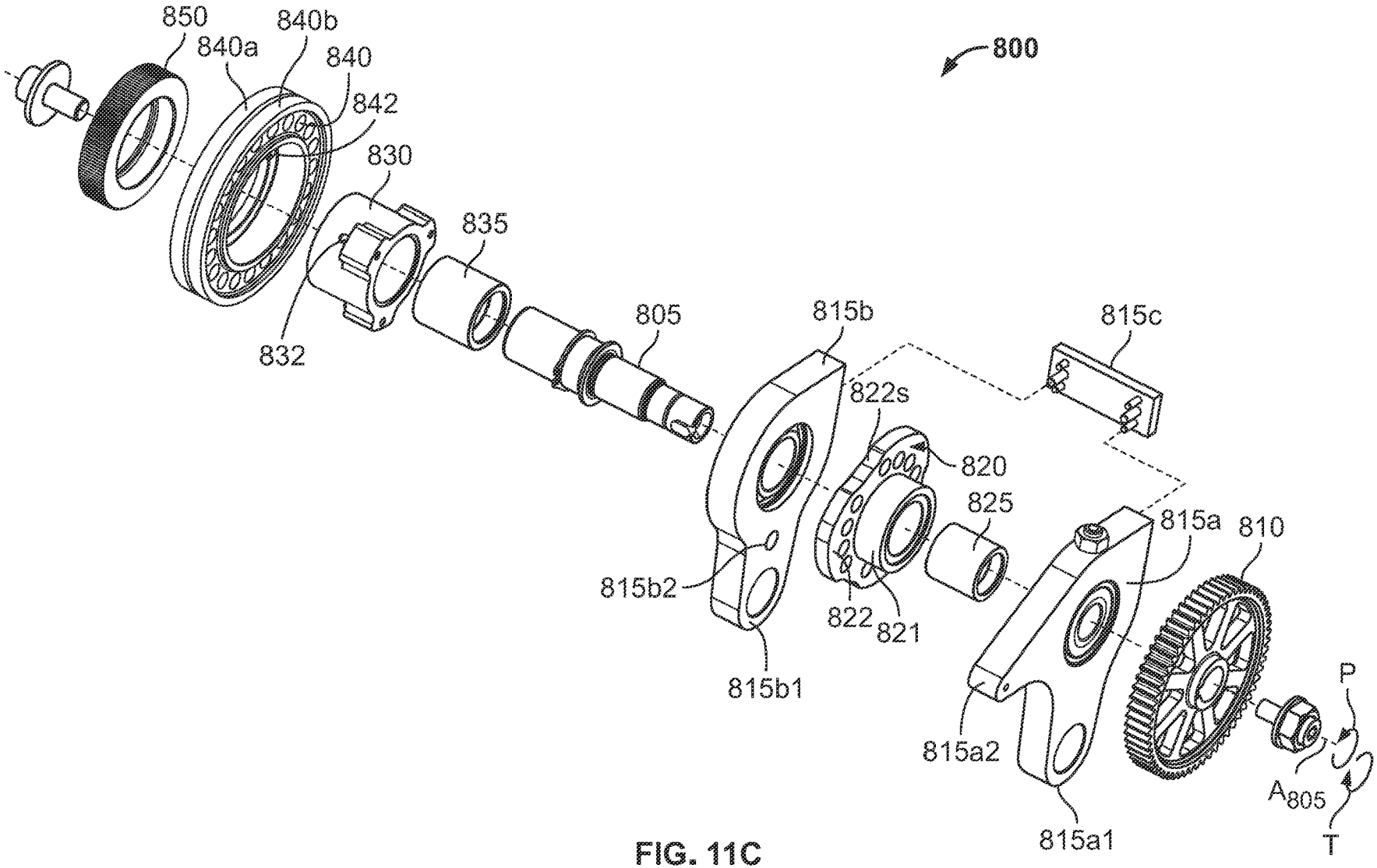
FIG. 11C is an exploded perspective view of the tensioning-wheel assembly of FIGS. 11A and 11B.
Figure 11D:
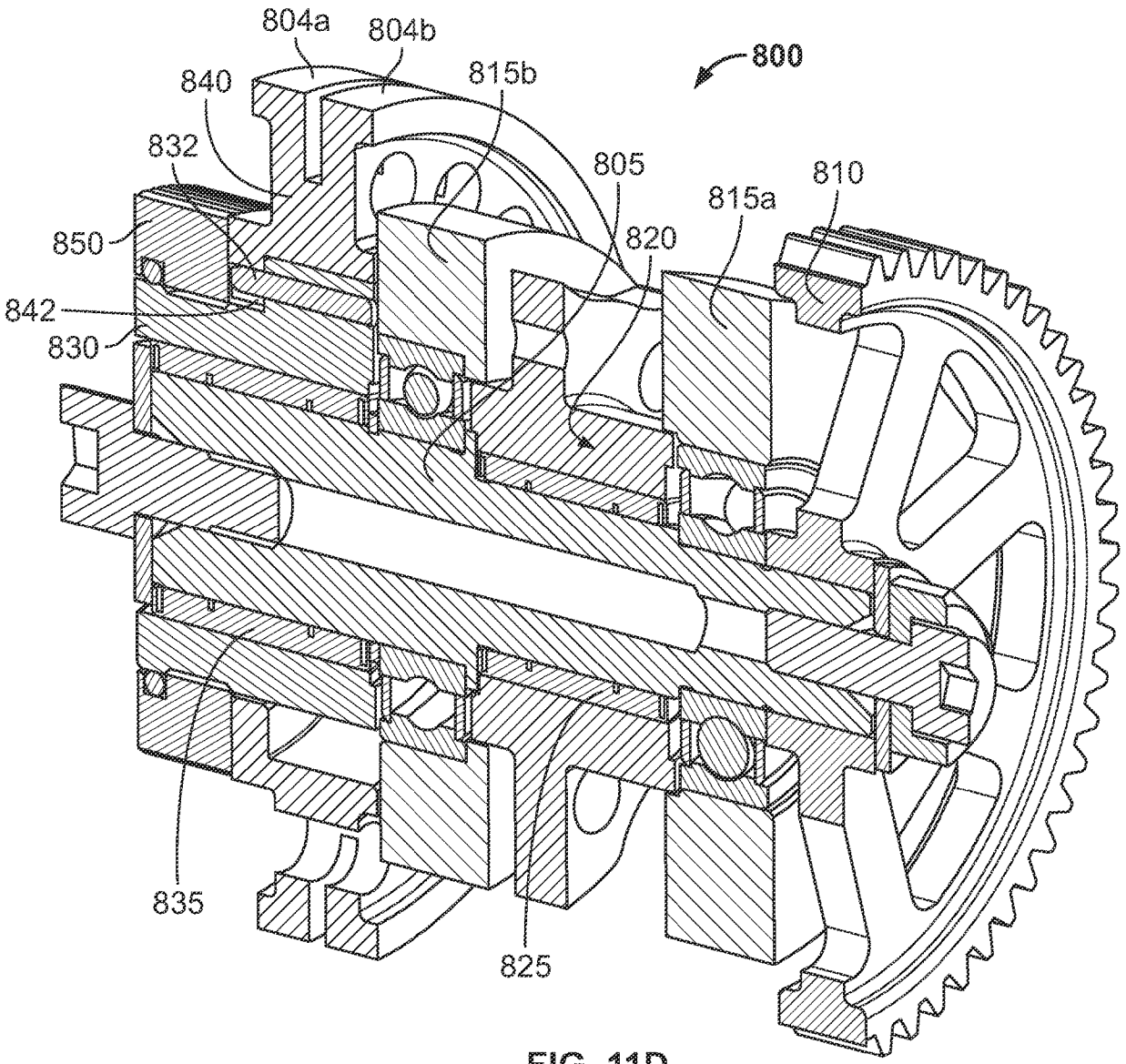
FIG. 11D is a cross-sectional perspective view of the tensioning-wheel assembly of FIGS. 11A and 11B taken substantially along line 11D-11D of FIG. 11B.
Figure 11E:
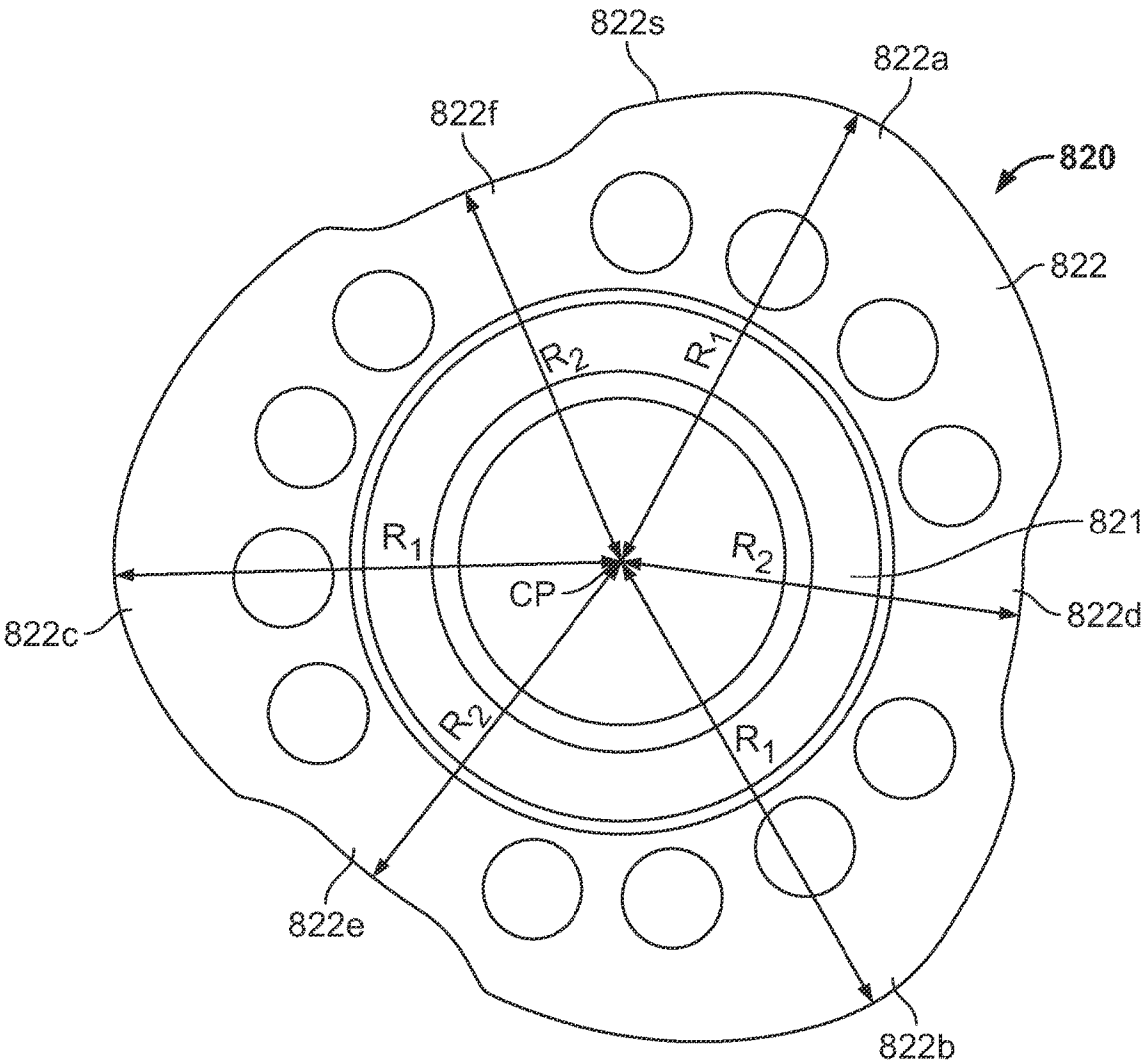
FIG. 11E is an end-on view of the tensioning-wheel-positioning cam of the tensioning-wheel assembly of FIGS. 11A and 11B.

The tensioning-wheel positioner 820 is best shown in FIG. 11E and includes a sleeve 821 and a cam 822 extending radially from the sleeve 821. The cam 822 includes lobes 822*a*, 822*b*, and 822*c* separated by recessed portions 822*d*, 822*e*, and 822*f*, respectively. Each of the lobes 822*a*, 822*b*, and 822*c* has a convex (constant or variable radius) perimeter with a peak having a radius R1, and each of the recessed portions 822*d*, 822*e*, and 822*f* has a concave perimeter with a trough having a radius R2 that is less than R1. The troughs of the recessed portions 822*d*, 822*e*, and 822*f* are generally flat in this example embodiment, though they may be curved in other embodiments. A camming surface 822*s* (FIG. 11C) is defined around the perimeter of the cam 822.

The driven gear 810 is fixedly mounted (such as via a keyed, splined, or other suitable connection) to one end of the tensioning-wheel-assembly shaft 805 so the driven gear 810 and the tensioning-wheel-assembly shaft 805 are rotatable together about a longitudinal axis $A_{805}$ of the tensioning-wheel-assembly shaft 805. The tensioning-wheel-assembly shaft 805 extends through the bearings in the tensioning-wheel-assembly mount 815 to mount the tensioning-wheel-assembly mount 815 to the tensioning-wheel-assembly shaft 805 such that the tensioning-wheel-assembly shaft 805 can rotate about the axis $A_{805}$ relative to the tensioning-wheel-assembly mount 815. The first freewheel 825 is mounted to the tensioning-wheel-assembly shaft 805 between the first and second mounting elements 815*a* and 815*b* of the tensioning-wheel-assembly mount 815, and the tensioning-wheel positioner 820 is mounted to the first freewheel 825 (via the sleeve 821) so the tensioning-wheel positioner 820 and the first freewheel 825 are rotatable together about the axis $A_{805}$. In this example embodiment, the first freewheel 825 is configured to: (1) rotate with the tensioning-wheel-assembly shaft 805 about the axis $A_{805}$ when the tensioning-wheel-assembly shaft 805 rotates in a positioning (or first) rotational direction P (FIG. 11C); and (2) not rotate with the tensioning-wheel-assembly shaft 805 when the tensioning-wheel-assembly shaft 805 rotates in a tensioning (or second) rotational direction T (FIG. 11C) opposite the positioning rotational direction P.

The second freewheel 835 is mounted to the tensioning-wheel-assembly shaft 805 adjacent the second mounting element 815*b* of the tensioning-wheel-assembly mount 815, and the tensioning-wheel mount 830 is mounted to the second freewheel 835 so the tensioning-wheel mount 830 and the second freewheel 835 are rotatable together about the axis $A_{805}$. In this example embodiment, the second freewheel 835 is configured to: (1) not rotate with the tensioning-wheel-assembly shaft 805 when the tensioning-wheel-assembly shaft 805 rotates in the positioning rotational direction P; and (2) rotate with the tensioning-wheel-assembly shaft 805 about the axis $A_{805}$ when the tensioning-wheel-assembly shaft 805 rotates in the tensioning rotational direction T. In other embodiments, the tensioning-wheel assembly 800 does not include the second freewheel 835, and the tensioning-wheel mount 830 is fixedly attached (via a keyed, splined, or other suitable connection) to the tensioning-wheel-assembly shaft 805 to rotate therewith.

Figure 15A:
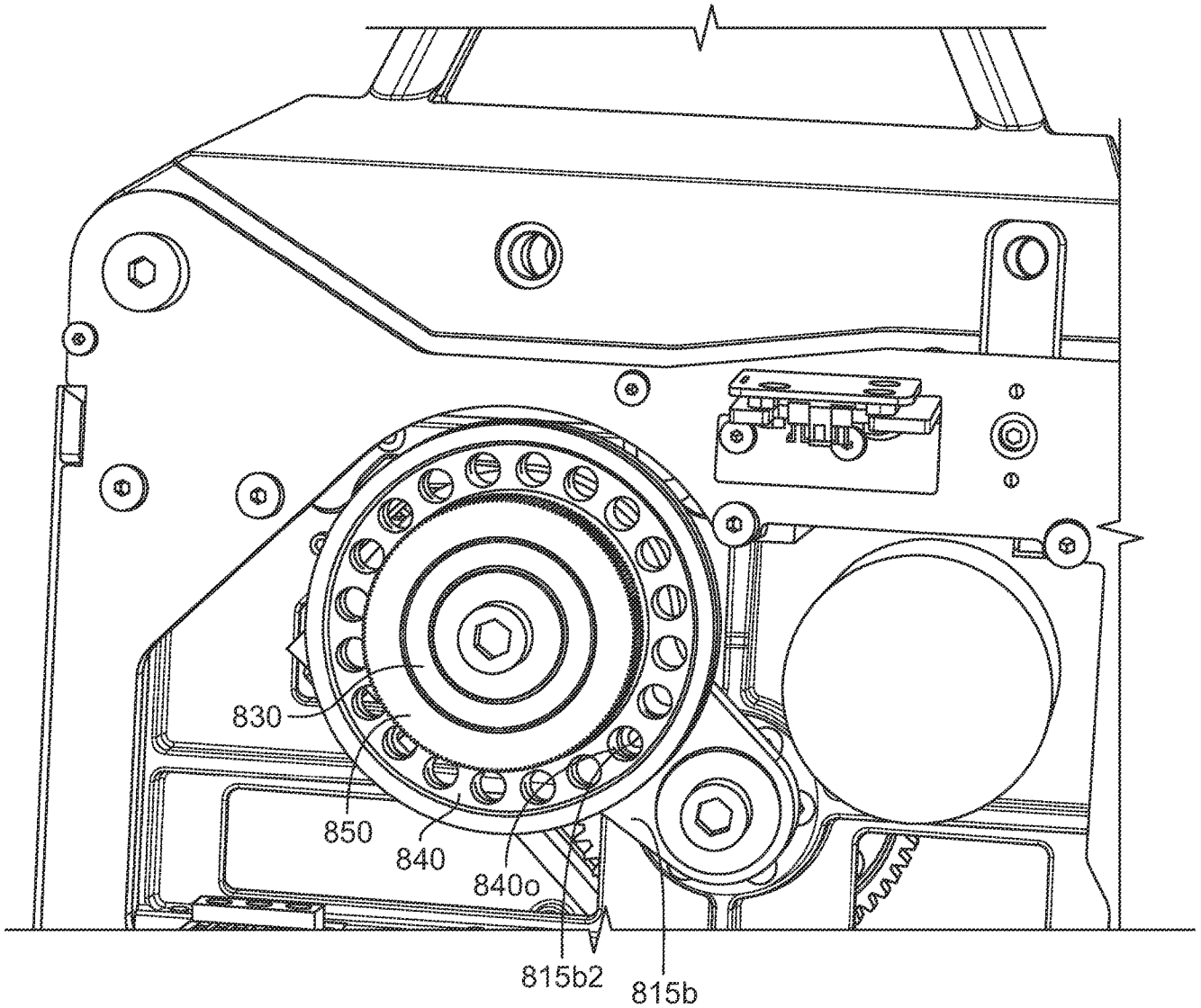
FIGS. 15A and 15B are side views of the strap-tensioning assembly of FIG. 2 with its covers removed and showing various components of the tensioning assembly.

The tensioning wheel 840, which has spaced-apart circumferential strap-engaging surfaces 840*a* and 840*b*, is removably mounted to the tensioning-wheel mount 830 so the tensioning wheel 840 and the tensioning-wheel mount 830 are rotatable together about the axis $A_{805}$. As shown in FIG. 15A, circumferentially spaced (about the axis $A_{805}$) locking openings 840*o* are defined through the tensioning wheel 840 near the perimeter of the tensioning wheel 840. As described below, the locking openings 840*o* are sized to receive the locking pin 50 facilitate locking the tensioning wheel 840 against rotation. In this example embodiment, the tensioning-wheel mount 830 includes three radially spaced (relative to the axis $A_{805}$) mounting studs 832 (FIGS. 11C and 11D) that are received in corresponding mounting openings 842 (FIGS. 11C and 11D) defined in the tensioning wheel 840. This ensures the tensioning wheel 840 and the tensioning-wheel mount 830 rotate together about the axis $A_{805}$. The tensioning-wheel retainer 850 is removably mounted to the tensioning-wheel mount 830 to retain the tensioning wheel 840 in place.

Figure 15B:
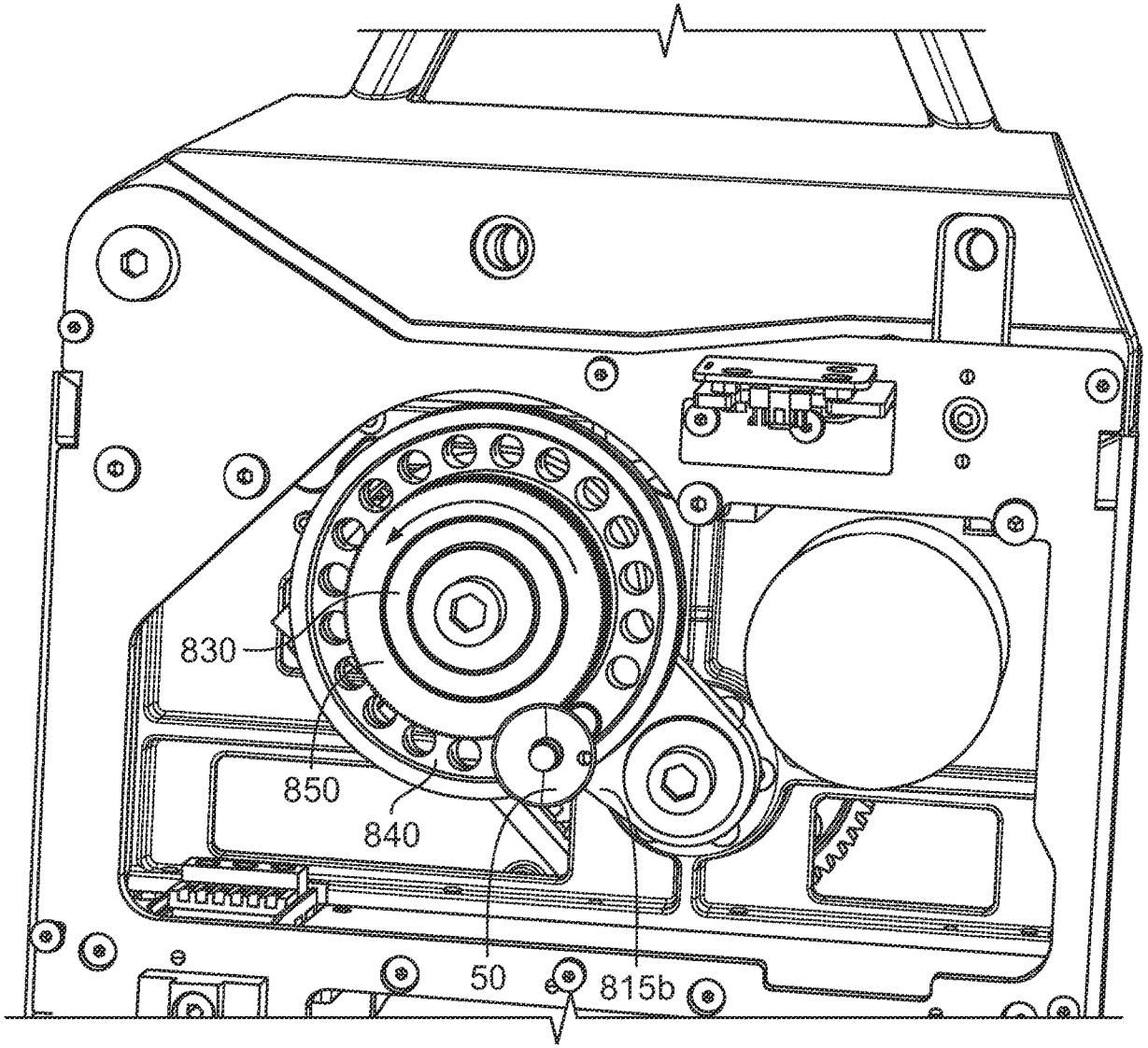

Although not shown for clarity, in this example embodiment the tensioning-wheel retainer 850 is threadable onto threads defined on the tensioning-wheel mount 830. To remove the tensioning wheel 840 (such as for cleaning or replacement), an operator aligns one of the locking openings 840*o* of the tensioning when 840 with the locking opening 815*b*2 of the tensioning-wheel-assembly mount 815 (as shown in FIG. 15A) by (if necessary) rotating the tensioning when 840 about the axis $A_{805}$. The operator then inserts the locking pin 50 through those locking openings, as shown in FIG. 15B, which prevents the tensioning wheel 840 from rotating about the axis $A_{805}$. The operator then removes the tensioning-wheel retainer 850 from the tensioning-wheel mount 830—here, by unthreading it from the tensioning-wheel mount 830—and slides the tensioning wheel 840 off of the tensioning-wheel mount 830. The operator reverses this process to mount the tensioning wheel 840 back onto the tensioning-wheel mount 830. In this embodiment, the operator need not re-insert the locking pin 50 into a locking opening 840*o* since the second freewheel 835 holds the tensioning-wheel mount 830 against rotation about the axis $A_{805}$ as the operator threads the tensioning-wheel retainer 850 back onto the tensioning-wheel mount 830. The threadable connection between the tensioning-wheel retainer 850 and the tensioning-wheel mount 830 and the use of the strap-tensioning assembly's locking pin 50 to lock the tensioning wheel 840 against rotation means the operator does not need any tools to remove the tensioning wheel 840 from the tensioning-wheel mount 830, making removal quick and easy.

Accordingly, when the tensioning-wheel-assembly shaft 805 rotates about the axis $A_{805}$ in the positioning rotational direction P, the driven wheel 810 and the tensioning-wheel positioner 820 rotate with the tensioning-wheel-assembly shaft 805 while the tensioning-wheel mount 830, the tensioning wheel 840, and the tensioning-wheel retainer remain stationary. When the tensioning-wheel-assembly shaft 805 rotates in the tensioning rotational direction T about the axis $A_{805}$, the driven wheel 810, the tensioning-wheel mount 830, the tensioning wheel 840, and the tensioning-wheel retainer 850 rotate with the tensioning-wheel-assembly shaft 805 while the tensioning-wheel positioner 820 remains stationary.

Figure 9A:
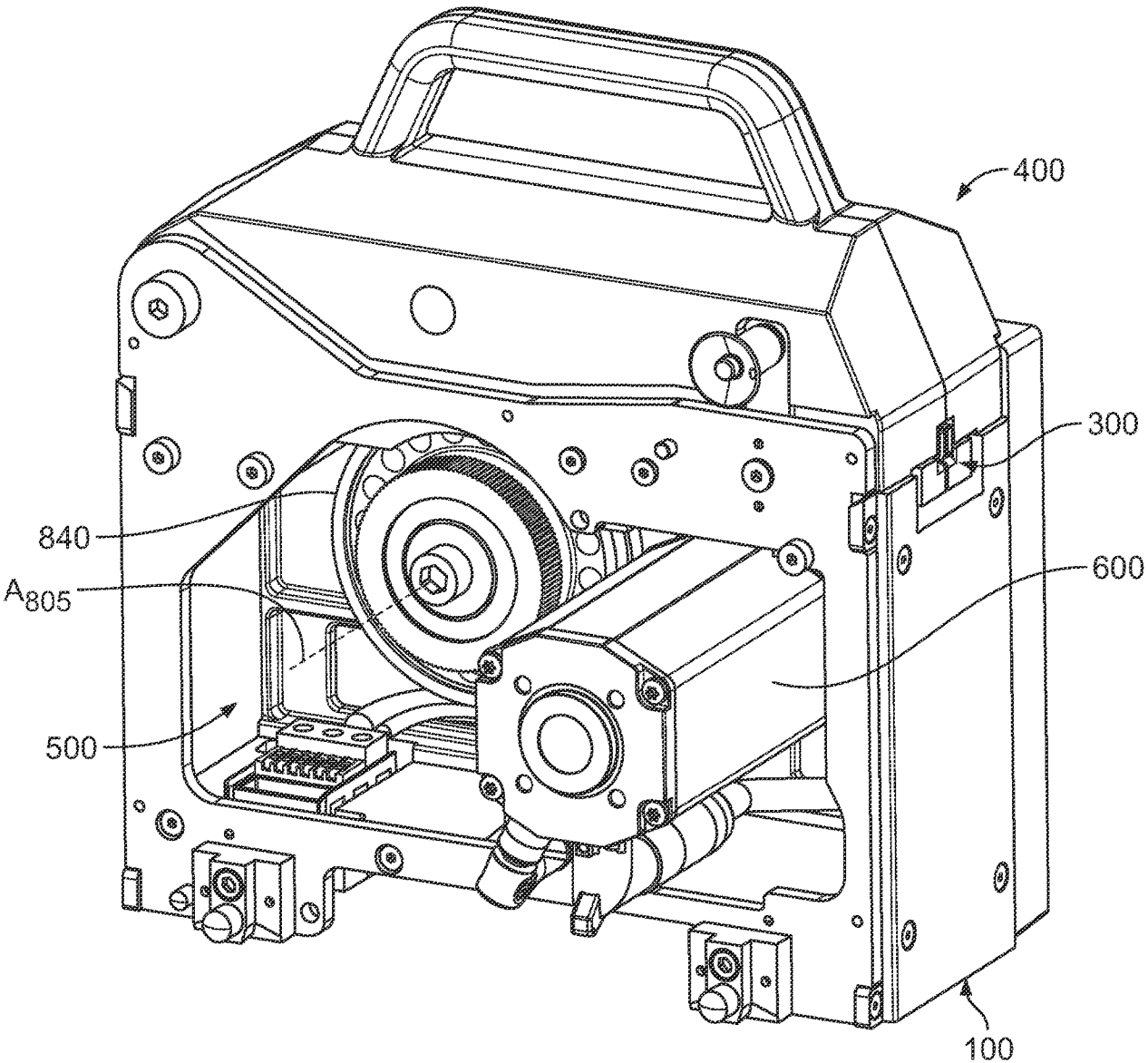
FIGS. 9A and 9B are opposing perspective views of the strap-tensioning assembly of FIG. 2 with its covers removed to expose the tensioning assembly.
Figure 9B:
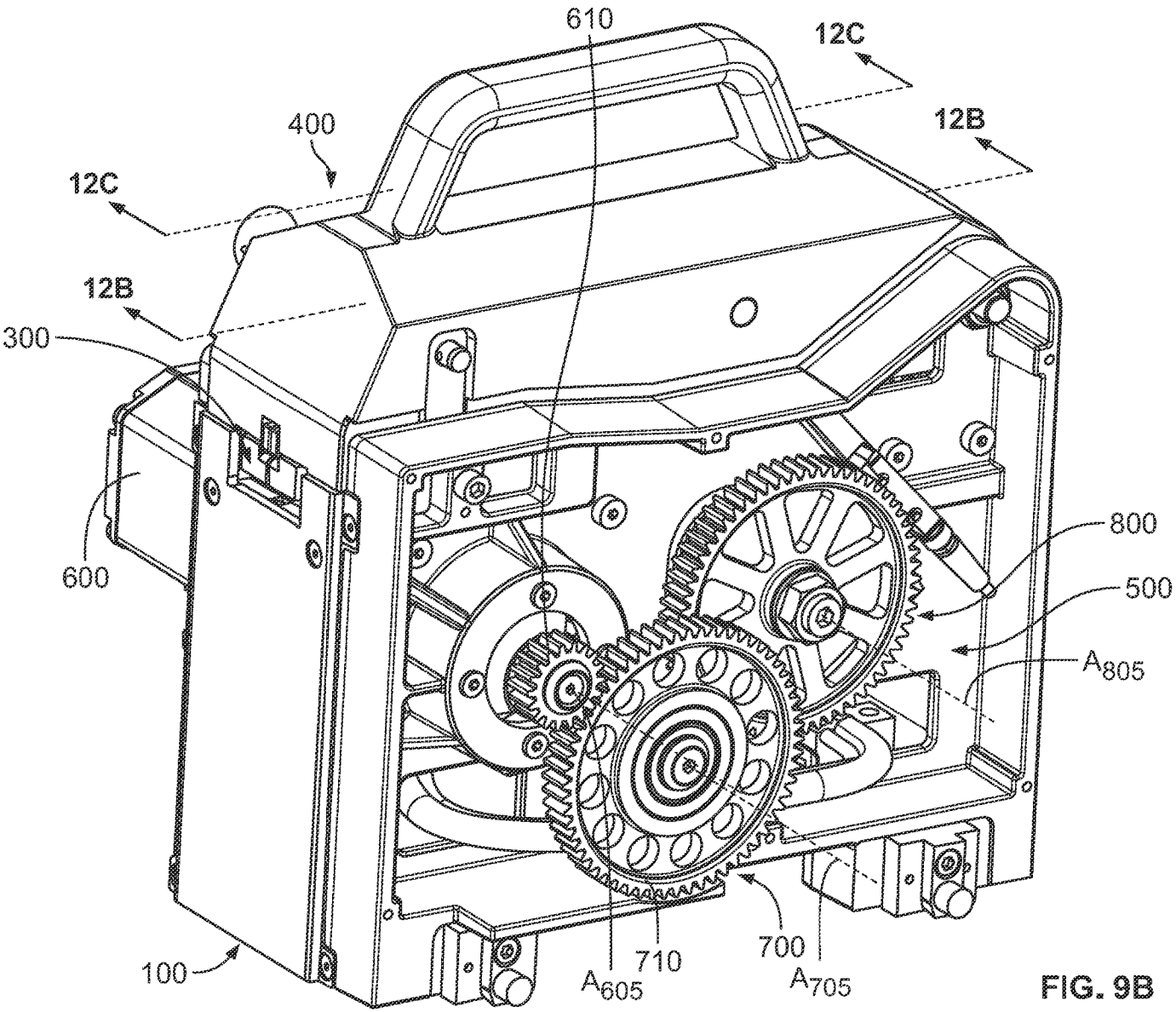

The tensioning-wheel assembly 800 is mounted to the transmission 700 such that the tensioning-wheel assembly 800 can rotate relative to the transmission 700 (and most other components of the strap-tensioning assembly 10) about the axis $A_{705}$ of the transmission shaft. Specifically, and as shown in FIG. 10, the transmission shaft extends through the transmission-mounting opening defined in the foot 815*a*1 of the first mounting element 815*a* and the transmission-mounting opening defined in the foot 815*b*1 of the second mounting element 815*b* (which may include bearings) to mount the tensioning-wheel assembly 800 to the transmission shaft $A_{705}$ such that the tensioning-wheel assembly 800 can rotate about the transmission shaft. The mounting collar 730 is sandwiched between the feet 815*a*1 and 815*b*1 and is fixedly attached to the strap-tensioning assembly frame 100 via suitable fasteners (or in any other suitable manner). As best shown in FIGS. 9B and 10, the drive gear 610 is drivingly engaged to the first transmission gear 710 of the transmission 700, and the second transmission gear 720 of the transmission 700 is drivingly engaged to the driven gear 810 of the tensioning-wheel assembly 800.

The tensioning assembly 800 is rotatable about the axis $A_{705}$ of the transmission shaft between: (1) a retracted position (FIG. 12C) in which the strap-engaging surfaces 840*a* and 840*b* of tensioning wheel 840 are spaced apart from the strap (when the strap extends through the strap channel SC); and (2) a tensioning position (FIG. 13C) in which the strap-engaging surfaces 840*a* and 840*b* contact the strap and force it against the counter-rollers 422 and 423 in preparation for tensioning (when the strap extends through the strap channel SC). And as described in detail below, during the strap-tensioning process the tensioning assembly 800 continues to rotate about the axis $A_{705}$ away from the tensioning and retracted positions.

Figure 12A:
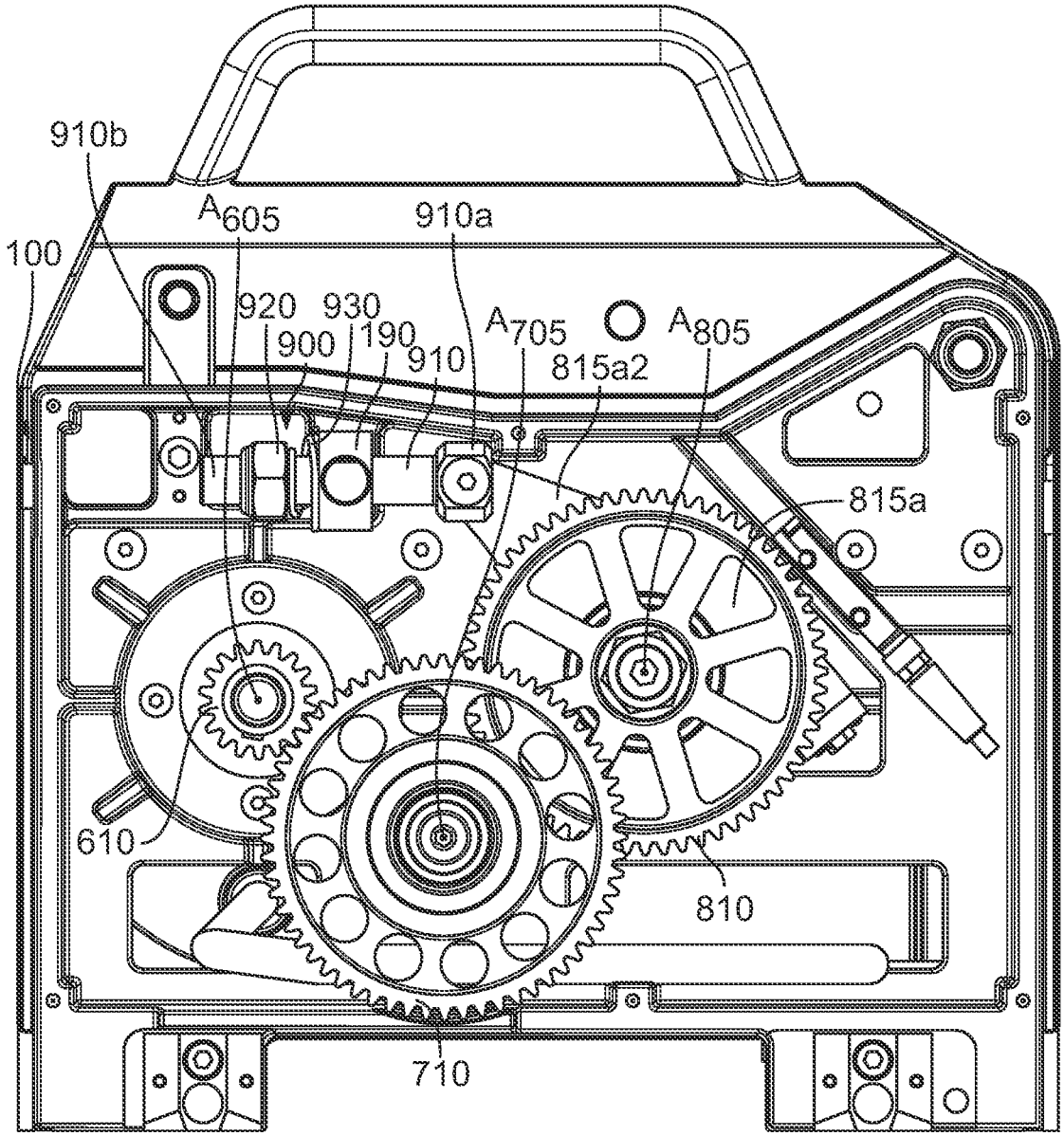
FIGS. 12A, 13A, and 14A are side views of the strap-tensioning assembly of FIG. 2 with its covers removed showing movement of various components of the tensioning assembly and the biasing assembly as the tensioning wheel moves from its retracted position into contact with the strap and begins tensioning the strap.
Figure 13A:
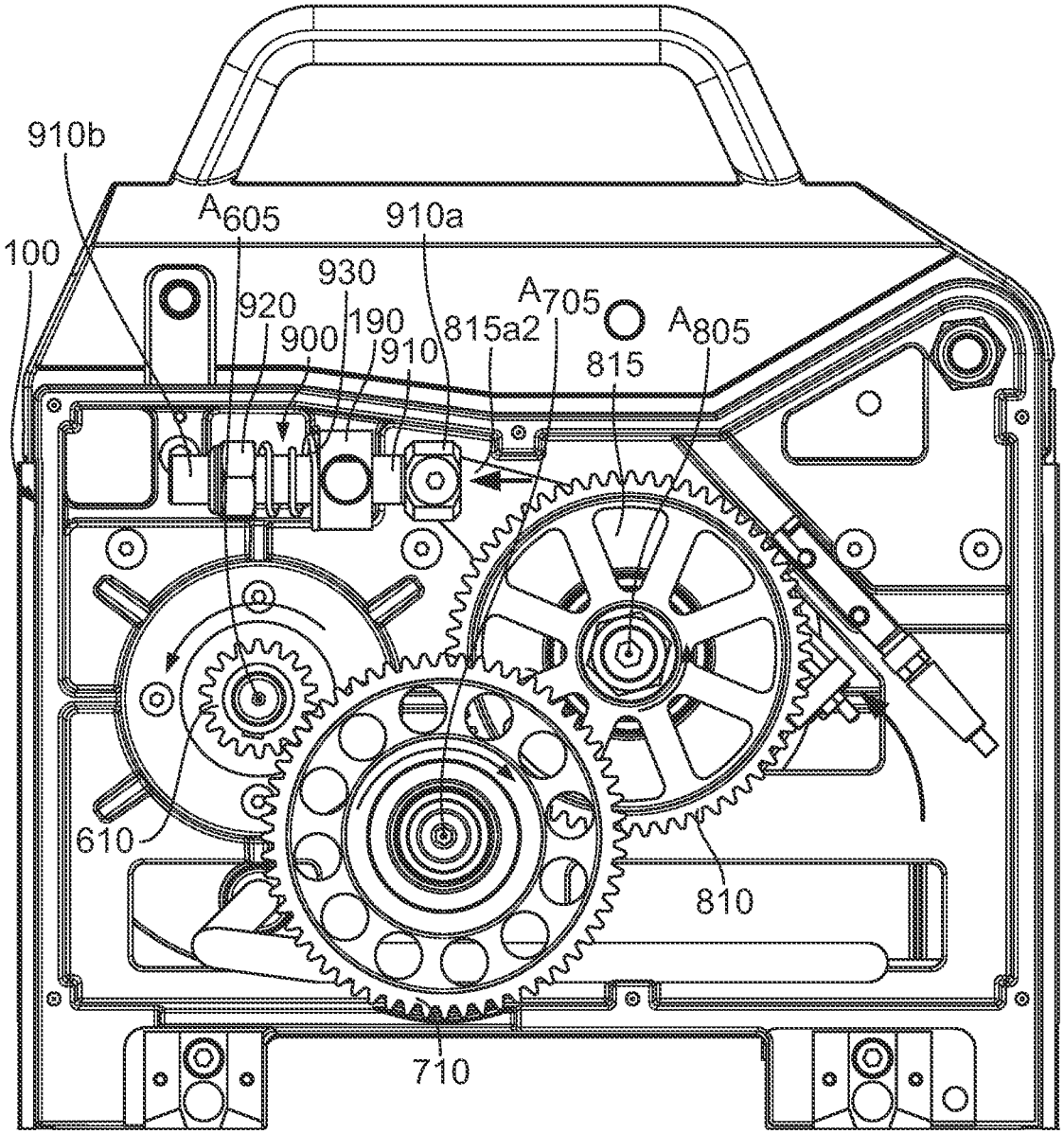
Figure 14A:
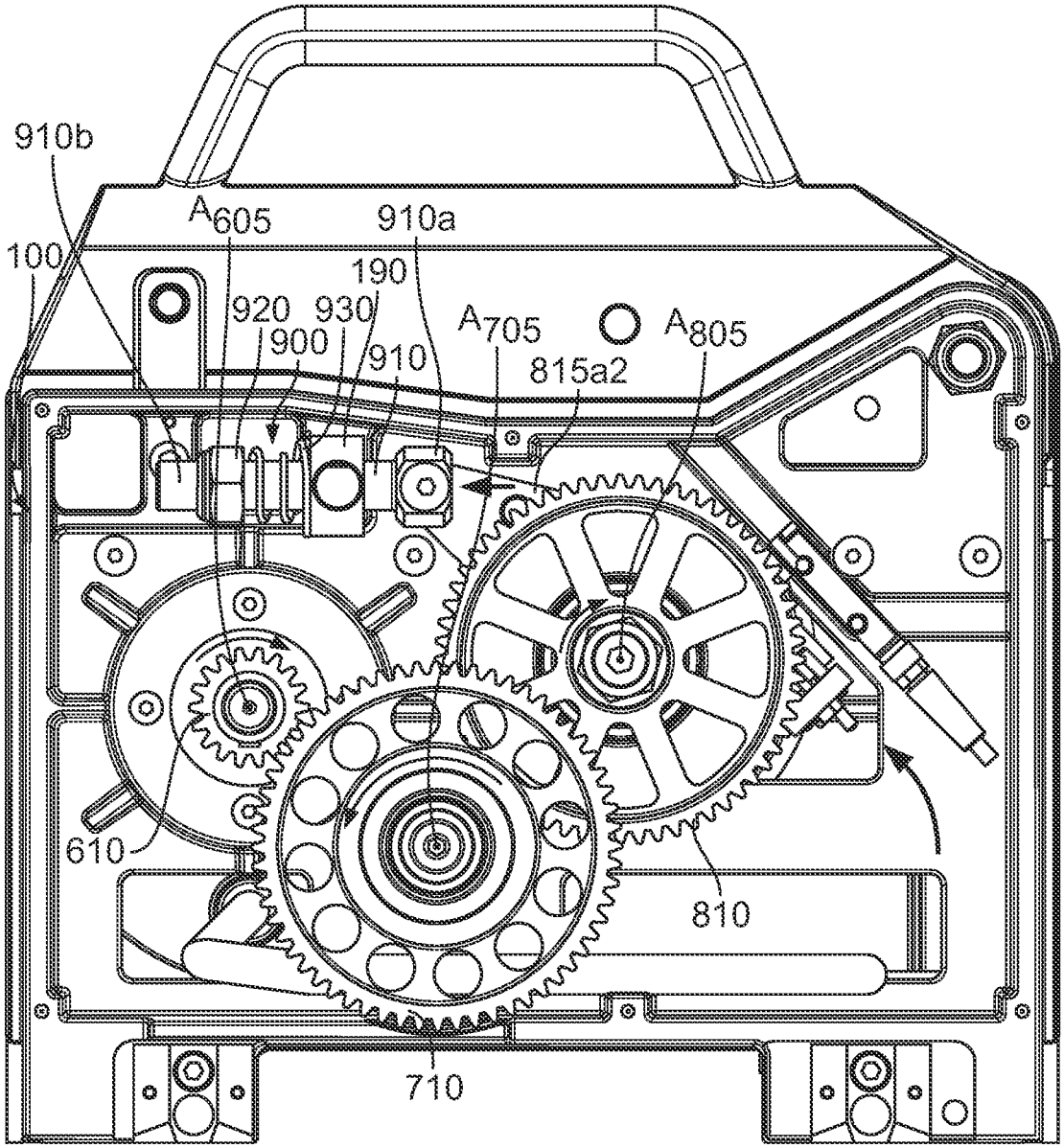

The biasing assembly 900, which is best shown in FIGS. 12A, 13A, and 14A, biases the tensioning-wheel assembly 800 away from its retracted position and toward its tensioning position. The biasing assembly 900 includes a body 910 having a head 910*a* and a foot 910*b*, a retainer 920 mounted to the foot 910*b* of the body 910, and a biasing element 930. In this example embodiment, the body 910 is cylindrical and extends through a bore (not shown) defined through a biasing-assembly mount 190 of the strap-tensioning-assembly frame 100. The head 910*a* of the body 910 is fixedly attached to the biasing-assembly-mounting arm 815*a*2 of the first mounting element 815*a* of the tensioning-wheel assembly 800. The biasing element 930, which is a spring in this example embodiment, circumscribes the body 910 and extends between the retainer 920, which is mounted to the foot 910*b* of the body 910, and the biasing-assembly mount 190. This configuration results in the biasing assembly 900 (and specifically the biasing element 930) biasing the tensioning-wheel assembly 800 away from its retracted position and toward its tensioning position.

Figure 12B:
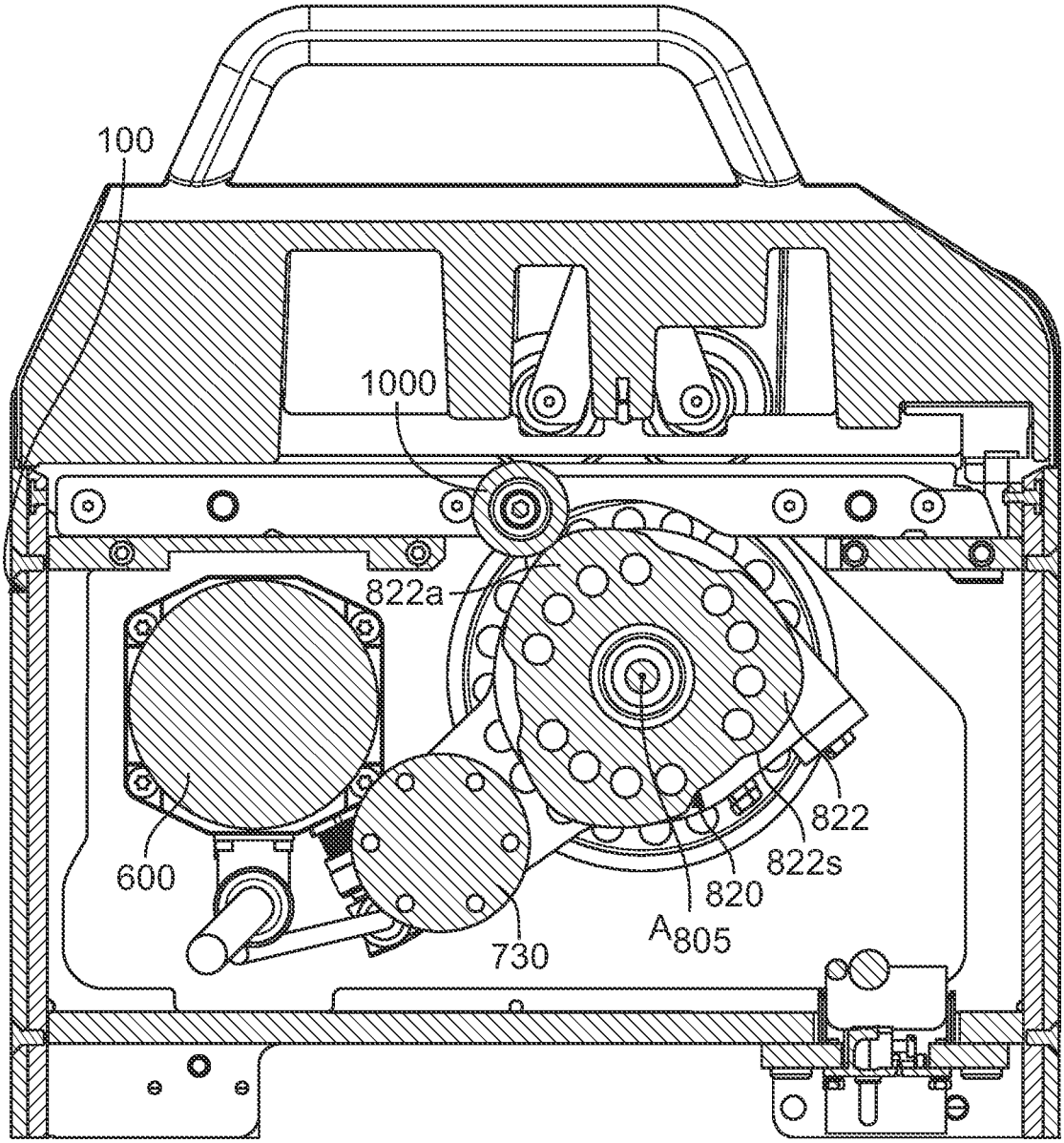
FIGS. 12B, 13B, and 14B are cross-sectional side views that correspond to FIGS. 12A, 13A, and 14A and that are taken substantially along line 12B-12B of FIG. 9B and that show the position of the tensioning-wheel positioner of the tensioning assembly relative to a cam follower.
Figure 12C:
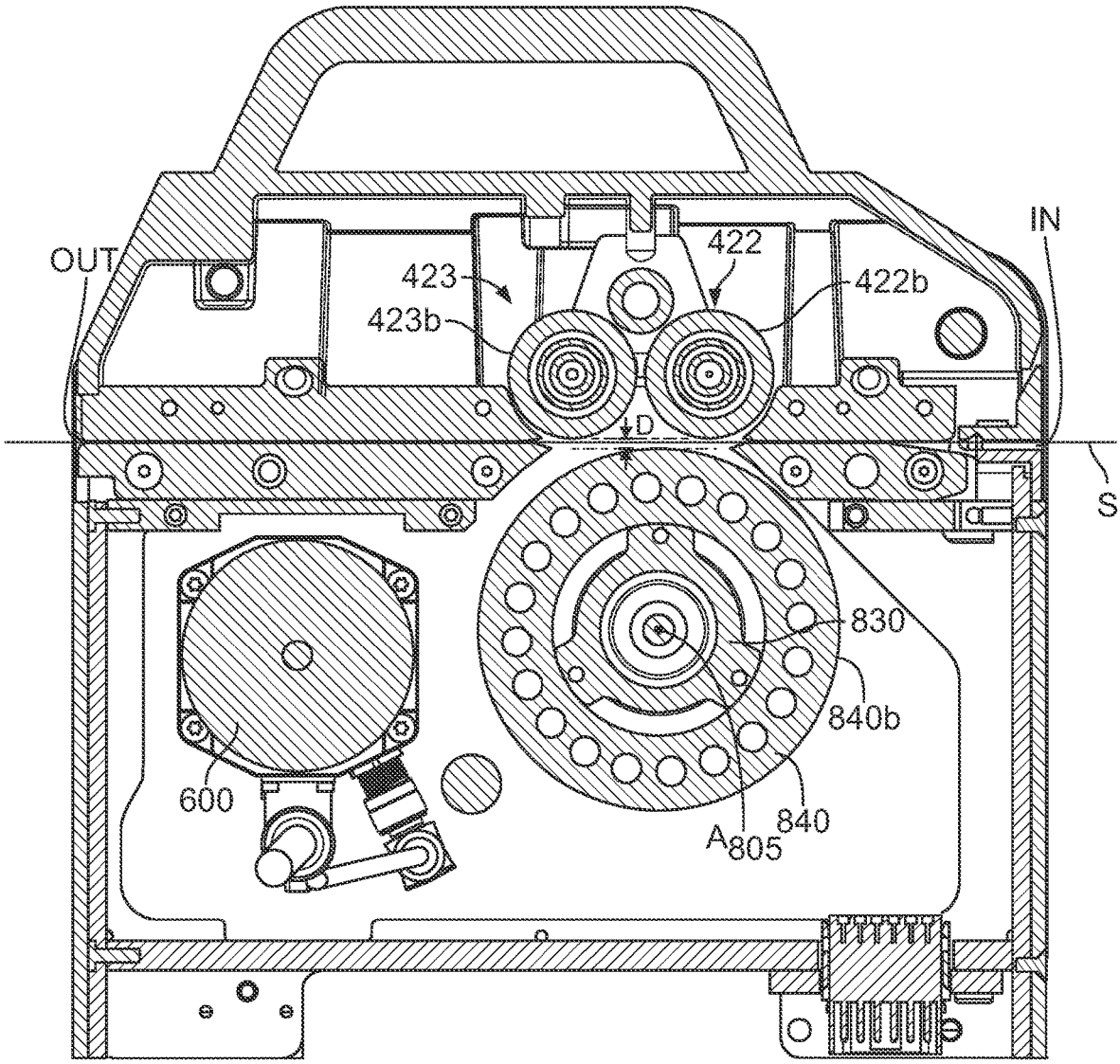
FIGS. 12C, 13C, and 14C are cross-sectional side views that correspond to FIGS. 12A, 13A, and 14A and that are taken substantially along line 12C-12C of FIG. 9B and that show the position of the tensioning wheel relative to the counter rollers.
Figure 13B:
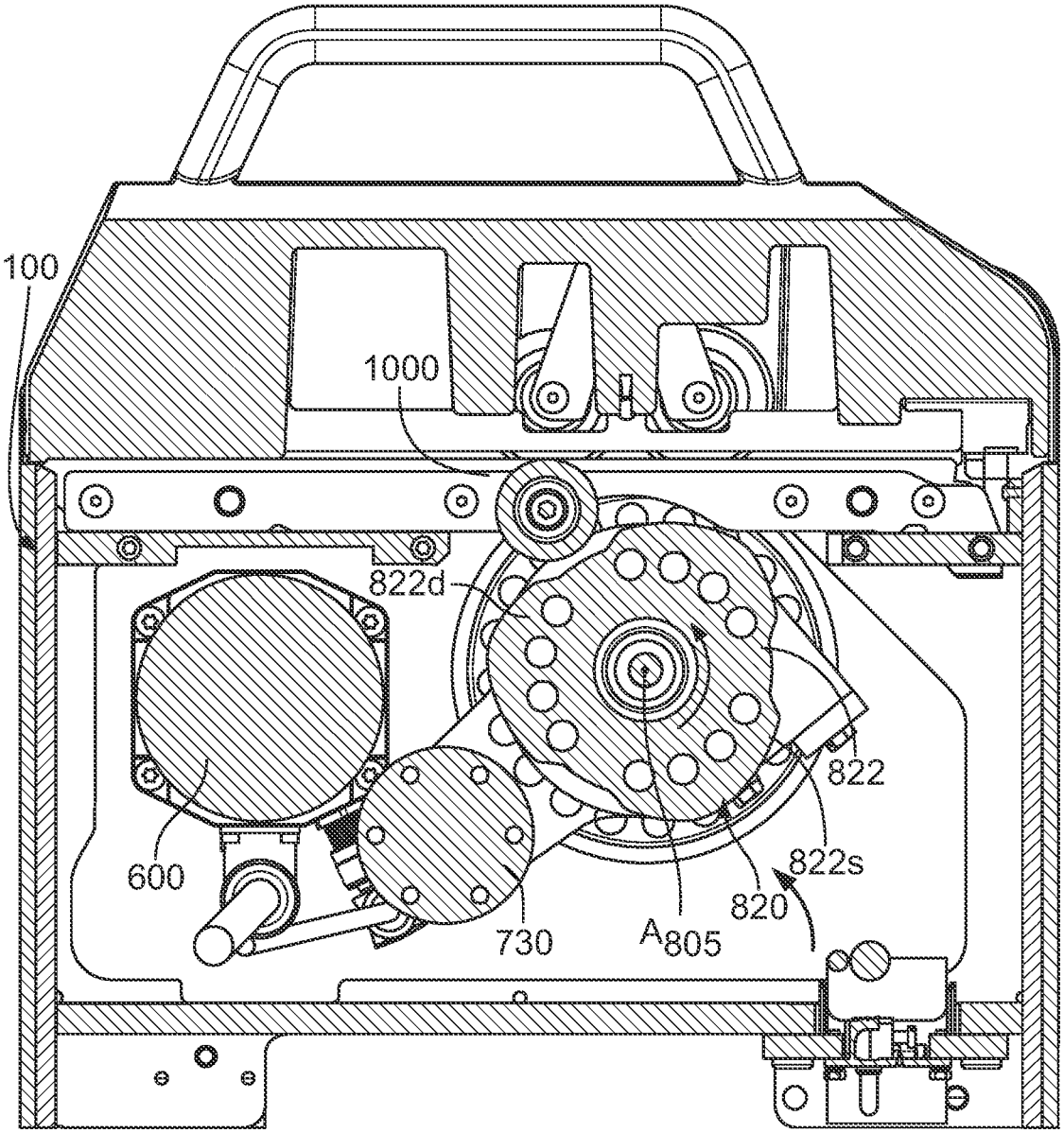
Figure 14B:
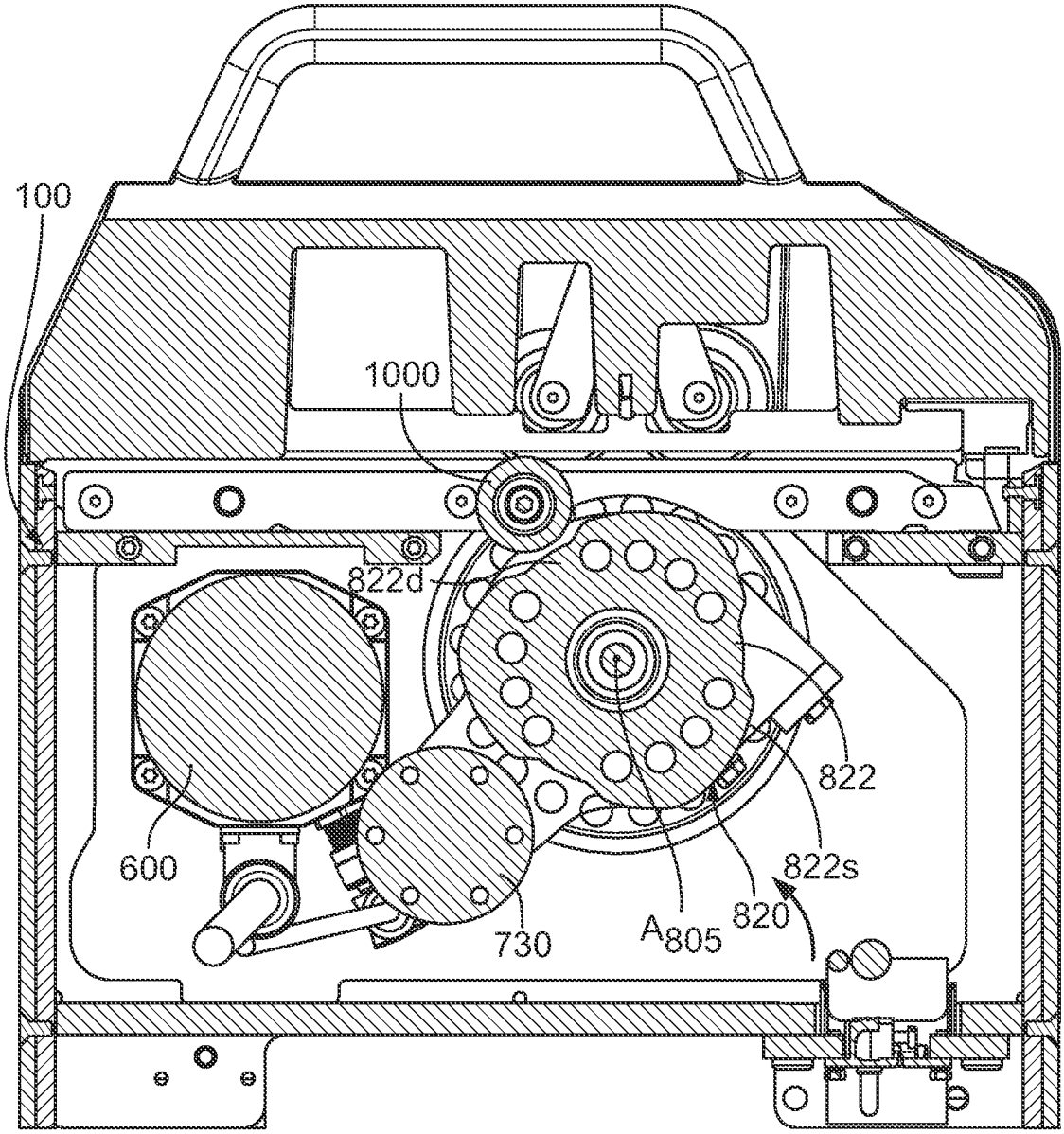

The rotational position of the tensioning-wheel positioner 820 partially controls the rotational position of the tensioning assembly 800 about the axis $A_{705}$ of the transmission shaft. As best shown in FIGS. 12B, 13B, and 14B, a cam follower 1000 is fixedly mounted to the strap-tensioning assembly frame 1000. When the tensioning-wheel positioner 820 is in a retracted rotational position (FIG. 12B), the peak of one of the lobes 822*a*, 822*b*, and 822*c* of the cam 822 engages the cam follower 1000. The geometry of the cam 822 and the position of the cam follower 1000 results in the tensioning-wheel assembly 800 being in its retracted position in which the strap-engaging surfaces 840*a* and 840*b* of the tensioning wheel 840 being spaced-apart from the strap S (FIG. 12C). As the tensioning-wheel positioner 820 rotates away from its retracted rotational position toward its tensioning rotational position (FIG. 13B), the peak of the lobe 822*a*, 822*b*, or 822*c* rotates out of contact with the cam follower 1000. As this occurs, the biasing assembly 900 pulls the tensioning-wheel assembly 800 away from its retracted position to force the cam surface 822*s* to maintain contact with the cam follower 1000. As the distance between the cam surface 822*s* and the cam follower 1000 shrinks, the tensioning-wheel assembly 800 rotates about the axis $A_{705}$ toward the counter rollers 422 and 423.

As the tensioning-wheel positioner 820 reaches its tensioning rotational position, the strap-engaging surfaces 840*a* and 840*b* of the tensioning wheel 840 engage the strap S and force the strap S against the counter rollers 422 and 423 (FIG. 13C), which stops the tensioning-wheel assembly 800 from rotating about the axis $A_{705}$. At this point the trough of one of the recessed portions 822*d*, 822*e*, and 822*f* is adjacent to (but does not contact) the cam follower 1000. This space between the trough and the cam follower enables the tensioning-wheel assembly 800 to further rotate during tensioning to increase the force the tensioning wheel 840 exerts on the strap, as described in detail below.

Operation of the strap-tensioning assembly 10 to tension a strap S around the load L is now described in conjunction with FIGS. 12A-14C. Initially, as shown in FIGS. 12A-12C, the tensioning-wheel positioner 820 is in its retracted rotational position, meaning that the tensioning-wheel assembly 800 and the tensioning wheel 840 are in their respective retracted rotational positions. The strap-feeding assembly FM feeds strap into the inlet IN, through the strap channel SC, and out of the outlet OUT, into and through the sealing assembly SM, and into and around the strap chute CH. After the sealing assembly grips the leading end of the strap, the strap-feeding assembly FM retracts the strap from the strap chute CH and onto the load L.

After the strap has been retracted from the strap chute CH and onto the load L, the strap-tensioning assembly 10 tensions the strap S to a designated tension (which may be preset by the operator). Specifically, the controller C controls the tensioning actuator 600 to rotate the output shaft and the drive gear 610 in the positioning rotational direction P (counterclockwise in this example embodiment) about the axis $A_{605}$. The transmission 700 (and particularly the first and second transmission gears 710 and 720) transmit this drive motion to the driven gear 810 of the transmission-wheel assembly 800 such that the drive gear 810 rotates in the positioning rotational direction P, which in turn causes the transmission-wheel-assembly shaft 805 to rotate in the positioning rotational direction P. As this occurs, the tensioning-wheel positioner 820 rotates with the transmission-wheel-assembly shaft 805 in the positioning rotational direction P, and the tensioning-wheel mount 830 and the tensioning wheel 840 do not rotate with the transmission-wheel-assembly shaft 805 in the positioning rotational direction P.

Figure 13C:
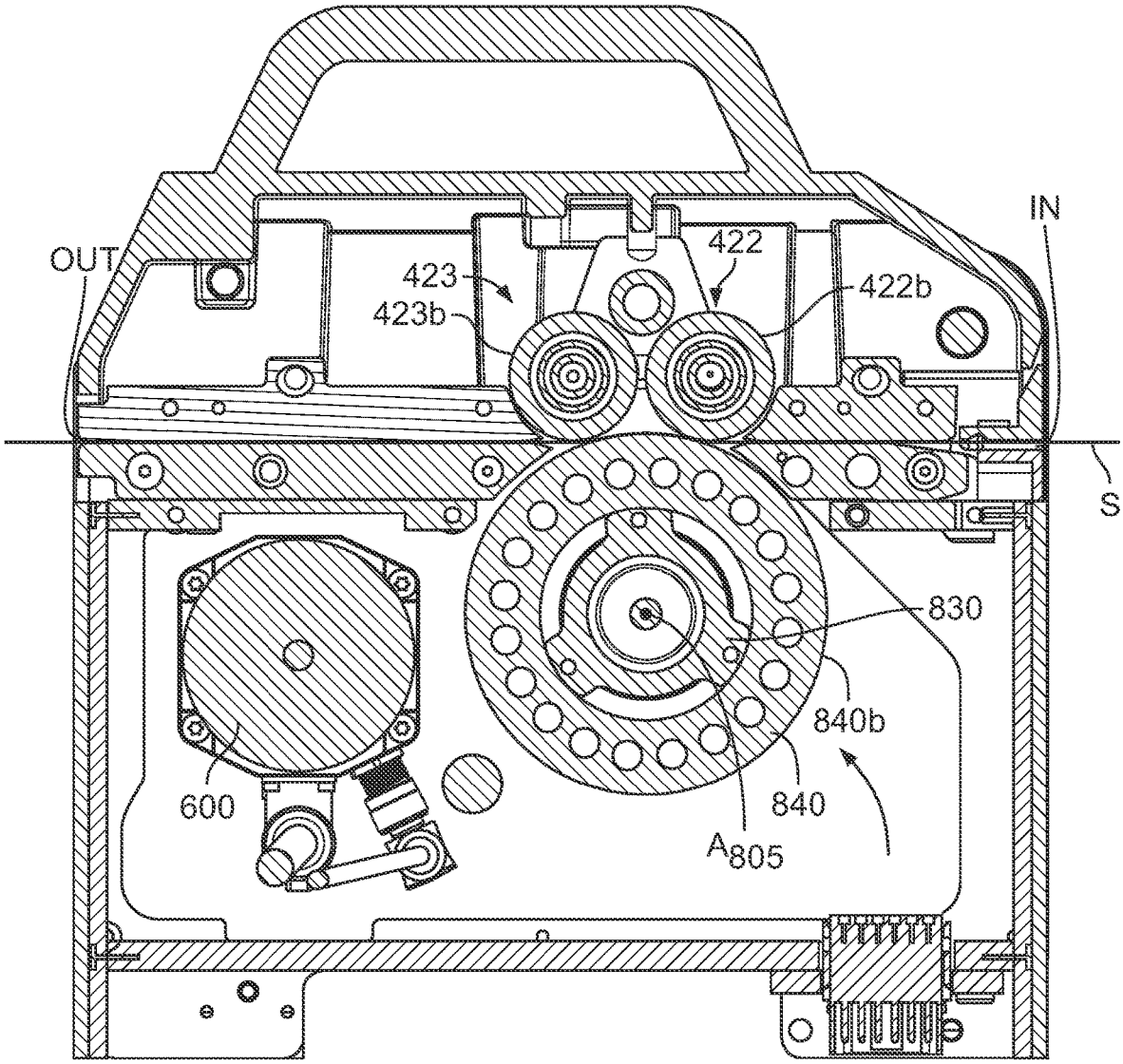

As the tensioning-wheel positioner 820 reaches its tensioning rotational position, the biasing assembly 900 pulls the tensioning-wheel assembly 800 and the tensioning wheel 840 into their respective tensioning rotational positions in which the strap-engaging surfaces 840*a* and 840*b* of the tensioning wheel 840 engage the strap S and force the strap S against the counter rollers 422 and 423, as shown in FIGS. 13A to 13C. After the tensioning-wheel positioner 820 reaches its tensioning rotational position (which a sensor may detect), the controller C controls the tensioning actuator 600 to rotate the output shaft and the drive gear 610 in the tensioning rotational direction T (clockwise in this example embodiment). The transmission 700 (and particularly the first and second transmission gears 710 and 720) transmit this drive motion to the driven gear 810 of the transmission-wheel assembly 800 such that the drive gear 810 rotates in the tensioning rotational direction T, which in turn causes the transmission-wheel-assembly shaft 805 to rotate in the tensioning rotational direction T. As this occurs, the tensioning-wheel positioner 820 does not rotate with the transmission-wheel-assembly shaft 805 in the tensioning rotational direction T, and the tensioning-wheel mount 830 and the tensioning wheel 840 rotate with the transmission-wheel-assembly shaft 805 in the tensioning rotational direction T.

Figure 14C:
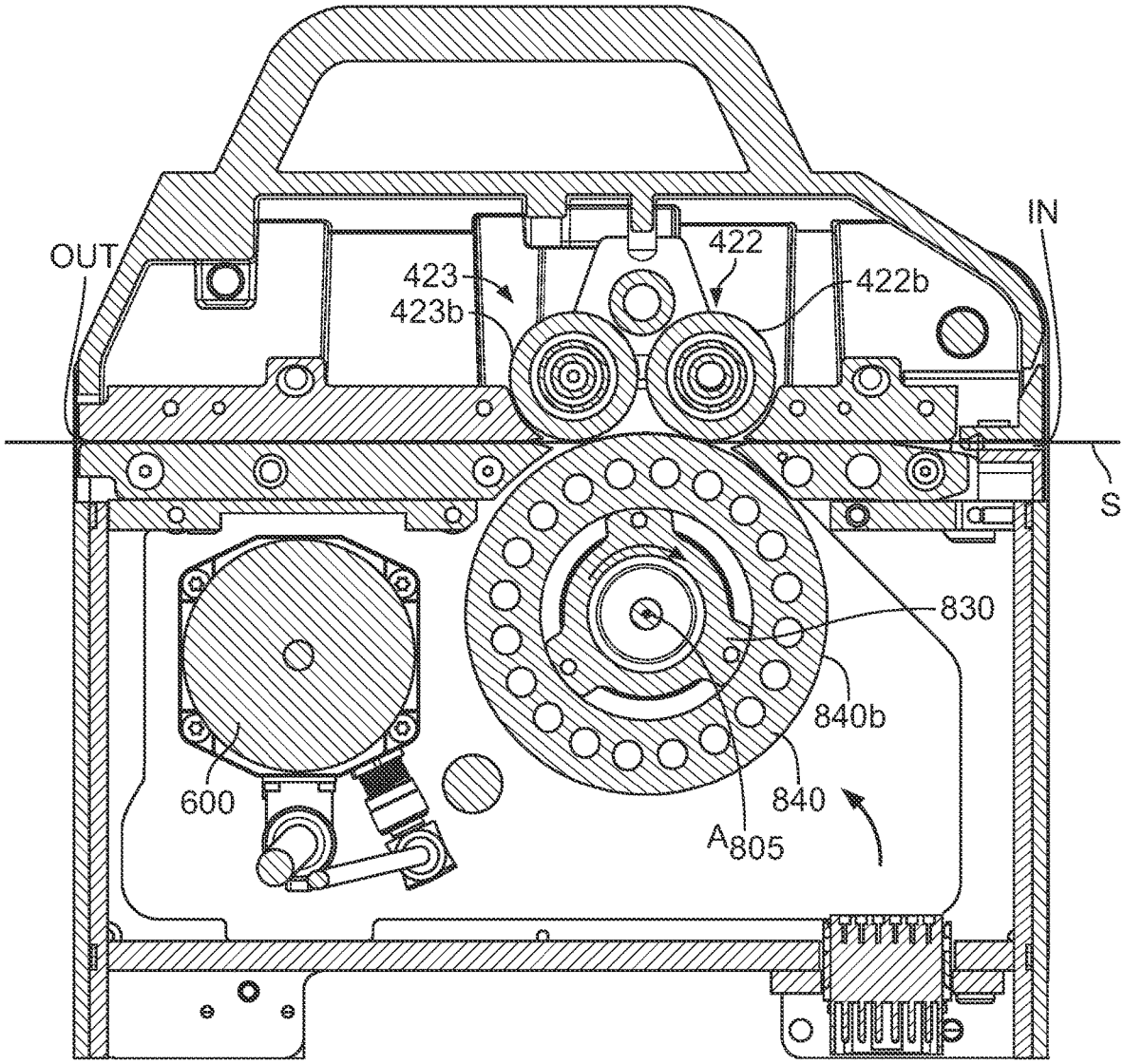

Rotation of the tensioning wheel 840 in the tensioning direction T causes the tensioning wheel to exert a pulling force the strap S to tension the strap S around the load L. Due to the geometry and positioning of the components and the space existing between the cam follower and the trough of the recessed portion of the cam, as the tensioning wheel 840 tensions the strap the tensioning-wheel assembly 800 slightly creeps further away from the retracted and tensioning rotational positions, as shown in FIGS. 14A-14C. This narrows the space between the cam follower 1000 and the trough of the cam 822. This also increases the pressing force the tensioning wheel 840 exerts on the strap S, which reduces the likelihood that the strap will slip during tensioning. The higher the strap tension, the higher the pressing force.

Once the designated tension is reached in the strap (which may be determined by monitoring the current draw of the tensioning actuator 600), the sealing assembly SM cuts the strap from the strap supply to form a trailing strap end and attaches the leading and trailing strap ends to one another. After the sealing assembly forms and grips the trailing strap end (or after the sealing assembly grips the portion of the strap that will become the trailing strap end), the controller C controls the tensioning actuator 600 to rotate the output shaft and the drive gear 610 in the positioning rotational direction P (counter-clockwise in this example embodiment) about the axis $A_{605}$. The transmission 700 (and particularly the first and second transmission gears 710 and 720) transmits this drive motion to the driven gear 810 of the transmission-wheel assembly 800 such that the drive gear 810 rotates in the positioning rotational direction P, which in turn causes the transmission-wheel-assembly shaft 805 to rotate in the positioning rotational direction P. As this occurs, the tensioning-wheel positioner 820 rotates with the transmission-wheel-assembly shaft 805 in the positioning rotational direction P, and the tensioning-wheel mount 830 and the tensioning wheel 840 do not rotate with the transmission-wheel-assembly shaft 805 in the positioning rotational direction P. As this occurs, a lobe of the cam 822 engages the cam follower 1000, eventually forcing the tensioning-wheel assembly 800 to move to its retracted position in preparation for the next strap-tensioning process as its peak reaches the cam follower 1000.

The strap-tensioning assembly improves upon prior art strap-tensioning assemblies in several ways. First, it enables an operator to quickly and easily (and in certain embodiments, toollessly) adjust the width of the strap channel and the height of the strap channel to accommodate straps of different widths and/or thicknesses. Specifically, and as described in more detail above, by simply manipulating the strap-channel-width adjusters and the eccentric mounting pins the operator can ensure that these components are in the optimal position for the particular strap being used. Second, the use of a self-energizing tensioning wheel eliminates the need for extra actuators and additional control-program complexity, which reduces cost and eliminates a potential failure point. Third, the use of a self-energizing tensioning wheel prevents delicate (e.g., thinner) strap from being pressed too forcefully against the counter roller and therefore being damaged. This damage can occur in certain prior art strap-tensioning assemblies including an actuator that uses the same amount of force to press the strap against the counter roller, regardless of its size.

Although the above-described example embodiment of the strap-tensioning assembly includes: (1) the lower strap guide configured to enable an operator to adjust the width of the strap channel; (2) the upper strap guide configured to enable an operator to adjust the height of the strap channel; and (3) the self-energizing tensioning wheel, in other embodiments the strap-tensioning assembly includes any two of these features or only one of these features rather than all three.

In other embodiments, the lower strap-guiding assembly includes only one movable outer guide member that (along with another stationary outer guide member and/or the strap-guiding-assembly frame) partially defines the strap channel. In this embodiment, rotation of the strap-channel-width adjusters causes the movable outer guide member to move as described above.

In other embodiments, the lower strap-guiding assembly includes only one strap-channel-width adjuster or more than one strap-channel-width adjuster.

In other embodiments, the strap-tensioning assembly comprises an actuator operably connected to the strap-channel width adjuster (or to the outer guide member) and configured to manipulate the strap-channel width adjuster to move the outer guide member. In further embodiments, the strap-channel width adjuster comprises an actuator directly connected to the outer guide member and configured to move the outer guide member.

In various embodiments, the strap-tensioning assembly includes only one of: (1) the lower strap-guiding assembly including one or more outer guide members movable to vary the width of the strap channel; and (2) the upper strap-guiding assembly including the eccentric mounting pins manipulatable to vary the distance between the counter roller and the feed wheel. In certain embodiments, one or more of the other assemblies (such as the strap-tensioning assembly and/or the strap-sealing assembly) of the strapping machine include the lower strap-guiding assembly and/or the upper strap-guiding assembly.

In other embodiments, the strap-tensioning assembly includes a mechanical stop positioned to engage part of the tensioning-wheel assembly to prevent the tensioning wheel from contacting the counter rollers if strap is not present between those components. In certain embodiments, the mechanical stop is positioned so the distance between the tensioning wheel and the counter rollers is less than the thickness of the thinnest strap that the strap-tensioning assembly is configured to tension.

The invention claimed is:

1. A strap-tensioning assembly comprising:

a strap-tensioning-assembly frame;

a counter-roller supported by the strap-tensioning-assembly frame; and a tensioning assembly supported by the strap-tensioning-assembly frame and comprising:

a tensioning-wheel assembly comprising:

a tensioning-wheel-assembly shaft defining a rotational axis;

a tensioning wheel mounted to the tensioning-wheel-assembly shaft and rotatable about the rotational axis, wherein the tensioning-wheel assembly is movable from a retracted position in which the tensioning wheel is a first distance from the counter roller and a tensioning position in which the tensioning wheel is a smaller second distance from the counter roller; and a tensioning-wheel positioner mounted to the tensioning-wheel-assembly shaft and rotatable about the rotational axis from a retracted rotational position to a tensioning rotational position to move the tensioning-wheel assembly from the retracted position to the tensioning position; and a tensioning actuator operably connected to the tensioning-wheel-assembly shaft to rotate the tensioning-wheel-assembly shaft in a tensioning rotational direction and in a positioning rotational direction opposite the tensioning rotational direction, wherein the tensioning wheel and the tensioning-wheel positioner are mounted to the tensioning-wheel-assembly shaft such that:

when the tensioning-wheel-assembly shaft rotates about the rotational axis in the tensioning rotational direction, the tensioning wheel rotates with the tensioning-wheel-assembly shaft and the tensioning-wheel positioner does not rotate with the tensioning-wheel-assembly shaft, and when the tensioning-wheel-assembly shaft rotates about the rotational axis in the positioning rotational direction, the tensioning-wheel positioner rotates with the tensioning-wheel-assembly shaft and the tensioning wheel does not rotate with the tensioning-wheel-assembly shaft.

2. The strap-tensioning assembly of claim 1, wherein the tensioning-wheel positioner is mounted to the tensioning-wheel-assembly shaft via a freewheel that operably connects the tensioning actuator to the tensioning-wheel positioner when the tensioning actuator rotates the tensioning-wheel-assembly shaft in the positioning rotational direction and that does not operably connect the tensioning actuator to the tensioning-wheel positioner when the tensioning actuator rotates the tensioning-wheel-assembly shaft in the tensioning rotational direction.

3. The strap-tensioning assembly of claim 2, wherein the freewheel is configured so the tensioning-wheel positioner rotates with the tensioning-wheel-assembly shaft in the positioning rotational direction and so the tensioning-wheel positioner does not rotate with the tensioning-wheel-assembly shaft in the tensioning rotational direction.

4. The strap-tensioning assembly of claim 3, wherein the tensioning-wheel assembly further comprises a tensioning-wheel mount mounted to the tensioning-wheel-assembly shaft to rotate therewith, wherein the tensioning wheel is removably mounted to the tensioning-wheel mount to rotate with the tensioning-wheel mount.

5. The strap-tensioning assembly of claim 3, wherein the freewheel comprises a first freewheel, wherein the tensioning wheel is mounted to the tensioning-wheel-assembly shaft via a second freewheel that operably connects the tensioning actuator to the tensioning wheel when the tensioning actuator rotates the tensioning-wheel-assembly shaft in the tensioning rotational direction and that does not operably connect the tensioning actuator to the tensioning wheel when the tensioning actuator rotates the tensioning-wheel-assembly shaft in the positioning rotational direction.

6. The strap-tensioning assembly of claim 5, wherein the second freewheel is configured so the tensioning wheel rotates with the tensioning-wheel-assembly shaft in the tensioning rotational direction and so the tensioning wheel does not rotate with the tensioning-wheel-assembly shaft in the positioning rotational direction.

7. The strap-tensioning assembly of claim 5, wherein the tensioning-wheel assembly further comprises a tensioning-wheel mount mounted to the tensioning-wheel-assembly shaft via the second freewheel, wherein the tensioning wheel is removably mounted to the tensioning-wheel mount to rotate with the tensioning-wheel mount.

8. The strap-tensioning assembly of claim 3, wherein the tensioning actuator comprises an output shaft, wherein the tensioning assembly further comprises a drive gear fixedly connected to the output shaft to rotate with the output shaft;

wherein the tensioning-wheel assembly further comprises a driven gear fixedly connected to the tensioning-wheel-assembly shaft to rotate with the tensioning-wheel-assembly shaft; and wherein the tensioning assembly further comprises a transmission operably connecting the drive gear to the driven gear.

9. The strap-tensioning assembly of claim 8, wherein the transmission comprises one or more transmission gears fixedly mounted to a transmission shaft to rotate with the transmission shaft, wherein the one or more transmission gears operably connect the drive gear to the driven gear, wherein the tensioning-wheel assembly is mounted to the transmission shaft and rotatable about the transmission shaft from the retracted position to its tensioning position.

10. The strap-tensioning assembly of claim 9, further comprising a biasing assembly biasing the tensioning-wheel assembly toward the tensioning position.

11. The strap-tensioning assembly of claim 10, wherein the tensioning-wheel positioner comprises a cam comprising a lobe comprising a peak positioned a third distance from the rotational axis and a recessed area comprising a trough positioned a smaller fourth distance from the rotational axis, wherein when the tensioning-wheel positioner is in the retracted rotational position, the lobe engages a cam follower supported by the strap-tensioning-assembly frame, and wherein the tensioning-wheel positioner is in the tensioning rotational position, the trough is adjacent the cam follower.

12. The strap-tensioning assembly of claim 11, wherein the trough is spaced-apart from the cam follower when the tensioning-wheel positioner is in the tensioning rotational position.

13. A strap-tensioning assembly comprising:

a strap-tensioning-assembly frame;

a counter-roller supported by the strap-tensioning-assembly frame;

a tensioning assembly supported by the strap-tensioning-assembly frame and including:

a tensioning-wheel assembly comprising:

a tensioning-wheel-assembly shaft defining a rotational axis;

a tensioning wheel mounted to the tensioning-wheel-assembly shaft and rotatable about the rotational axis, wherein the tensioning-wheel assembly is movable from a retracted position in which the tensioning wheel is a first distance from the counter roller and a tensioning position in which the tensioning wheel is a smaller second distance from the counter roller; and a tensioning-wheel positioner mounted to the tensioning-wheel-assembly shaft and rotatable about the rotational axis from a retracted rotational position to a tensioning rotational position to move the tensioning-wheel assembly from the retracted position to the tensioning position, wherein the tensioning-wheel positioner comprises a cam comprising a lobe comprising a peak positioned a third distance from the rotational axis and a recessed area comprising a trough positioned a smaller fourth distance from the rotational axis, wherein when the tensioning-wheel positioner is in the retracted rotational position, the lobe engages a cam follower supported by the strap-tensioning-assembly frame, and wherein when the tensioning-wheel positioner is in the tensioning rotational position, the trough is spaced-apart from the cam follower; and a tensioning actuator operably connectable to the tensioning wheel to rotate the tensioning wheel about the rotational axis in a tensioning rotational direction.

14. The strap-tensioning assembly of claim 13, wherein the tensioning actuator is operably connected to the tensioning-wheel-assembly shaft to rotate the tensioning-wheel-assembly shaft in a tensioning rotational direction and in a positioning rotational direction, wherein the tensioning wheel and the tensioning-wheel positioner are mounted to the tensioning-wheel-assembly shaft such that:

when the tensioning-wheel-assembly shaft rotates about the rotational axis in the tensioning rotational direction, the tensioning wheel rotates with the tensioning-wheel-assembly shaft and the tensioning-wheel positioner does not rotate with the tensioning-wheel-assembly shaft, and when the tensioning-wheel-assembly shaft rotates about the rotational axis in the positioning rotational direction, the tensioning-wheel positioner rotates with the tensioning-wheel-assembly shaft and the tensioning wheel does not rotate with the tensioning-wheel-assembly shaft.

15. The strap-tensioning assembly of claim 14, wherein the tensioning-wheel positioner is mounted to the tensioning-wheel-assembly shaft via a freewheel that operably connects the tensioning actuator to the tensioning-wheel positioner when the tensioning actuator rotates the tensioning-wheel-assembly shaft in the positioning rotational direction and that does not operably connect the tensioning actuator to the tensioning-wheel positioner when the tensioning actuator rotates the tensioning-wheel-assembly shaft in the tensioning rotational direction.

16. The strap-tensioning assembly of claim 15, wherein the freewheel is configured so the tensioning-wheel positioner rotates with the tensioning-wheel-assembly shaft in the positioning rotational direction and so the tensioning-wheel positioner does not rotate with the tensioning-wheel-assembly shaft in the tensioning rotational direction.

17. The strap-tensioning assembly of claim 16, wherein the tensioning-wheel assembly further comprises a tensioning-wheel mount mounted to the tensioning-wheel-assembly shaft to rotate therewith, wherein the tensioning wheel is removably mounted to the tensioning-wheel mount to rotate with the tensioning-wheel mount.

18. The strap-tensioning assembly of claim 16, wherein the freewheel comprises a first freewheel, wherein the tensioning wheel is mounted to the tensioning-wheel-assembly shaft via a second freewheel that operably connects the tensioning actuator to the tensioning wheel when the tensioning actuator rotates the tensioning-wheel-assembly shaft in the tensioning rotational direction and that does not operably connect the tensioning actuator to the tensioning wheel when the tensioning actuator rotates the tensioning-wheel-assembly shaft in the positioning rotational direction.

19. The strap-tensioning assembly of claim 18, wherein the second freewheel is configured so the tensioning wheel rotates with the tensioning-wheel-assembly shaft in the tensioning rotational direction and so the tensioning wheel does not rotate with the tensioning-wheel-assembly shaft in the positioning rotational direction.

20. The strap-tensioning assembly of claim 13, further comprising a biasing assembly biasing the tensioning-wheel assembly toward the tensioning position.

* * * * *